US005478066A

United States Patent [19]

Yoshida et al.

[11] Patent Number: 5,478,066

[45] Date of Patent: Dec. 26, 1995

[54] SHEET SUPPLY APPARATUS

[75] Inventors: Yasumi Yoshida, Kawasaki; Makoto Tanaka, Tokyo; Hiroyuki Takahara, Kawasaki; Takeshi Aoyama, Yokohama; Ryusei Kominato, Tokyo; Shinsuke Ubayashi, Yokohama, all of Japan

[73] Assignee: Canon Kabushiki Kaisha, Tokyo, Japan

[21] Appl. No.: 144,260

[22] Filed: Nov. 1, 1993

[30] Foreign Application Priority Data

| | | | |
|---|---|---|---|
| Nov. 2, 1992 | [JP] | Japan | 4-317887 |
| Dec. 28, 1992 | [JP] | Japan | 4-361205 |
| Dec. 29, 1992 | [JP] | Japan | 4-361273 |
| Feb. 19, 1993 | [JP] | Japan | 5-055096 |
| Mar. 3, 1993 | [JP] | Japan | 5-067452 |

[51] Int. Cl.[6] ..... B65H 5/08

[52] U.S. Cl. ..... 271/12; 271/94; 271/96; 271/99; 271/104; 271/105; 271/106; 271/108; 271/263; 271/902

[58] Field of Search ..... 271/94, 96, 98, 271/99, 104, 105, 106, 108, 122, 265, 263, 258, 11, 12, 902

[56] References Cited

U.S. PATENT DOCUMENTS

| | | | |
|---|---|---|---|
| 3,961,784 | 6/1976 | Serak et al. | 271/94 |
| 4,014,537 | 3/1977 | Stange | 271/105 X |
| 4,159,782 | 7/1979 | Swartzendruber | 271/263 X |
| 4,432,540 | 2/1984 | Akers et al. | 271/94 X |
| 4,596,385 | 6/1986 | Silverberg | 271/94 |
| 5,139,253 | 8/1992 | Bohme et al. | 271/94 X |

FOREIGN PATENT DOCUMENTS

| | | | |
|---|---|---|---|
| 2822692 | 12/1978 | Germany | 271/94 |
| 0067343 | 4/1985 | Japan | 271/94 |
| 3079525 | 4/1991 | Japan | 271/99 |
| 4169433 | 6/1992 | Japan | 271/98 |
| 4-358637 | 12/1992 | Japan . | |
| 4358637 | 12/1992 | Japan | 271/94 |

OTHER PUBLICATIONS

Anderson et al., Document Feeder and Separator, IBM Technical Disclosure Bulletin, vol. 6 No. 2, pp. 32–33, 1963.

*Primary Examiner*—William E. Terrell
*Assistant Examiner*—Carol L. Druzbick
*Attorney, Agent, or Firm*—Fitzpatrick, Cella, Harper & Scinto

[57] ABSTRACT

The present invention provides a sheet supply apparatus with a sheet support for supporting a plurality of sheets, a first sheet absorb unit arranged facing a sheet surface of the sheet stack supported by the sheet support for absorbing the sheet by air suction, a second sheet absorb unit arranged facing a tip end of the sheet stack in a sheet supply direction for absorbing the sheet by air suction and a conveyer for conveying the sheet absorbed to the first and second sheet absorb units. The first sheet absorb unit and the second sheet absorb unit are respectively disposed at positions where the first sheet absorb unit is substantially parallel to the sheet surface and the second sheet absorb unit is inclined relative to the sheet surface. When a sheet stops a feeding unit operates in response to return the sheet to the sheet stack as the sheet is being absorbed by the first sheet absorb unit.

24 Claims, 50 Drawing Sheets

SHEET SUPPLY APPARATUS

BACKGROUND OF THE INVENTION

1. Field of the Invention

The present invention relates to a sheet supply apparatus used with an image forming apparatus such as a copying machine, a printer, a facsimile machine and the like.

2. Related Background Art

In the past, generally, in sheet supply apparatuses used with an image forming apparatus such as a copying machine, a printer, a facsimile machine and the like, sheets stacked on a sheet stacking tray were conveyed one by one by rotational friction of a sheet supply roller. In the sheet supply apparatus of this kind, a surface of the sheet supply roller is formed from elastic material such as rubber, so that the sheet supplying ability greatly depends upon the coefficient of friction of the roller surface. Accordingly, the sheet supplying ability was unstable due to the change in the outer configuration of the sheet supply roller because of the frictional wear, the change in the material of the sheet supply roller through the elapsed time and the change in the coefficient of friction of the roller surface because of the adhesion of paper powder, and other sheets having different surface conditions could not be handled.

To avoid this, recently, there has been proposed a sheet supply apparatus (referred to as "air sheet supply apparatus" hereinafter) in which sheets stacked on a sheet stacking tray is absorbed and conveyed by utilizing an absorbing force of air and a conveying force of an endless belt. FIG. 49 shows a typical example of such air sheet supply apparatus. A sheet convey portion 100 is arranged above a sheet stacking tray 101 on which a plurality of sheets S are stacked. The sheet convey portion 100 comprises a sheet absorb means 102, a convey belt 103 having a plurality of air openings 103A, and a blower 104 for absorbing or sucking air below the convey belt 103 through the air openings 103A and an opening 102A of the sheet absorb means 102.

A nozzle 105 for injecting air to float an uppermost sheet S and a nozzle 106 for injecting air against second, third and other sheets S to separate the uppermost sheet S from the other sheets are arranged in the proximity of a tip end of the sheet stack S rested on the sheet stacking tray 101. The nozzles 105, 106 are connected to a blower 107 so that the air is supplied to these nozzles.

In this air sheet supply apparatus, in order to supply the sheets S stacked on the sheet stacking tray 101, first of all, the air is injected from the nozzle 105 by the action of the blower 107 to float several sheets S on the sheet stacking tray 101. Then, by the absorbing force of the sheet absorb means 102 generated by the action of the blower 104, the uppermost sheet S is absorbed to a sheet absorb surface 103B of the convey belt 103. Thereafter, the convey belt 103 is rotated in a direction shown by the arrow to convey the sheet absorbed to the convey belt 103 in a downstream direction. In this case, the air from the nozzle 106 is blown against a tip end of the sheet S by the action of the blower 107, thereby separating the double-fed second and other sheets (if any) from the uppermost sheet S. In this way, only the uppermost sheet S is sent to a pair of convey rollers 108.

Incidentally, in this air sheet supply apparatus, the sheet S floated by the air from the nozzle 105 and absorbed to the sheet absorb surface 103B of the convey belt 103 by the absorbing force of the sheet absorb means 102 is absorbed to the sheet absorb surface 103B of the convey belt 103 in a condition that the sheet is substantially parallel with the convey belt through the whole length of the sheet. Further, the endless convey belt 103 extends between and wound around two rollers 109, 110 arranged on both sides of the sheet absorb means 102. In this example, the downstream roller 109 is a drive roller rotated by a motor 111, and the upstream roller 110 is a driven roller.

Incidentally, the air generated by the blower 107 flows toward the nozzle 105 when a valve 112 is switched to a position a, and flows toward the nozzle 106 when the valve 112 is switched to a position b. Further, the sheet absorb means 102 is so designed that the absorbing force is generated by the action of the blower 104 when a valve 113 is in a position c, and the absorbing force is not generated when the valve 113 is in a position d.

By the way, in the above-mentioned air sheet supply apparatus, an important factor for separating the sheets S is to surely blow the air from the nozzle 106 between the first sheet S1 to be conveyed and the second sheet S2 to be separated. As shown in FIG. 50, when the air from the nozzle 106 is blown between the first sheet S1 and the second sheet S2, the positive pressure is generated between the sheets, with the result that a downwardly directing force for aiding the separation acts on the second sheet S2 and an upwardly directing force for aiding the absorption of the sheet to the convey belt 103 acts on the first sheet S1. Thus, the first sheet S1 is separated from the second sheet S2. In this way, when any gap exists between the tip end of the first sheet S1 to be conveyed and the tip end of the second sheet S2 to be separated, the air from the nozzle 106 can enter between the sheets S1, S2 to separate the second sheet S2 from the first sheet S1.

However, in the above-mentioned conventional air sheet supply apparatus in which the sheet S floated by the air from the nozzle 105 and absorbed to the sheet absorb surface 103B of the convey belt 103 by the absorbing force of the sheet absorb means 102 is absorbed to the sheet absorb surface 103B of the convey belt 103 in the condition that the sheet is substantially parallel with the convey roller through the whole length of the sheet, the second sheet S2 sometimes could not be separated from the first sheet S1.

That is to say, as shown in FIG. 51, if the tip end of the first sheet S1 is closely contacted with the tip end of the second sheet S2 due to the sticking between fibers of first and second sheets and/or the flash of the cut edges of the sheets generated by the poor cutting, the air from the nozzle 106 will not enter between the first sheet S1 and the second sheet S2, with the result that the positive pressure is generated below the second sheet S2. Accordingly, in this case, the air acts on the undersurface of the second sheet S2 to promote the close contact between the first sheet S1 and the second sheet S2. In particular, in thin sheets, it is feared that the second sheet S2 is absorbed to the convey belt 103 together with the first sheet S1 by the absorbing force of the air from the air openings 103A of the convey belt 103.

In this way, when the tip end of the first sheet is closely contacted with the tip end of the second sheet, it is impossible to separate the second sheet S2 from the first sheet S1. As a result, there arose a problem that the double-feed of the sheets could not be prevented. Further, in order to prevent the double-feed, if the force of the air injected from the nozzle 106 becomes stronger, the first sheet S1 to be conveyed will also be blown out.

SUMMARY OF THE INVENTION

The present invention aims to eliminate the above-mentioned conventional drawbacks, and an object of the present invention is to provide a sheet supply apparatus in which, even if a tip end of a first sheet is closely contacted with a tip end of a second sheet due to the sticking between fibers of these sheets, the first sheet can surely be separated from the second sheet, thereby preventing the double-feed of the sheets.

To achieve the above object, according to the present invention, there is provided a sheet supply apparatus comprising a sheet stacking means on which a plurality of sheets can be stacked, a first air absorb means arranged in opposition to a sheet surface of a sheet stack rested on the sheet stacking means and adapted to absorb a sheet by air suction, a second sheet absorb means arranged at a tip end side of the sheet surface in a sheet convey direction and adapted to absorb a tip end of the sheet by air action, and a convey means for conveying the sheet absorbed by the first and second sheet absorb means, and wherein the first and second sheet absorb means are arranged at positions having different distances from the sheet surface and the sheets are separated one by one by averting the tip end of the sheet.

With the arrangement as mentioned above, since the distance between the first sheet absorb means and the sheet surface is different from the distance between the second sheet absorb means and the sheet surface and since the tip end of the sheet is averted by these sheet absorb means, for example, even if two sheets are absorbed by these sheet absorb means, an upper sheet is directly absorbed by these sheet absorb means to avert the tip end of the sheet. On the other hand, a lower sheet tries to maintain a natural substantially horizontal attitude along a third sheet by its own weight and restoring force. Further, as the sheets continue to be conveyed, the averted tip end portion of the sheet is gradually increased so that a distance between the tip end of the upper sheet and the tip end of the lower sheet is gradually increased.

DETAILED DESCRIPTION OF THE PREFERRED EMBODIMENTS

First of all, a first embodiment of the present invention will be explained with reference to FIG. 1.

Figure 1:
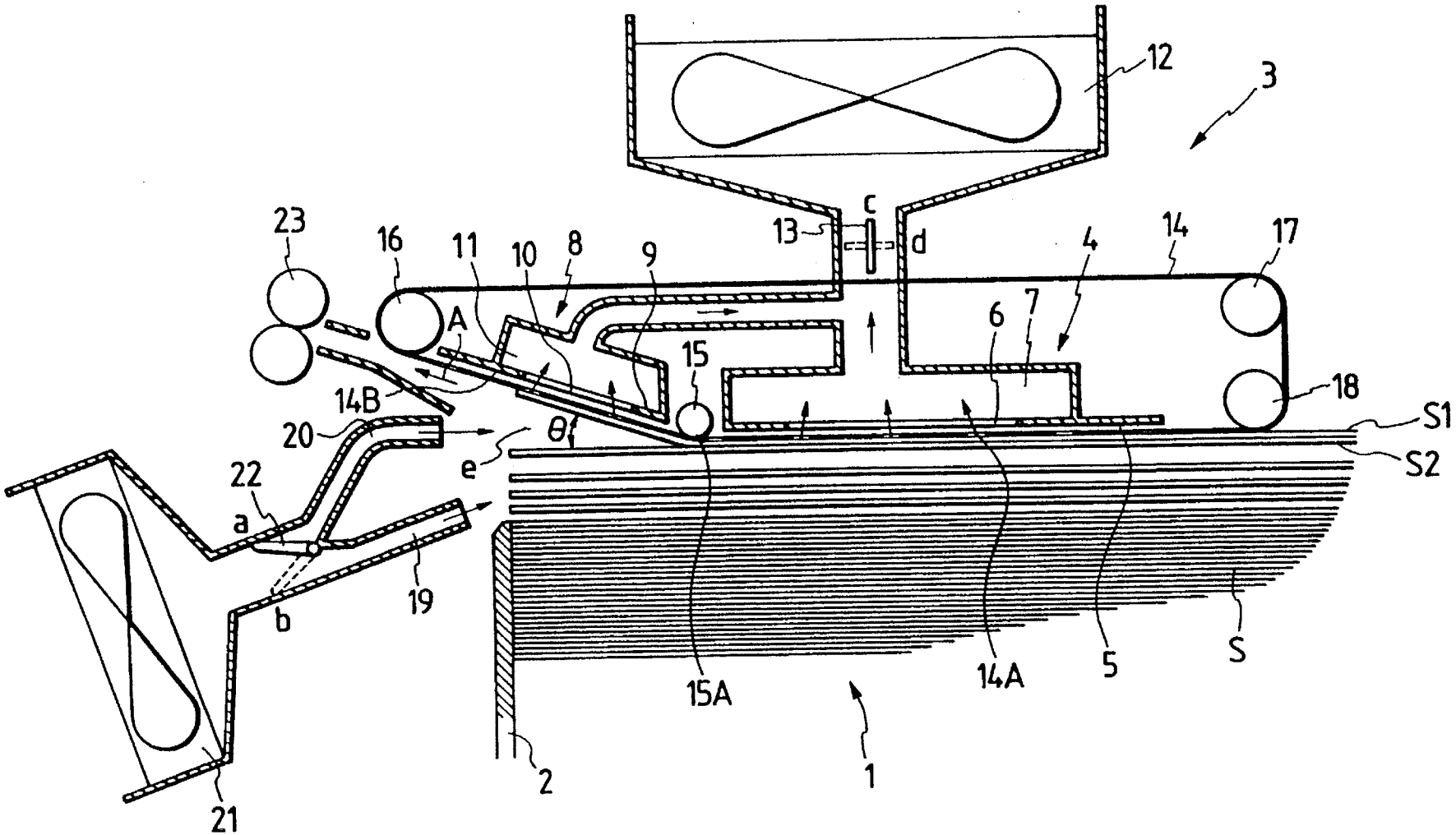
FIG. 1 is an elevational sectional view of a sheet supply apparatus according to a first embodiment of the present invention.

FIG. 1 shows a whole construction of an air sheet supply apparatus according to a first embodiment of the present invention. In FIG. 1, a plurality of sheets S are stacked on a sheet stacking tray 1, and tip ends of the sheets S are abutted against an alignment guide plate 2. A sheet convey portion 3 is provided with a first sheet absorb means 4 which comprises a flat bottom plate 5 opposed to a sheet stack rested on the sheet stacking tray 1, an air absorb opening 6 formed in the bottom plate 5, and a suction chamber 7.

A second sheet absorb means 8 comprises a flat bottom plate 9 disposed at a downstream side of the flat bottom plate 5 in a sheet convey direction and inclined upwardly from the bottom plate 5 by a predetermined angle θ, an air absorb opening 10 formed in the bottom plate 9, and a suction chamber 11. The suction chambers 7, 11 is communicated with an air absorb blower 12. The absorbing action of the blower 12 is ON/OFF controlled by a valve 13.

An endless convey belt 14 is mounted on and around rollers 15, 16, 17 and 18 in such a manner that the whole bottom surfaces of the sheet absorb means 4, 8 are covered by the convey belt. The convey belt 14 has a plurality of air openings 14A formed therein. The convey belt 14 is supported by the rollers 15, 16, 17 and 18 with a predetermined tension and is intermittently driven in a direction shown by the arrow A by a drive means (not shown), thereby conveying the sheet. The roller 15 is disposed at the intersection between the horizontal flat bottom plate 5 and the inclined flat bottom plate 9 and acts as a displacement fulcrum portion 15A for displacing or bending the sheet in such a manner that the sheet becomes convex downwardly. As a result, the tip end of the sheet S sucked by the second sheet absorb means 8 is absorbed to a tip end portion 14B of the convey belt 14 inclined by a predetermined angle.

A nozzle 19 serves to inject air in order to float the sheets S stacked on the sheet stacking tray 1, and a nozzle 20 serves to inject air in order to separate a single sheet from the other sheets. The nozzles 19, 20 are connected to an air injection blower 21. The injection of the air from the nozzles 19, 20 can selectively be switched by a valve 22. A pair of convey rollers 23 serve to convey the sheet S conveyed by the convey belt 14 in a downstream direction.

Next, the operation of the air sheet supply apparatus will be explained.

First of all, the valve 22 is switched to a position a by a switch means (not shown) such as a solenoid so that the blower 21 is operated to inject the air from the nozzle 19 toward the tip end of the sheet stack rested on the sheet stacking tray 1. As a result, several sheets S are blown up to float.

Then, the valve 13 is switched to a position c by a switch means such as a solenoid so that the blower 12 is operated to suck or absorb the air below the convey belt 14 through the absorb openings 6, 10 and the air openings 14A. As a result, a first (uppermost) sheet S1 is absorbed to the sheet absorb means 4, 8 so that the sheet is adhered to the convey belt 14. More specifically, as shown in FIG. 1, a central portion of the sheet S1 is absorbed to the sheet absorb means 4 and the tip end portion of the sheet S1 is absorbed to the sheet absorb means 8. In this case, since the absorbing forces of the sheet absorb means 4, 8 are set to be sufficiently strong, the sheet S1 is bent around the displacement fulcrum portion 15A in opposition to the resilience of the sheet itself, so that the tip end portion and the central portion of the sheet is adhered to the convey belt 14. That is to say, the sheet S1 follows the flat bottom plates 5, 9 to bend around the displacement fulcrum portion 15A so that the sheet becomes convex downwardly.

Now, it is assumed that a second sheet S2 is closely contacted with the first sheet S1. In this case, a central portion of the second sheet S2 substantially follows the first sheet S1. However, since the surface of the sheet absorb means 8 is covered by the sheet S1, the absorbing force does not act on the tip end portion of the sheet S2. Accordingly, the second sheet S2 is not bent around the displacement fulcrum portion 15A in opposition to the resilience of the sheet to maintain the flat condition, so that the tip end of the sheet S2 is separated from the tip end of the sheet S1 to create a gap e between the sheets S1 and S2.

Then, the convey belt 14 is driven by the drive means (not shown) to convey the sheet S1 in the direction shown by the arrow A. At the same time, the valve 22 is switched to a position b to inject the air from the nozzle 20 into the gap e between the sheets S1 and S2, so that, as shown in FIG. 1, the sheet S2 is surely separated from the sheet S1. Accordingly, only the sheet S1 is conveyed toward the downstream direction to be brought to the paired convey rollers 23. Incidentally, the operations of the blowers 12, 21 and the operation of the drive means for the convey belt 14 are controlled by a control means.

Figure 2:
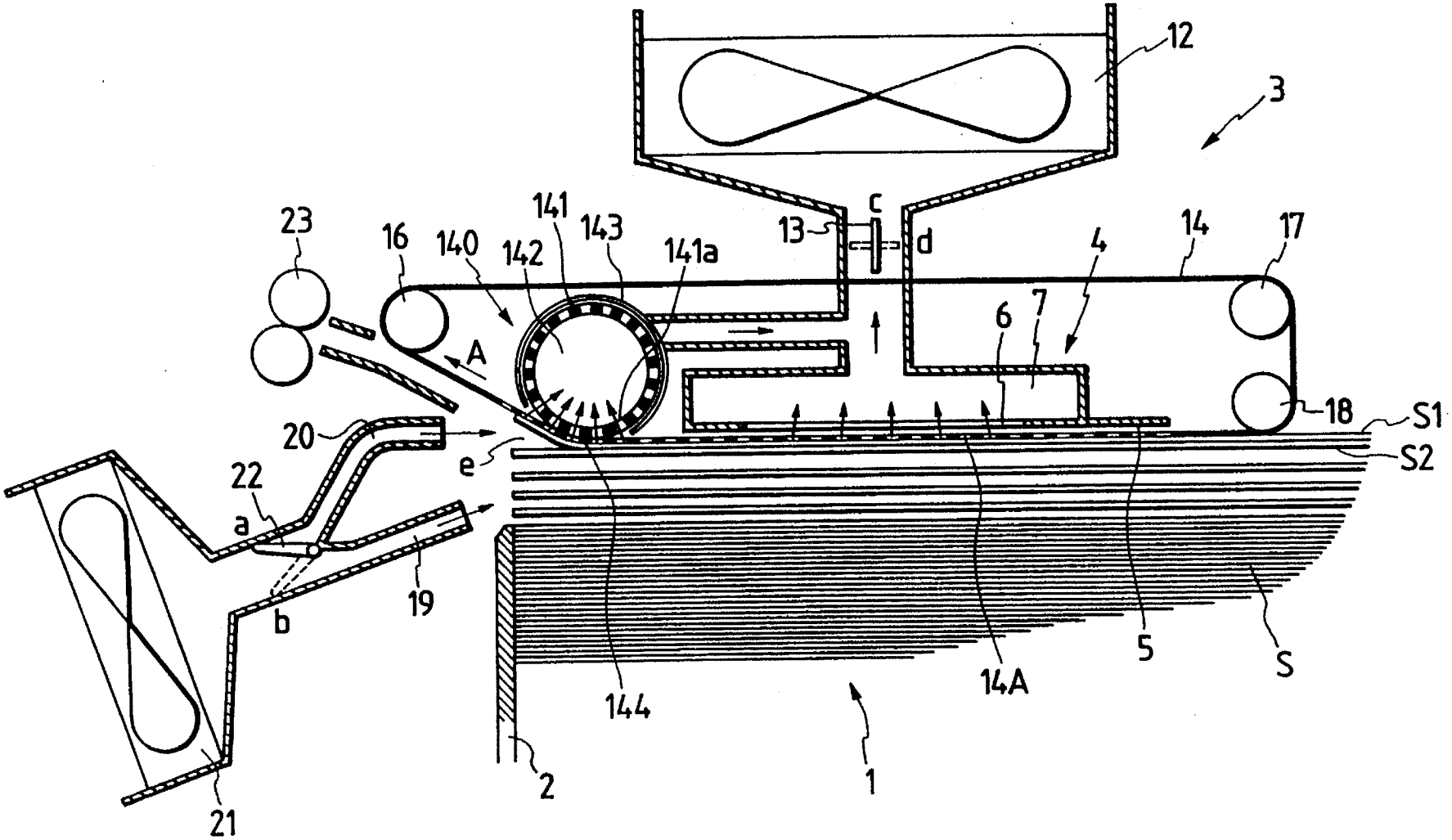
FIG. 2 is an elevational sectional view of a sheet supply apparatus according to a second embodiment of the present invention.

FIG. 2 shows a whole construction of an air sheet supply apparatus according to a second embodiment of the present invention. Incidentally, in this air sheet supply apparatus, the same constructural elements as those of the air sheet supply apparatus according to the first embodiment are designated by the same reference numerals and the detailed explanation thereof will be omitted.

A second sheet absorb means 140 is disposed at a downstream side of the first sheet absorb means 4 in the sheet convey direction. The second sheet absorb means 140 comprises a hollow absorb roller 141 having a plurality of air openings 141A formed in a surface of the roller, a suction chamber 142, and a cover 143 for substantially covering a portion of the absorb roller 141 other than a sheet absorbing portion of the roller. Since the sheet absorbing portion of the absorb roller 141 has a curvature, it is positioned substantially above the flat bottom plate 5 of the sheet absorb means 4. The chambers 7, 142 are communicated with the blower 12.

The convey belt 14 is mounted on and around rollers 15, 16, 17 and 18 in such a manner that the whole bottom surface of the sheet absorb means 4 is covered by the convey belt. The convey belt 14 is supported by the rollers 15, 16, 17 and 18 with a predetermined tension and is intermittently driven in the direction shown by the arrow A by the drive means (not shown), thereby conveying the sheet.

Next, the operation of this air sheet supply apparatus will be explained.

First of all, the valve 22 is switched to the position a by the switch means (not shown) such as a solenoid so that the blower 21 is operated to inject the air from the nozzle 19 toward the tip end of the sheet stack rested on the sheet stacking tray 1. As a result, several sheets S are blown up to float.

Then, the valve 13 is switched to the position c by the switch means such as a solenoid so that the blower 12 is operated to suck or absorb the air through the absorb opening 6 and the air openings 141A, 14A. As a result, the first (uppermost) sheet S1 is absorbed to the sheet absorb means 4, 140 so that the sheet is adhered to the convey belt 14. More specifically, as shown in FIG. 2, the central portion of the sheet S1 is absorbed to the sheet absorb means 4 and the tip end portion of the sheet S1 is absorbed to the sheet absorb means 140. Since a surface of the sheet absorb means 140 has the predetermined curvature, the tip end of the sheet S1 is lifted upwardly substantially along the curvature in opposition to the resilience of the sheet and is adhered to the convey belt 14. That is to say, the sheet S1 is bent around a position from which the convey belt 14 starts to be curved (i.e., a position 144 where the absorb roller 141 is contacted with the convey belt 14) so that the sheet S1 becomes convex downwardly.

Then, as in the first embodiment, when the sheet S1 is conveyed while injecting the air into the gap e between the sheets S1 and S2, the sheet is conveyed toward the downstream direction without the double-feed.

Figure 3:
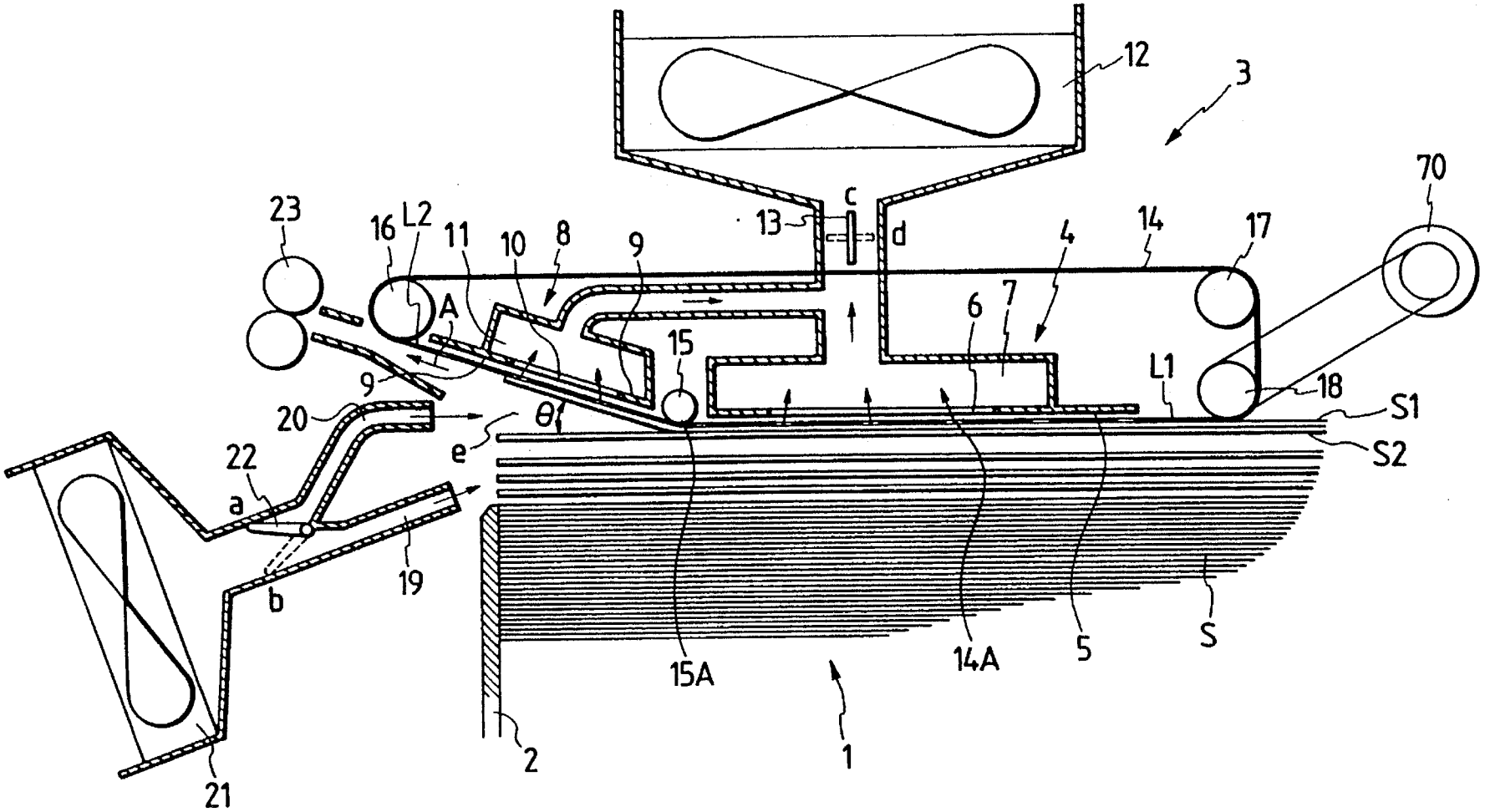
FIG. 3 is an elevational sectional view of a sheet supply apparatus according to a third embodiment of the present invention.

FIG. 3 shows a construction of an air sheet supply apparatus according to a third embodiment of the present invention. The construction of this air sheet supply apparatus is substantially the same as the air sheet supply apparatus according to the first embodiment fundamentally.

In this air sheet supply apparatus, the rollers 15, 18 and the sheet absorb means 4 are arranged so that a straight line L1 connecting between lower ends of the rollers 15 and 18 is positioned toward the surface of the sheet stack more than the flat bottom surface 5 of the sheet absorb means 4. Further, the rollers 15, 16 and the sheet absorb means 8 are arranged so that a straight line L2 connecting between lower ends of the rollers 15 and 16 is positioned toward the surface of the sheet stack more than the flat bottom surface 9 of the sheet absorb means 8.

Further, in this air sheet supply apparatus, the roller 18 is a drive roller driven by a motor 70 to rotate the convey belt 14, and the other rollers 15, 16 and 17 are driven roller rotated by the movement of the convey belt 14. When a driving force is transmitted from the motor 70 to the roller 18 to rotate the convey belt in the direction shown by the arrow A, the convey belt 14 is tensioned between the rollers 17 and 18 and is loosened between the rollers 18 and 15 and between the rollers 15 and 16.

Next, the operation of this air sheet supply apparatus will be explained.

First of all, the valve 22 is switched to the position a by the switch means (not shown) such as a solenoid so that the blower 21 is operated to inject the air from the nozzle 19 toward the tip end of the sheet stack rested on the sheet stacking tray 1. As a result, several sheets S are blown up to float.

Then, the valve 13 is switched to the position c by the switch means such as a solenoid so that the blower 12 is operated to such or absorb the air below the convey belt 14 through the absorb openings 6, 10 and the air openings 14A. As a result, the first (uppermost) sheet S1 is absorbed to the sheet absorb means 4, 8 so that the sheet is adhered to the convey belt 14. In this case, since the convey belt 14 is loosened between the rollers 18 and 15 and between the rollers 15 and 16, the loosened portions of the convey belt are absorbed to the sheet absorb means 4 and the sheet absorb means 8, respectively, together with the sheet S1 and are slightly contacted with the flat bottom plates 5, 9 of the sheet absorb means 4, 8, respectively.

Since the separation and conveyance of the sheet which are then effected are the same as those in the first embodiment, the explanation thereof is omitted.

Incidentally, in this embodiment, while the roller 18 associated with the convey belt 14 was drive roller, the roller 15 may be a drive roller. In this case, since the roller disposed at the upstream side of the sheet absorb means 8 (i.e., roller 15) is the drive roller, a portion of the convey belt 14 between the rollers 15 and 16 is loosened, with the result that the tip end portion of the sheet can be absorbed effectively.

Figure 4:
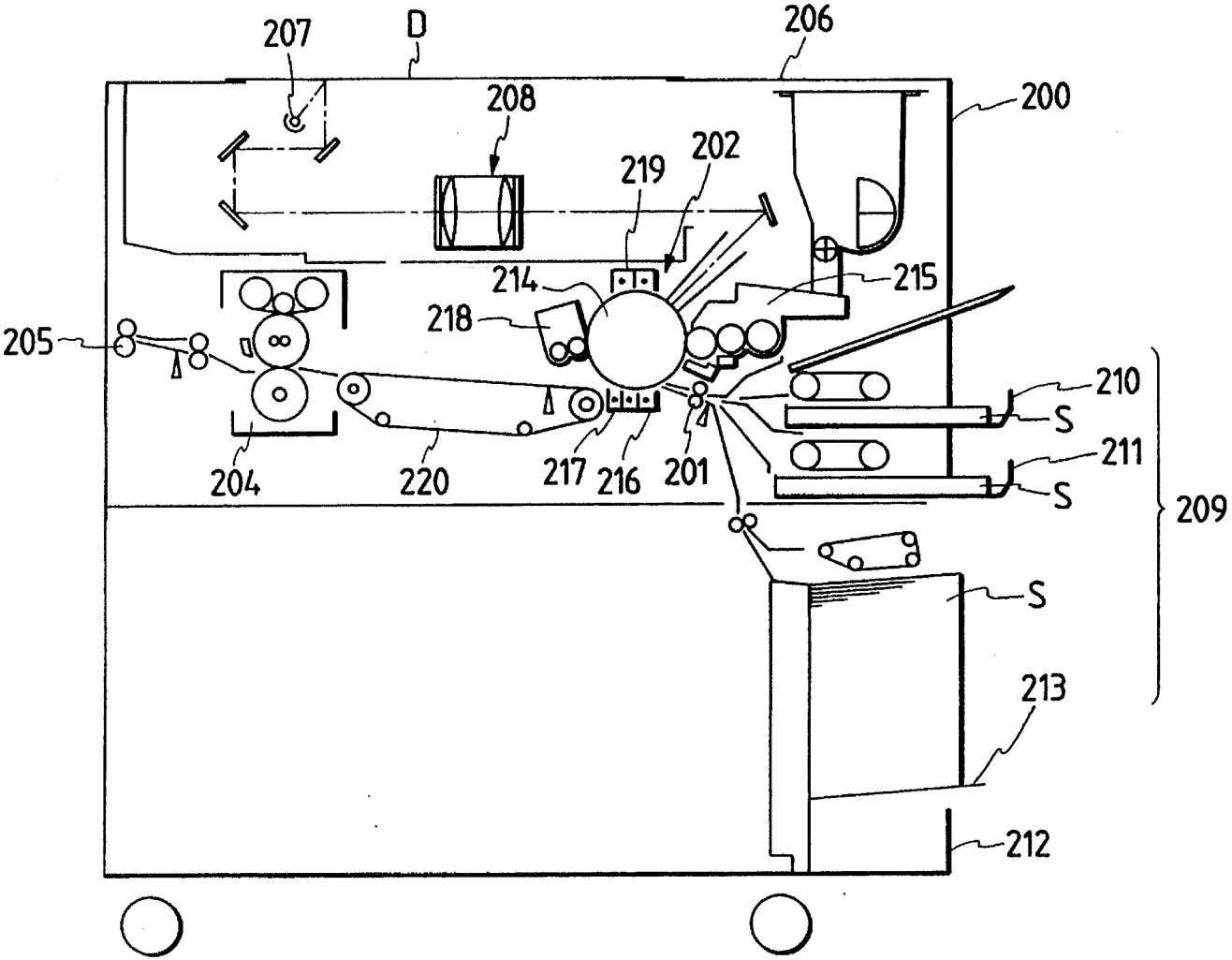
FIG. 4 is an elevational sectional view showing an example of an image forming apparatus having the sheet supply apparatus of the present invention.

Now, FIG. 4 shows an example of an image forming apparatus (copying machine) having the sheet supply apparatus of the present invention.

The image forming apparatus 200 is provided with an original support 206, a light source 207, a lens system 208, a sheet supply portion 209 and an image forming portion 202. The sheet supply portion 209 has cassettes 210, 211 adpated to contain sheets S and removably mounted to the image forming apparatus 200, and a deck 213 arranged on a pedestal 212. The sheet supply apparatus of the present invention is mounted on the deck 213. The image forming portion 202 includes a cylindrical photosensitive member 214, a developing device 215 containing toner, a transfer charger 216, a separation charger 217, a cleaner 218 and a first or primary charger 219. A convey device 220, a fixing device 204 and discharge rollers 295 are arranged at a downstream side of the image forming portion 202.

Next, the operation of the image forming apparatus will be explained. When a sheet supply signal is outputted from a control device (not shown) of the image forming apparatus 200, the sheet S is supplied from the cassette 210 or 211 of the deck 213. On the other hand, light omitted from the light source 207 and reflected from an original D rested on the original support 206 is incident to the photosensitive member 214 through the lens system 208. The photosensitive member 214 is previously charged by the primary charger 219. Accordingly, when the photosensitive member is illuminated by the reflected light, an electrostatic latent image is formed on the photosensitive member, which latent image is then developed by the developing device 215 as a toner image.

The sheet S supplied from the sheet supply portion 209 is sent to regist rollers 201, where the skew-feed of the sheet is corrected. Then, the sheet is sent to the image forming portion 202 with a predetermined timing. In the image forming portion 202, the toner image formed on the photosensitive member 214 is transferred onto the sheet S by the transfer charger 216, and then the sheet to which the toner image was transferred is separated from the photosensitive member 214 by applying to the sheet the charge opposite to that of the transfer charger 216 by the separation charger 217. The separated sheet S is sent, by the convey device 220, to the fixing device 204, where the transferred non-fixed image is permanently fixed to the sheet. The sheet S to which the image was fixed is discharged out of the image forming apparatus 200 by the discharge rollers 205.

In this way, the sheet S which was supplied from the sheet supply portion 209 and on which the image was formed is discharged.

Next, a fourth embodiment of the present invention will be explained with reference to FIG. 5.

This embodiment differs from the first embodiment only in the point that an angle θ of the displacement fulcrum portion 15A is variable. The same constructural elements as those of the first embodiment are designated by the same reference numerals and the detailed explanation thereof will be omitted, and the only difference will be fully explained.

Figure 5:
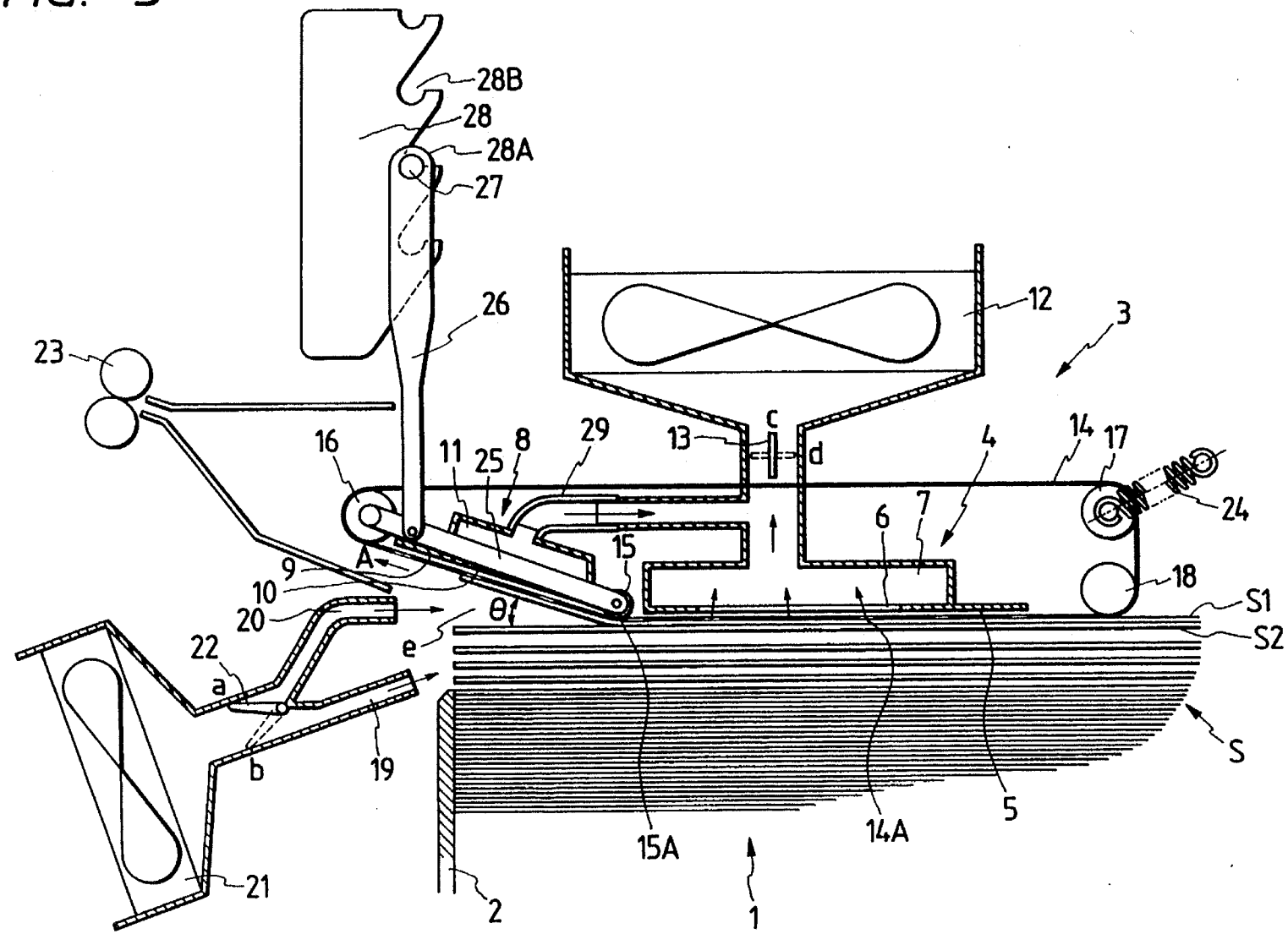
FIG. 5 is an elevational sectional view of a sheet supply apparatus according to a fourth embodiment of the present invention.

In FIG. 5, an angle adjustment shaft support plate 25 for rotatably supporting the rollers 15, 16 is rotatably mounted on a roller shaft of the roller 15, and an angle adjustment arm 26 is rotatably attached to the angle adjustment support plate 25. A stopper shaft 27 is provided on the other end of the angle adjustment arm 26 so that the stopper shaft 27 can be locked in a recess 28A or 28B of a stopper 28. These recesses serve to previously set an angle θ (referred to as "separation angle" hereinafter) to an angle satisfying the following two conditions in response to the resilience of the sheet S to be conveyed. The first condition is that only the uppermost sheet S1 is completely absorbed to the second sheet absorb means 8, and the second condition is that a force for maintaining the lower sheet S2 to a flat attitude by the resilience of the sheet is greater than a force bending the lower sheet S2 absorbed together with the uppermost sheet S1 around the displacement fulcrum portion 15A to become convex downwardly.

Next, the operation of this air sheet supply apparatus in a case where the resilience of the sheet is great will be explained with reference to FIG. 5. When the resilience of the sheet is great, if the separation angle θ is great, since the uppermost sheet S1 is stabilized and is not absorbed to the second sheet absorb means 8, the separation angle θ is set to be small. In this case, the stopper shaft 27 is introduced into the recess 28A of the stopper 28. Thereafter, the valve 22 is switched to the position b by the switch means (not shown) such as a solenoid so that the blower 21 is operated to inject the air from the first nozzle 19 toward the tip end of the sheet stack So As a result, several sheets S are blown up to float. Then, the valve 13 is switched to the position c by the switch means (not shown) such as a solenoid so that the blower 12 is operated to absorb the air through the air absorb openings 6, 10 and the air openings 14A.

Consequently, the uppermost sheet S1 is absorbed to the first and second sheet absorb means 4, 8 and is adhered to the convey belt 14. More specifically, as shown in FIG. 5, the central portion of the sheet S1 is absorbed to the first sheet absorb means 4 and the tip end portion of the sheet S1 is absorbed to the second sheet absorb means 8. In this case, since the separation angle θ was previously set to be small, the sheet S1 is bent around the displacement fulcrum portion 15A in opposition to the resilience of the sheet S1, so that the tip end portion and the central portion of the sheet S1 are closely adhered to the convey belt 14. That is to say, the sheet S1 substantially follows the flat bottom plate 5 and is bent around the displacement fulcrum portion 15A to become convex downwardly. In this case, since the separation angle θ was previously set to be small as mentioned above, the lower sheet S2 is not bent around the displacement fulcrum portion 15A to maintain the flat attitude, with the result that the tip end of the sheet S2 is separated from the tip end of the sheet S1 to create the gap e therebetween.

Thereafter, the convey belt 14 is driven by the drive means to convey the uppermost sheet S1 in the direction shown by the arrow A. At the same time, the valve 22 is switched to the position b, with the result that the air from the second nozzle 20 is blown into the gap e between the sheets S1 and S2, thereby separating the sheet S2 stably. Accordingly, only the sheet S1 is conveyed in the downstream direction to be sent to the paired convey rollers 23.

Figure 6:
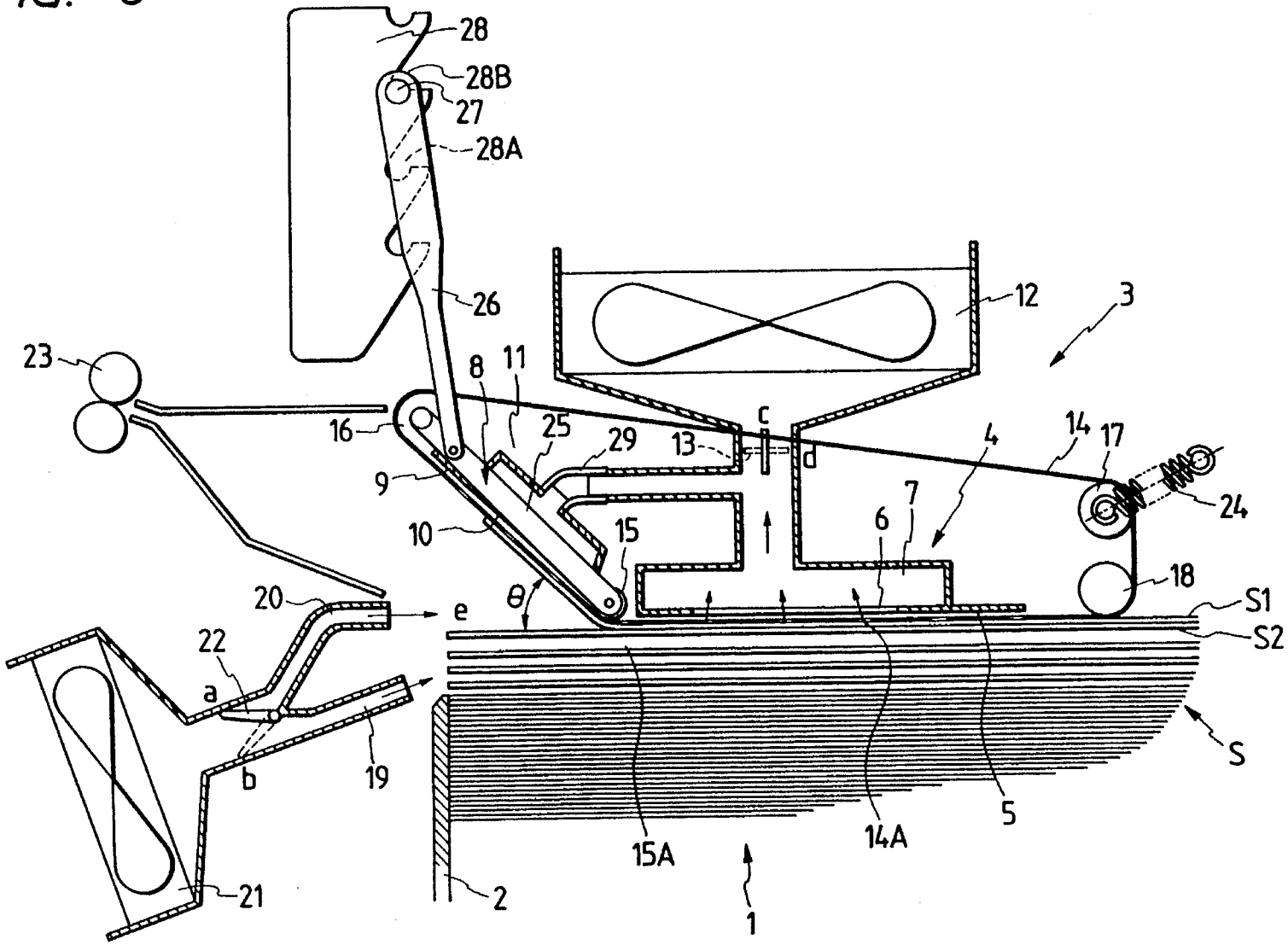
FIG. 6 is an elevational sectional view of the apparatus of FIG. 5 in its operative condition.

Next, a case where the resilience of the sheet is weak will be explained with reference to FIG. 6. In the case where the resilience of the sheet S is weak, if the separation angle θ is small, when the uppermost sheet S1 is absorbed, since the lower sheet S2 is apt to be absorbed together with the uppermost sheet, the separation angle θ is set to be great. In this case, the stopper shaft 27 is introduced into the recess 28B of the stopper. By increasing the separation angle θ in this way, the sheet having the weak resilience can also be surely separated.

In this fourth embodiment, while an example that the separation angle θ can be varied with two stages was explained, the present invention is not limited to this example, but the separation angle may be varied with any plural stages or in a stageless manner. Further, it should be noted that a range of the separation angle θ (including 0°) may be appropriately set.

Next, a fifth embodiment of the present invention will be explained with reference to FIG. 7. Incidentally, in an air sheet supply apparatus according to the fifth embodiment, the same constructural elements as those of the first embodiment are designated by the same reference numerals and the detailed explanation thereof will be omitted.

In the aforementioned fourth embodiment, the time period from when the first and second sheet absorb means 4, 8 start to the suction to when the convey belt 14 starts to drive was normally constant. However, since the second absorb means 8 is spaced apart from the uppermost surface of the sheet stack S rested on the sheet stacking tray 1, depending upon the kinds of the sheet (thick sheet, thin sheet or the like) and the change in the sheet supply environment, the time period from when the second sheet absorb means 8 starts to the suction to when the sheet S is absorbed to the second sheet absorb means 8 was varied. Accordingly, if the convey belt 14 starts to drive before the sheet S is absorbed to the second sheet absorb means 8, it was feared that the poor sheet supply occurs. To avoid this, if the time period from when the second sheet absorb means 8 starts to the suction to when the convey belt 14 starts to drive becomes long sufficient to surely absorb the sheet S to the second sheet absorb means 8, the sheet supply cycle will be longer, thereby reducing the number of sheets supplied per unit time.

Figure 7:
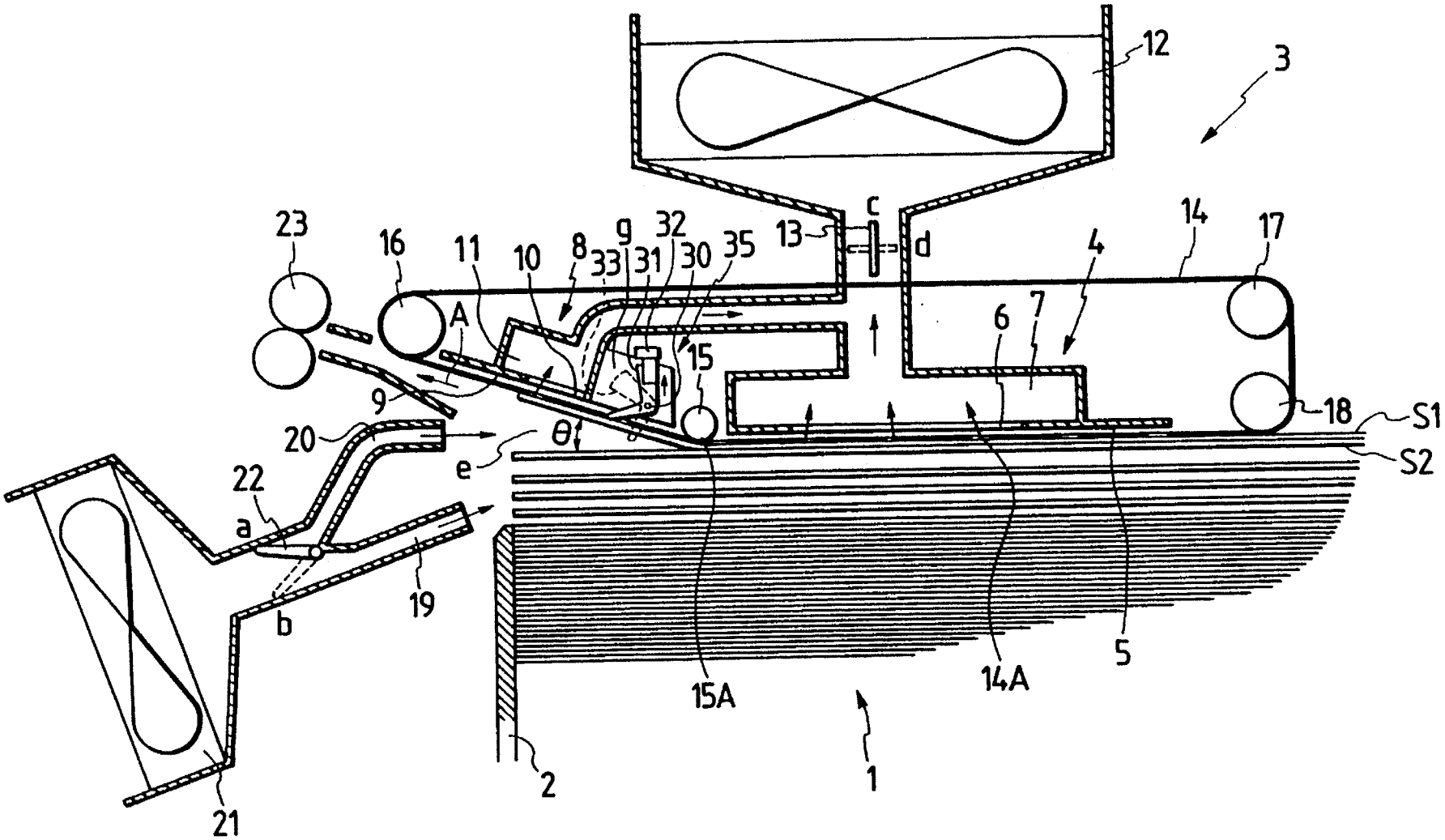
FIG. 7 is an elevational sectional view of a sheet supply apparatus according to a fifth embodiment of the present invention.

Thus, as shown in FIG. 7, a sheet detection portion (detection means) 35 comprising a flag 31 pivotally mounted on a shaft 30, a photo-sensor 32 and a stopper 33 is provided on the second sheet absorb means 8 so that it can be judged whether the sheet S is absorbed to the second sheet absorb means 8 or not.

Figure 8:
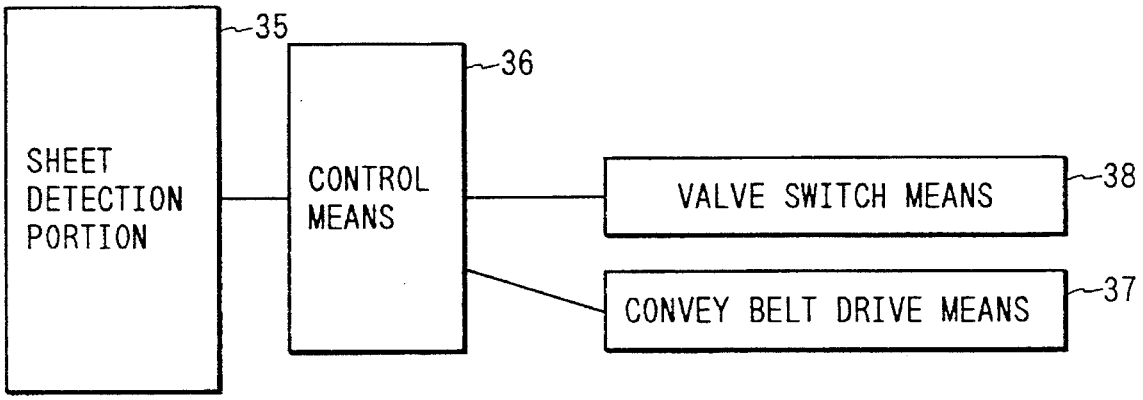
FIG. 8 is a control block diagram of the apparatus of FIG. 7.

FIG. 8 shows a control block diagram of the air sheet supply apparatus according to the fifth embodiment. A detection signal from the sheet detection portion 35 is inputted to a control means 36, and the control means 36 controls a convey belt drive means 37 and a valve switch means 38.

The flag 31 is rocked by the sheet S absorbed to the second sheet absorb means 8 to be shifted to a condition f, thereby detecting the suction of the sheet S by the photo-sensor 32. When the detection signal outputted from the photo-sensor 32 is inputted to the control means 36, the convey belt 14 is driven by the convey belt drive means 37, thereby conveying the sheet S1 in the direction shown by the arrow A. At the same time, the valve 22 is switched to the position b by the valve switch means 38 to inject air from the second nozzle 20 into the gap e between the sheets S1 and S2, thereby separating the sheet S2 stably. Accordingly, only the sheet S1 is conveyed toward the downstream direction to be sent to the paired convey rollers 23.

In the above-mentioned fifth embodiment, while an example that the timing for starting the drive of the convey belt 14 is the timing for detecting the sheet S by the sheet detection portion 35 was explained, the present invention is not limited to this example. For example, it is assumed that the time when the valve 13 is switched to the position c is t=0, the time period until the sheet S is detected by the sheet detection portion 35 is $t=T_2$, and any time period from when the valve 13 is switched to the position c is $t=T_1$, when $T_2<T_1$ the drive of the convey belt 14 may be started at $t=T_1$ and when $T_2>T_1$ the drive of the convey belt 14 may be started at $t=T_2$. Thus when the time period $T_2$ is set to a certain large extent, since the drive of the convey belt 14 is started at $t=T_1$ in the normal sheet supply operation, and the drive of the convey belt is started at $t=T_2$ only when the suction of the sheet S to the second sheet absorb means 8 is delayed suddenly, it is possible to achieve the stable sheet supply operation.

Incidentally, in this fifth embodiment, while an example that the separation angle θ is constant was explained, the present invention is not limited to this example.

Next, a sixth embodiment of the present invention will be explained with reference to FIG. 9. Incidentally, in an air sheet supply apparatus according to the sixth embodiment, the same constructural elements as those of the fifth embodiment are designated by the same reference numerals and the detailed explanation thereof will be omitted.

Figure 9:
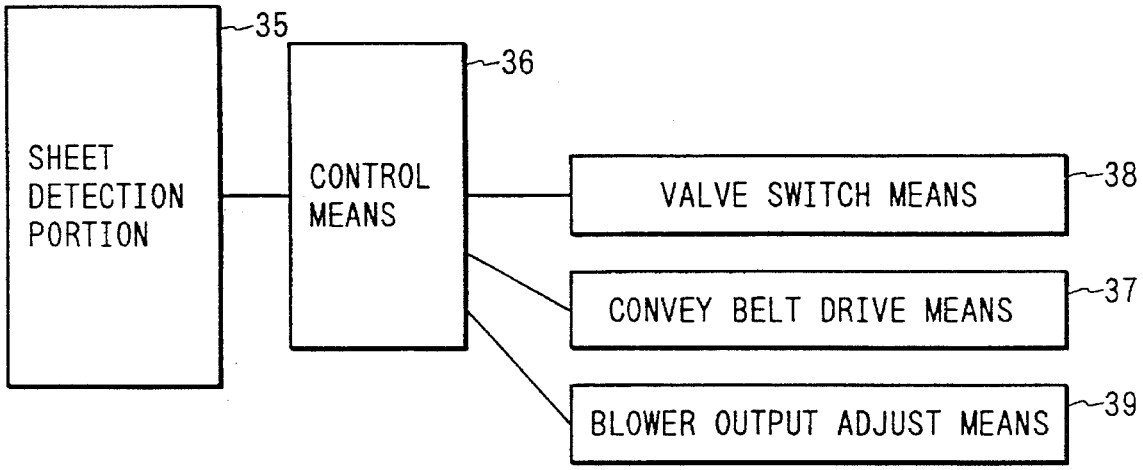
FIG. 9 is a control block diagram of a sheet supply apparatus according to a sixth embodiment of the present invention.

In this sixth embodiment, as shown in FIG. 9, the control means 36 also controls a blower output adjust means 39 for adjusting the output of the blower 12, as well as the aforementioned valve switch means 38 and convey belt drive means 37. It is assumed that the time when the valve 13 is switched to the position c is t=0, the time period until the sheet S is detected by the sheet detection portion 35 is $t=T_2$, and any time period from when the valve 13 is switched to the position c is $t=T_1$, when $T_2>T_1$, the output of the blower 12 is increased by the control means 36 to increase the absorbing force of the second sheet absorb means 8. In this way, even a sheet S which is hard to be absorbed to the second sheet absorb means 8 can be absorbed surely and quickly. Thereafter, as in the aforementioned fifth embodiment, the convey belt 14 is driven by the convey belt drive means 47 to start the sheet supply operation.

Incidentally, the output adjust means may be provided on the blower 21 in place of the blower 12 so that the blowing force of the first nozzle 19 is increased to absorb the sheet S to the second sheet absorb means 8. Of course, in place of the blower output adjust means, a switching valve and the like may be provided to adjust the absorbing force and/or the blowing force.

Incidentally, in the sixth embodiment, while an example that the separation angle θ is constant was explained, the present invention is not limited to this example.

Next, a seventh embodiment of the present invention will be explained with reference to FIGS. 10 to 13. Incidentally, in an air sheet supply apparatus according to the seventh embodiment, the same constructural elements as those of the fourth embodiment are designated by the same reference numerals and the detailed explanation thereof will be omitted.

In the aforementioned fourth embodiment, since the air from the second nozzle 20 is blown in the proximity of the tip end portion B (FIG. 10) of the sheet S absorbed to the second sheet absorb means 8 to separate the lower sheet S2, it is required to adjust the blowing position of the second nozzle 20 against the second sheet absorb means 8 with high accuracy. In particular, when the second sheet absorb means 8 is movable, since the second nozzle 20 is integrally formed with the first nozzle 19 and the blower 21, in response to the change in the separation angle θ between the first sheet absorb means 4 and the second sheet absorb means 8, it was feared that the position of the second nozzle 20 is deviated with respect to the tip end portion B of the sheet S.

Figure 10:
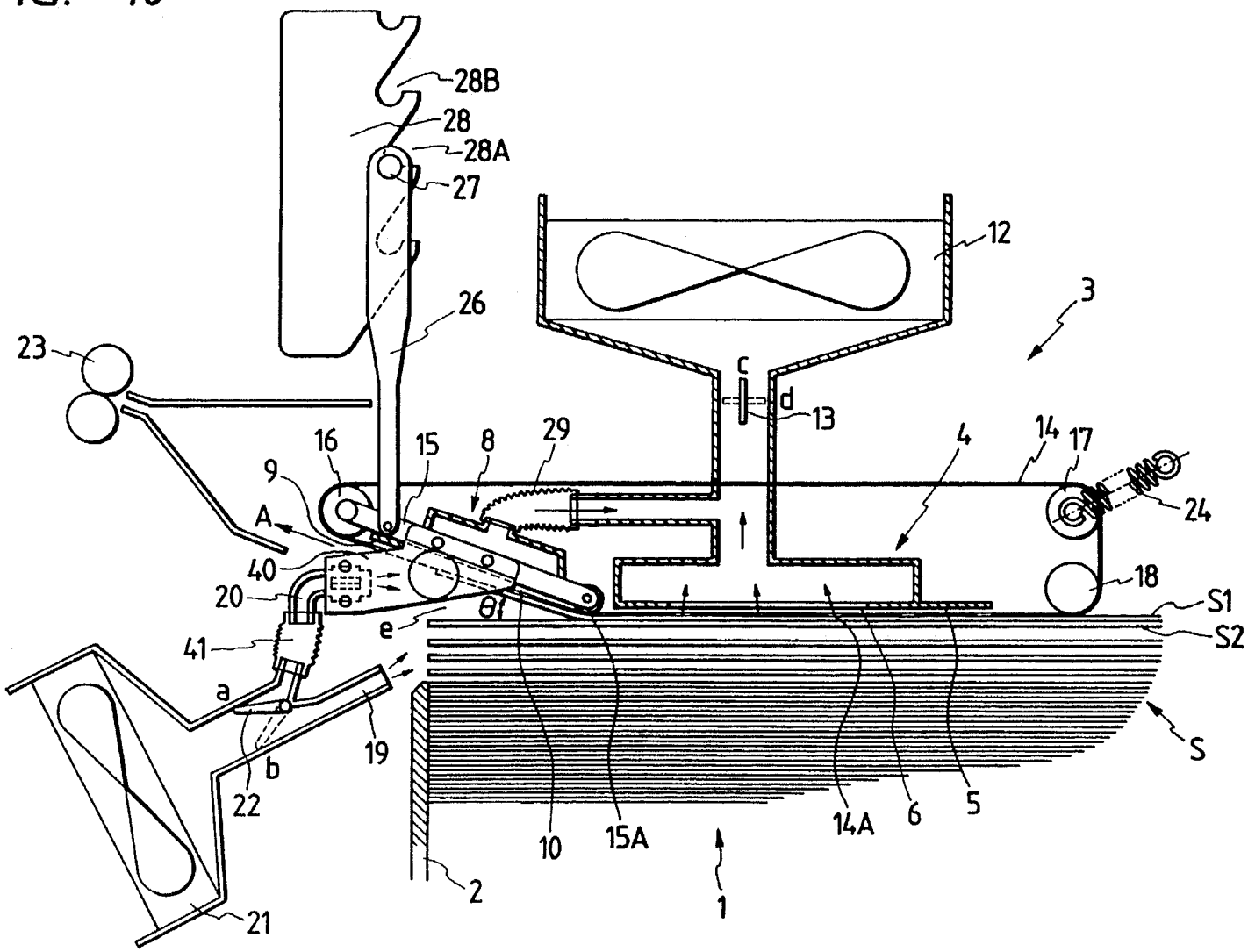
FIG. 10 is an elevational sectional view of a sheet supply apparatus according to a seventh embodiment of the present invention.

To avoid this, as shown in FIG. 10, the second nozzle 20 is secured to the angle adjustment support plate 25 by a nozzle attachment plate 40 and the second nozzle is connected to the blower 21 via a flexible duct 41. With this arrangement, the air injected from the second nozzle 20 can always impinge against the tip end portion B of the sheet S, thereby eliminating the above-mentioned disadvantage.

Figure 11:
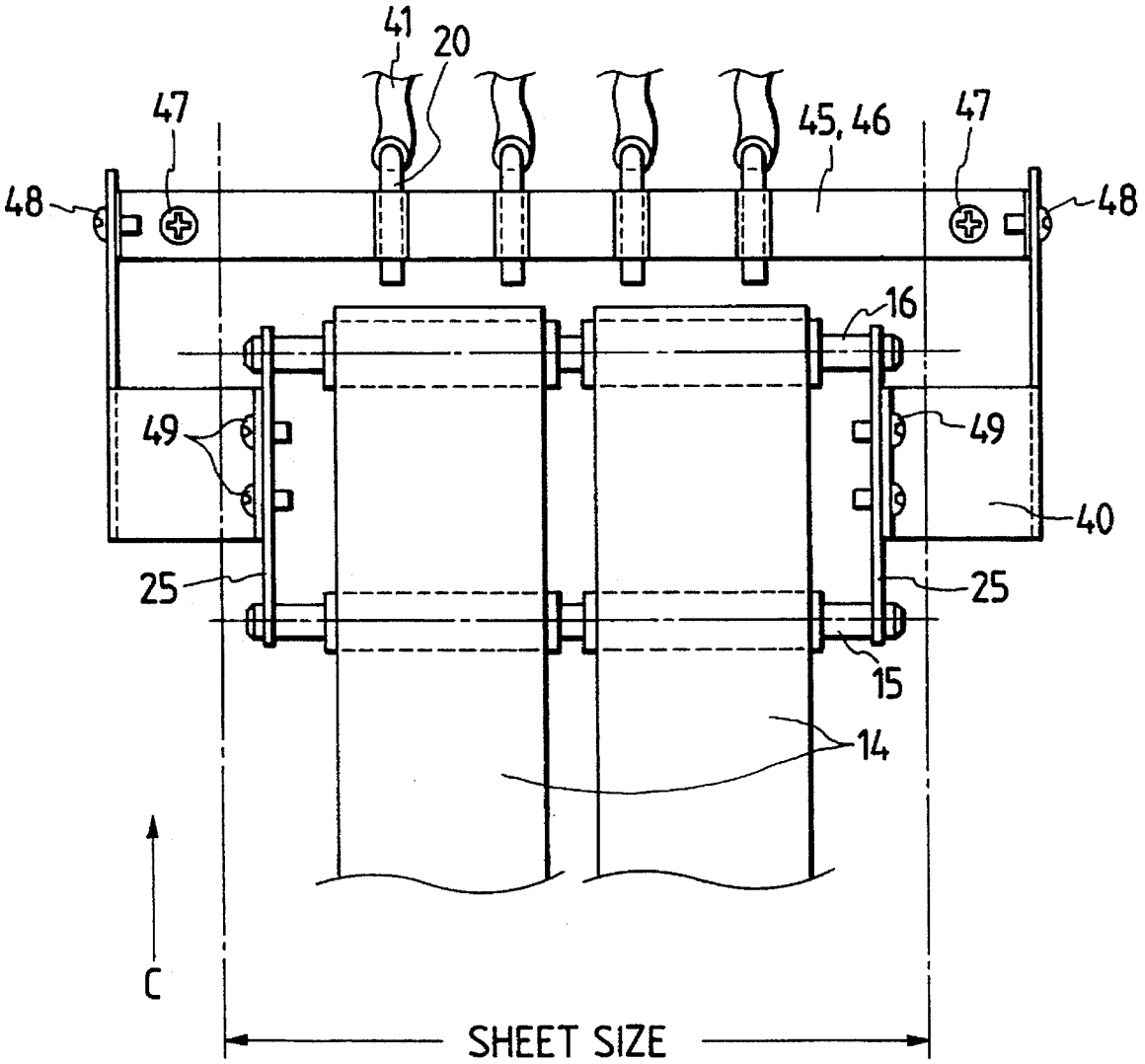
FIG. 11 is a plan view of nozzles and therearound of the apparatus of FIG. 10.
Figure 12:
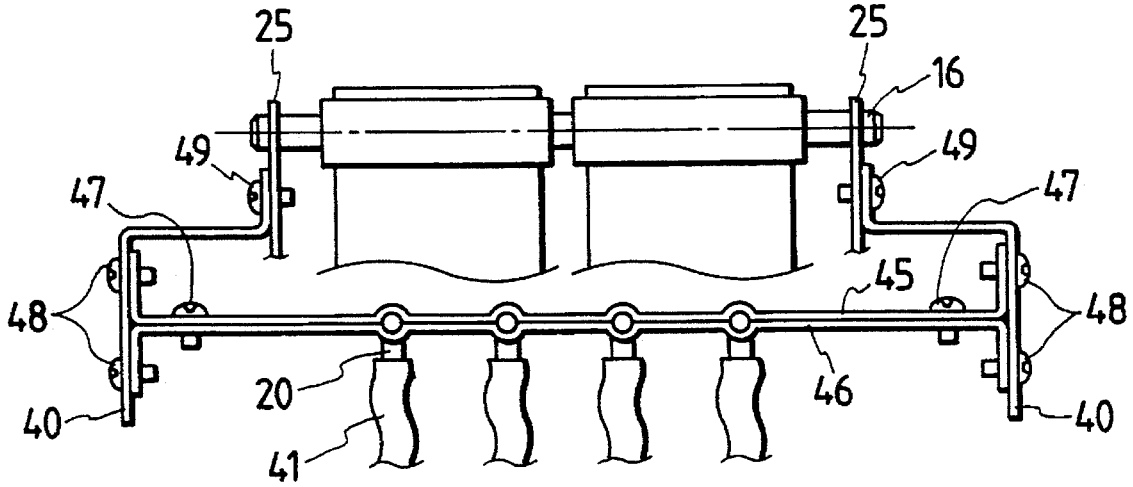
FIG. 12 is a view looked at along the arrow of FIG. 11.
Figure 13:
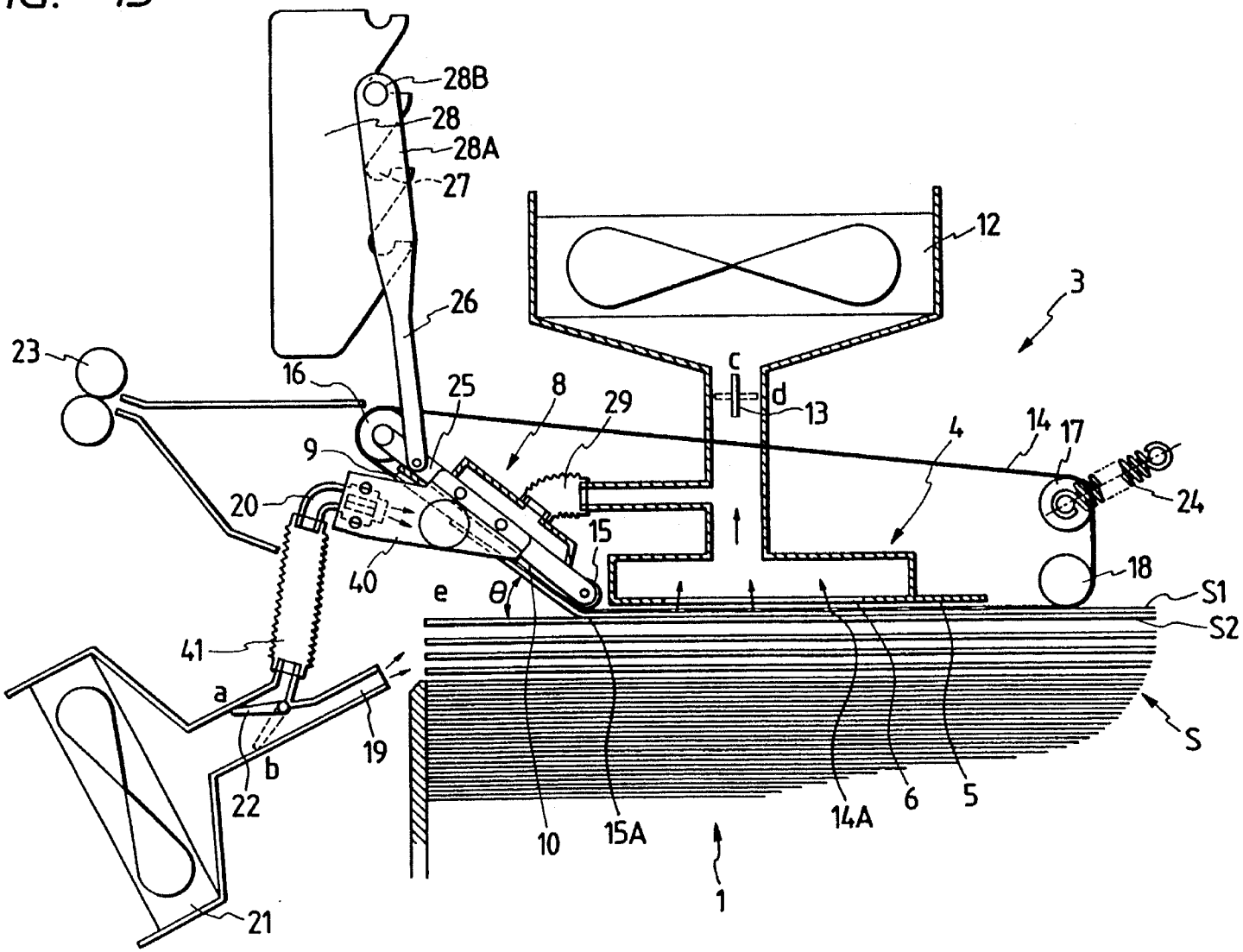
FIG. 13 is an elevational sectional view of the apparatus of FIG. 10 in its operative condition.

FIG. 11 is a schematic top view of the second nozzles 20 and therearound of FIG. 10, and FIG. 11 is a view looked at along the arrow C in FIG. 11. The second nozzles 20 are pinched by nozzle stays 45, 46 and are fixed to the nozzle stays by screws 47. Further, the nozzle stays 45, 46 are secured to the nozzle attachment plate 40 by screws 48, which nozzle attachment plate 40 is secured to the angle adjustment support plate 25 by screws 49. FIG. 13 shows a condition that the separation angle θ is increased. In this condition, when the angle adjustment support plate 25 is shifted, the second nozzles 20 are also shifted, and, thus, since the angle between the second nozzles and the flat bottom plate 9 of the second sheet absorb means 8 is not varied, the sheet can be separated regardless of the separation angle θ.

Figure 14:
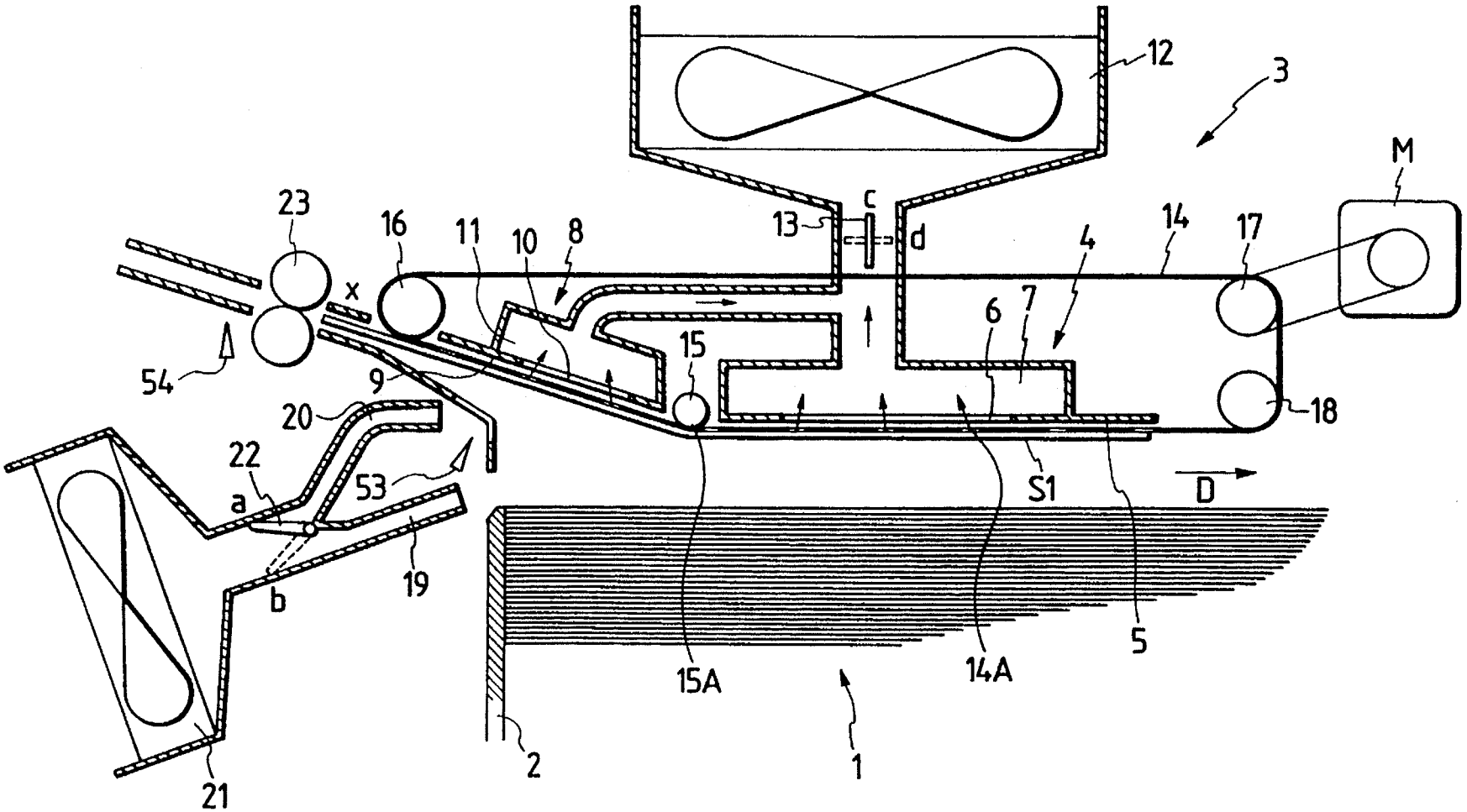
FIG. 14 is an elevational sectional view of a sheet supply apparatus according to an eighth embodiment of the present invention.

Next, an eighth embodiment of the present invention will be explained with reference to FIG. 14. Incidentally, in an air sheet supply apparatus according to the eighth embodiment, the same constructural elements as those of the first embodiment are designated by the same reference numerals and the detailed explanation thereof will be omitted.

When the sheet is jammed in the image forming apparatus, the delay and stay of the sheet is detected by a jam detection sensor, thereby immediately stopping the image forming operation of the image forming apparatus (in this case, the blower 21 is also stopped). In this case, it is assumed that the sheet S1 is stopped at a position x shown in FIG. 14. In this position, the sheet was discharged from the sheet stacking tray 1 but is not pinched by the paired convey rollers 23 (since the sheet S situated in this position is not pinched by the paired convey rollers 23, wrinkles and other damages are not generated in the sheet). That is to say, in this case, the presence of the sheet S is detected by a detection sensor 53 provided in the air sheet supply apparatus, and the absence of the sheet S is detected by a detection sensor 54. In this condition, even when the operation of the image forming apparatus is stopped by the detection of the jam detection sensor 50 (or 51 or 52), the blower 12 continues to operate, with the result that the sheet S1 continues to be adhered to the convey belt 14.

Thereafter, when a motor M is driven reversely, the convey belt 14 is driven in a direction (shown by the arrow D) opposite to the sheet convey direction, thereby conveying the sheet S1 toward the upstream direction. When the sheet S1 is returned above the sheet stacking tray 1 to pass the tip end of the sheet S1 through the detection sensor 53 (which now detects the absence of the sheet), the motor M is stopped to stop the convey belt 14. Thereafter, the blower 12 is also stopped, with the result that the sheet S1 drops onto the sheet stacking tray 1, thereby preparing the waiting condition for the next image forming operation. After these series of operations, by removing the jammed and damaged sheet from the image forming apparatus, the jam treatment is effected without removing the reusable sheet S1 and the jam treatment time can be reduced.

When the jammed condition is detected, if the sheet S is detected by the detection sensor 54, the above-mentioned series of operations are not performed, and the image forming apparatus is stopped immediately, because, in this case, the sheet S is pinched by the paired convey rollers 23 and it is feared that the sheet S is damaged. When the jammed condition is detected, unless the sheet S is detected by the detection sensors 53, 54 simultaneously, the above-mentioned series of operations are also not performed, and the image forming apparatus is stopped immediately, because, in this case, there is no sheet in these areas.

Next, a ninth embodiment of the present invention in which a means for improving the separability of the sheet is provided in the air sheet supply apparatus of the first embodiment will be explained.

Figure 15:
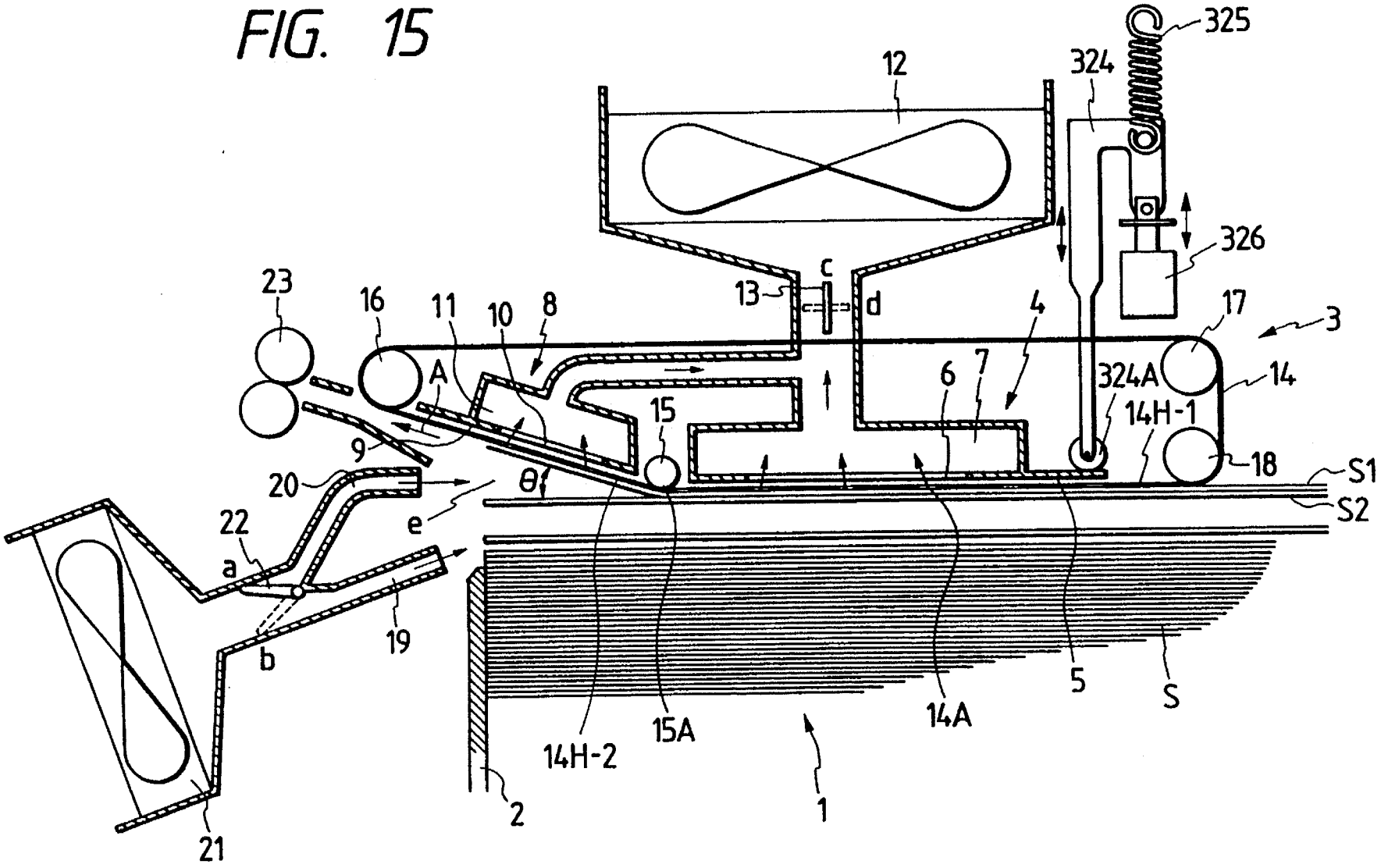
FIG. 15 is an elevational sectional view of a sheet supply apparatus according to a ninth embodiment of the present invention.

FIG. 15 shows a whole construction of a sheet supply apparatus according to the ninth embodiment.

Incidentally, in this sheet supply apparatus, the same constructural and functional elements as those of the sheet supply apparatus of the first embodiment are designated by the same reference numerals and the detailed explanation thereof will be omitted. This is also applied to a sheet supply apparatus according to a tenth embodiment.

In this sheet supply apparatus, a sheet push rod (sheet pushing means) 324 having a roller 324A at its free end is disposed in the proximity of the upstream end of the convey belt 14, which sheet push rod is arranged not to overlap with the convey belt 14. A bias spring 325 serves to bias the sheet push rod 324 upwardly, and a solenoid 326 is connected to the sheet push rod 324. The solenoid 326 is turned ON when the sheet S adhered to a sheet absorb surface 14H-1 of the belt 14 is pushed out by the sheet push rod 324, thereby lowering the sheet push rod 324 to a position F shown in FIG. 16B. Normally, the solenoid 326 is in an OFF condition so that the sheet push rod 324 is maintained in a position E shown in FIG. 16A.

Next, the operation of this sheet supply apparatus will be explained with reference to FIGS. 16A to 16D.

Figure 16A:
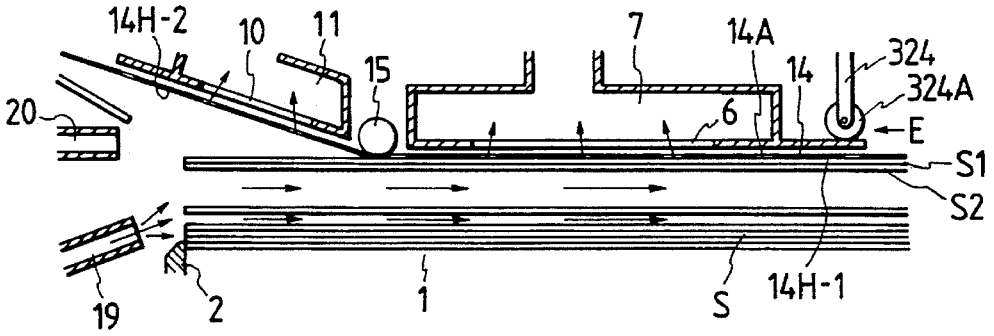
FIGS. 16A to 16D are sectional views showing the operation of the apparatus of FIG. 15.
Figure 16B:
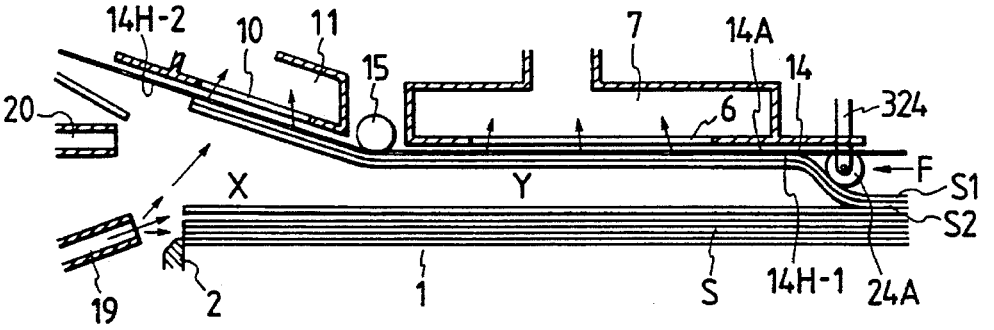

First of all, the valve 22 is switched to the position a by the switch means (not shown) such as a solenoid so that the blower 21 is operated to inject the air from the nozzles 19 toward the tip end of the sheet stack. As a result, several sheets S1, S2 are blown up to float (FIG. 16A). Then, the valve 13 is switched to the position c by the switch means such as a solenoid so that the blower 12 is operated to absorb or suck the air through the absorb openings 6, 10 and the air openings 14A. At the same time, the solenoid 326 is turned ON to lower the sheet push rod 324 to the position F (FIG. 16B).

Consequently, the air flows in areas X and Y are blocked, thereby increasing the pressures in the areas X and Y. As a result, since the pressures in the areas X and Y are greatly increased in comparison with the pressures in the chambers 11, 7, the uppermost sheet S1 is absorbed to the first and second sheet absorb means 4, 8 and is stably adhered to the sheet absorb surfaces 14H-1, 14H-2 of the convey belt 14.

Figure 16C:
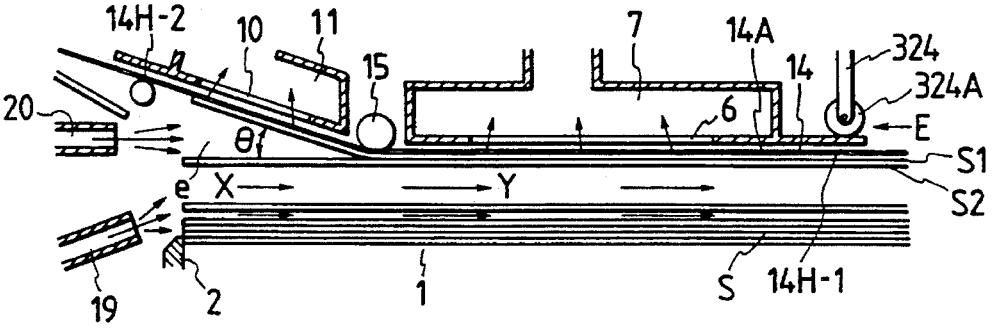

Thereafter, the solenoid 326 is turned OFF, with the result that, since the pushing action of the sheet push rod 324 is released, the air flows in the areas X and Y are restored to the original condition (FIG. 16C). In this case, by the absorbing forces of the first and second sheet absorb means 4, 8, the sheet S1 is bent around the displacement fulcrum portion 15A in opposition to the resilience of the sheet, with the result that the tip end portion and the central portion of the sheet S1 are closely contacted with the sheet absorb surfaces 14H-1, 14H-2 of the convey belt 14, respectively. That is to say, the sheet S1 follows the sheet absorb surfaces 14H-1, 14H-2 to become convex downwardly around the displacement fulcrum portion 15A.

In this case, if the second sheet S2 is closely contacted with the first sheet S1, although the central portion of the sheet S2 substantially follows the sheet S1, since the surface of the second sheet absorb means 8 is covered by the first sheet S1, the tip end portion of the sheet S2 is not subjected to the absorbing force. Accordingly, since the resilience of the second sheet S2 overcomes the absorbing force, the second sheet S2 is not bent around the displacement fulcrum portion 15A to maintain the flat attitude, with the result that the tip end of the second sheet S2 is separated from the tip end of the first sheet S1, thereby creating the gap e between the sheets (FIG. 16C).

Figure 16D:
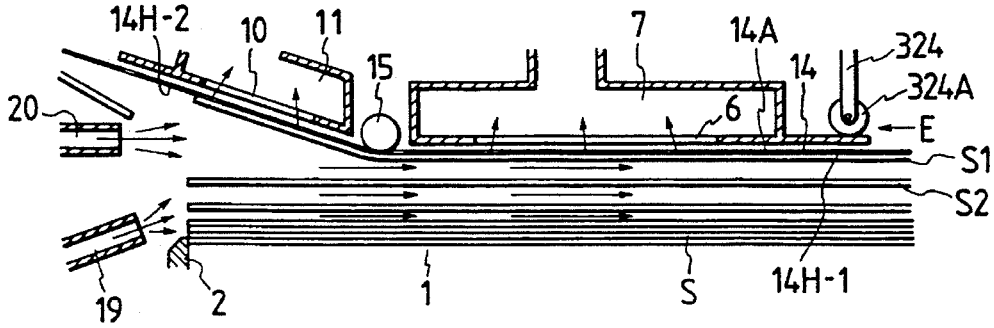

Thereafter, the convey belt 14 is driven by the drive means to convey the sheet S1 in the direction shown by the arrow A. At the same time, the valve 22 is switched to the position b, with the result that the air from the nozzles 20 is blown into the gap e between the sheets S1 and S2, thereby stably separating the sheet S2 from the sheet S1 (FIG. 16D). Accordingly, only the sheet S1 is conveyed toward the downstream direction to be sent to the paired convey rollers 23.

In this embodiment, while an example that the sheet push rod 324 pressurizes the sheet substantially along the vertical direction was explained, the present invention is not limited to this example, but the sheet push rod may push the sheet obliquely or may be rocked around a pivot to push the sheet.

Figure 17:
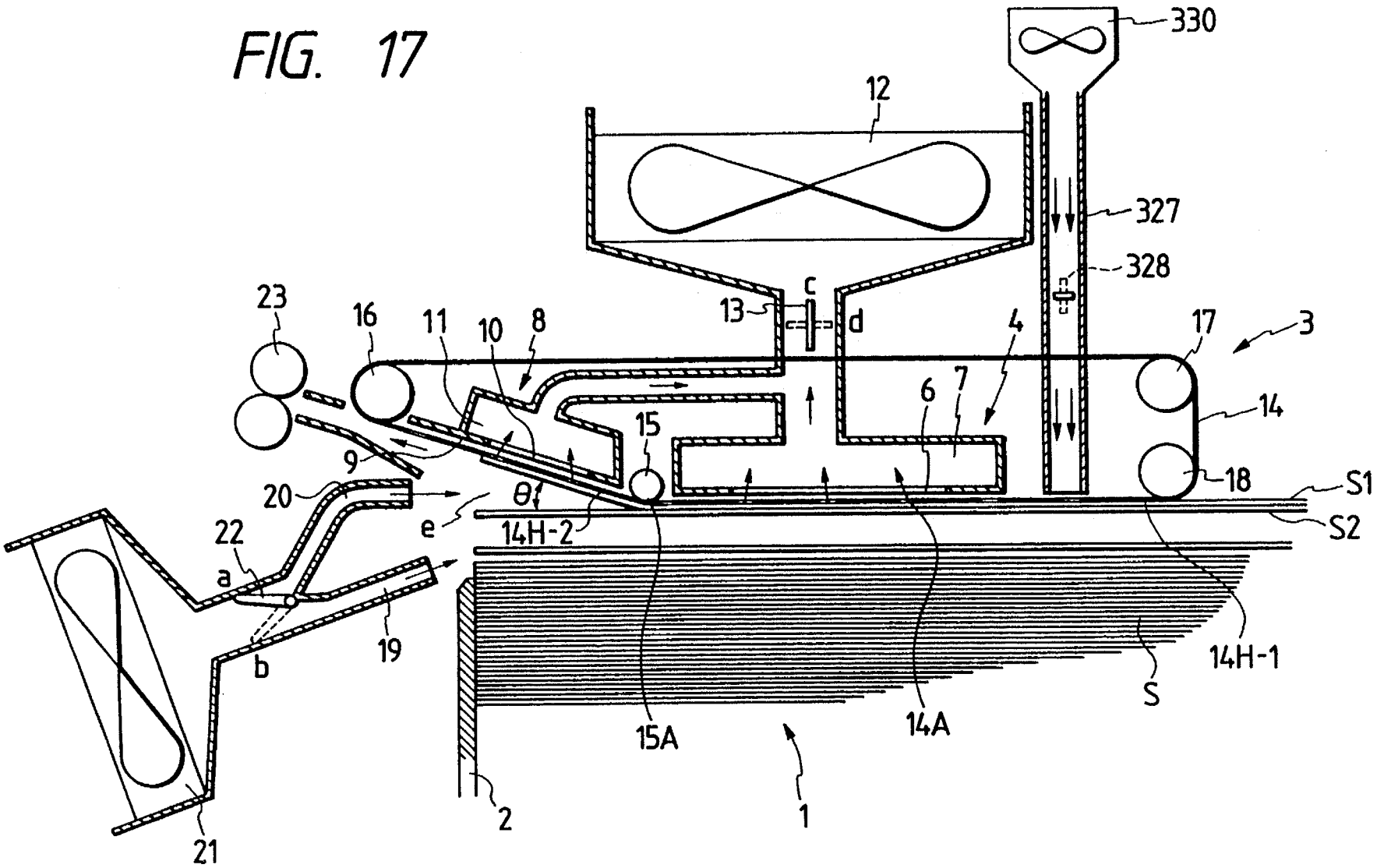
FIG. 17 is an elevational sectional view of a sheet supply apparatus according to a tenth embodiment of the present invention.
Figure 18A:
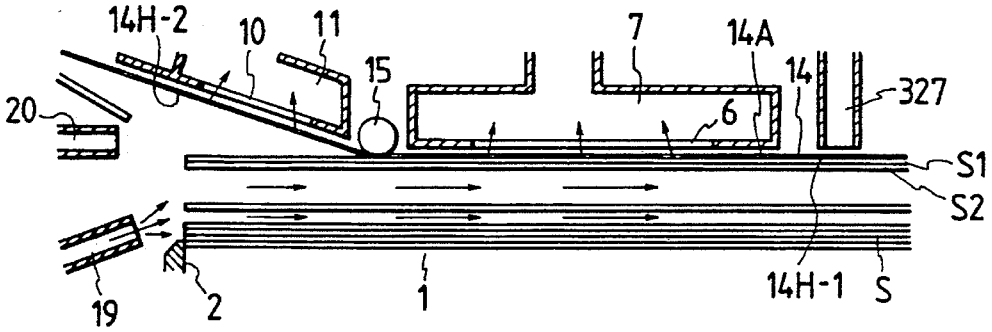
FIGS. 18A to 18D are sectional views showing the operation of the apparatus of FIG. 17.
Figure 18B:
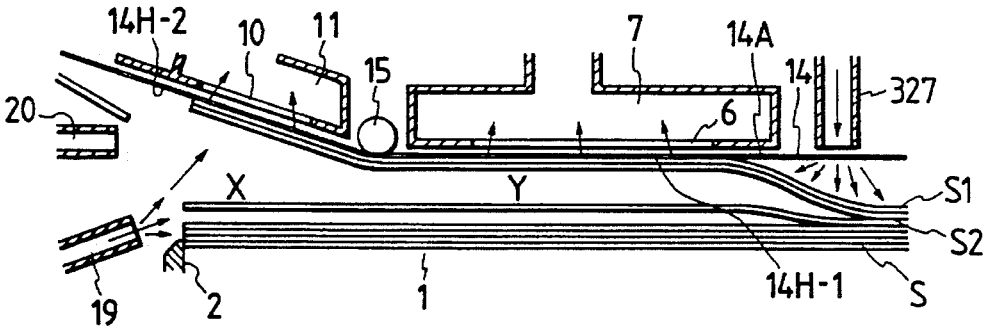
Figure 18C:
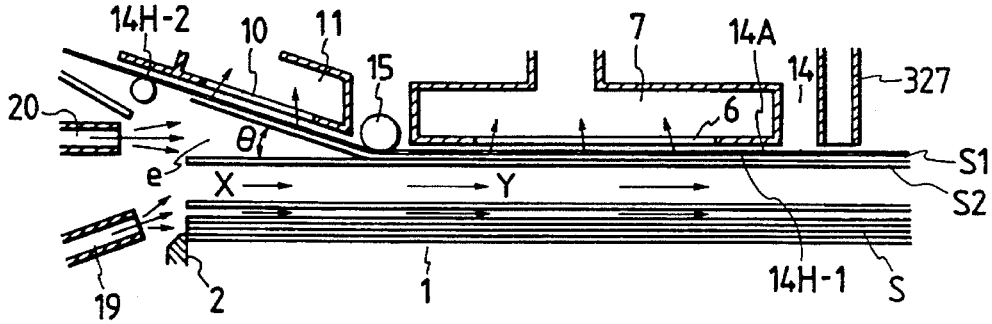
Figure 18D:
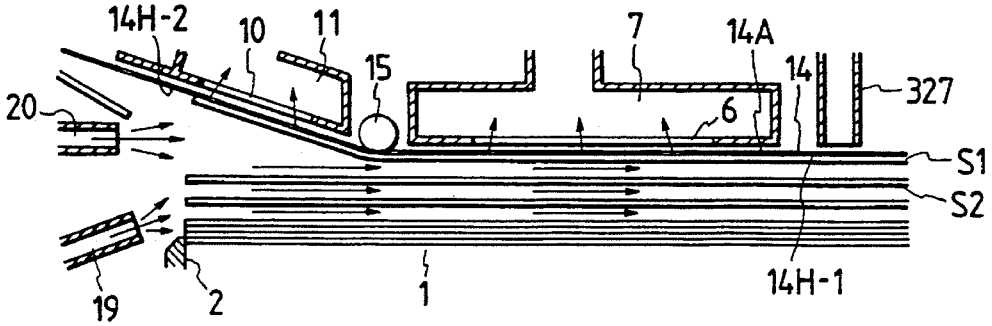

FIG. 17 shows a whole construction of a sheet supply apparatus according to a tenth embodiment of the present invention.

In this sheet supply apparatus, a sheet pushing air nozzle 327 is disposed in the proximity of the upstream end of the convey belt 14, which nozzle is arranged not to overlap with the convey belt 14. A fan 330 for supplying air to the sheet pushing air nozzle 327 is connected to the air nozzle 327. A shutter 328 serves to switch ON/OFF of the air from the sheet pushing air nozzle 327. Normally, the shutter 328 is in an OFF condition.

Although the operation of this sheet supply apparatus is shown in FIGS. 18A to 18D, fundamentary, the operation is substantially the same as that of the sheet supply apparatus according to the ninth embodiment. Regarding this sheet supply apparatus, in FIG. 18B, the air is injected from the sheet pushing air nozzle 327 to push out the sheets S1, S2, so that the air flows in the areas X and Y are blocked, thereby increasing the pressures in the areas X and Y. Incidentally, in this embodiment, while an example that the air injected from the sheet pushing air nozzle pushes the sheets substantially along the vertical direction was explained, the present invention is not limited to this example, but the air from the nozzle may push the sheets obliquely.

Figure 49:
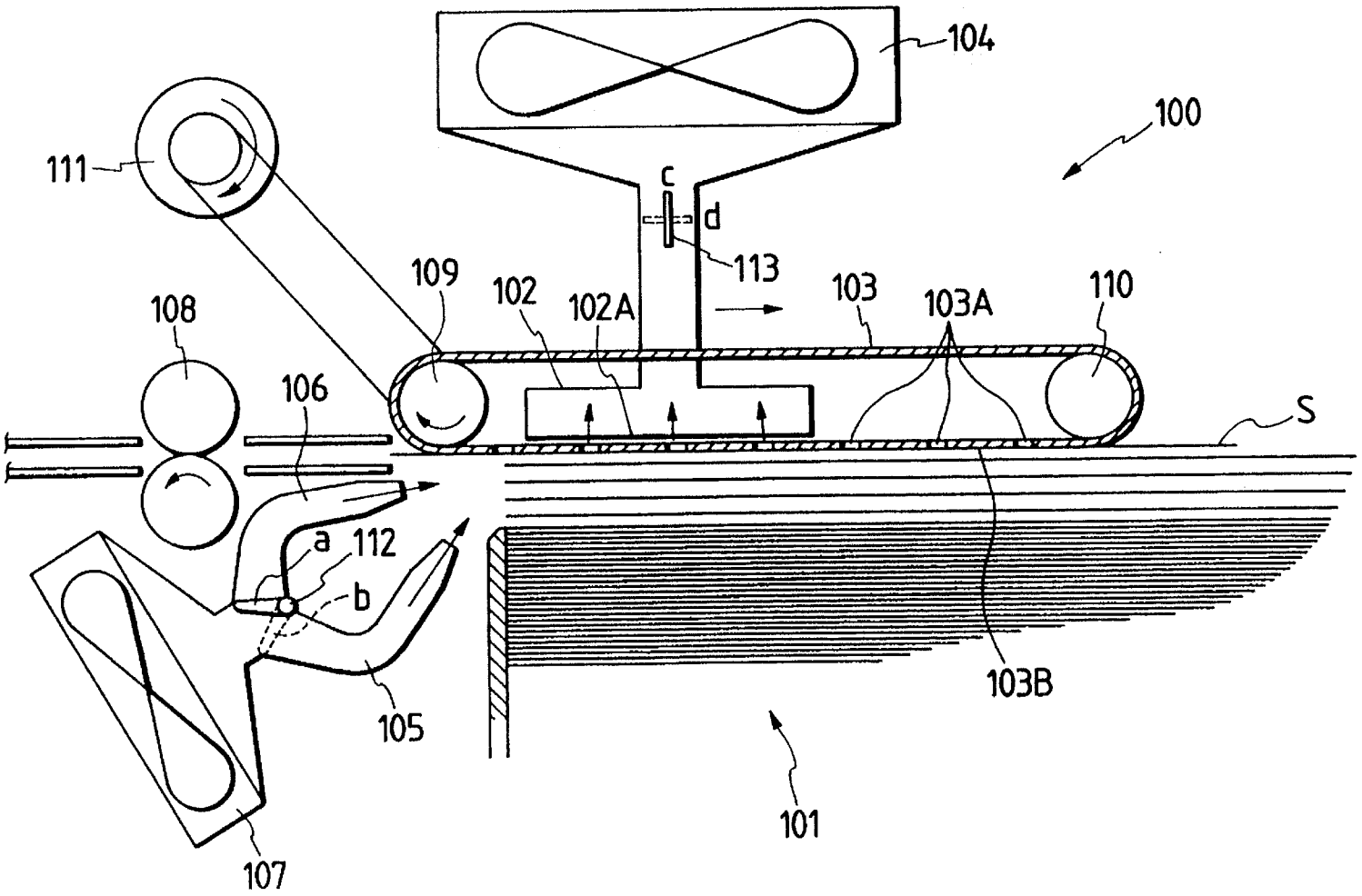
FIG. 49 PRIOR ART
FIG. 49 is an elevational sectional view showing an example of a conventional air sheet supply apparatus.
Figure 50:
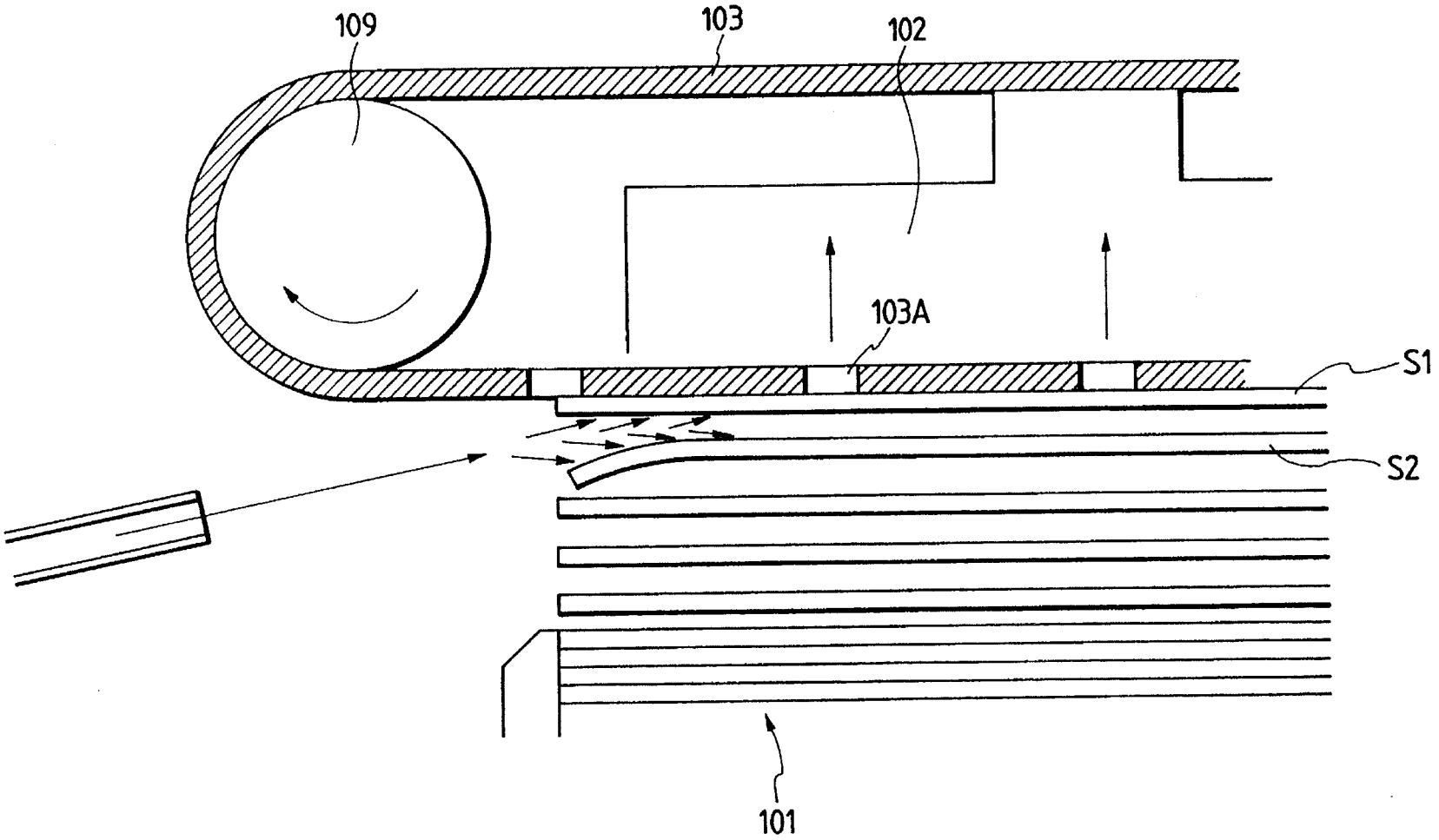
FIG. 50 PRIOR ART
FIGS. 50 and 51 are sectional views showing the operation of the apparatus of FIG. 49.
Figure 51:
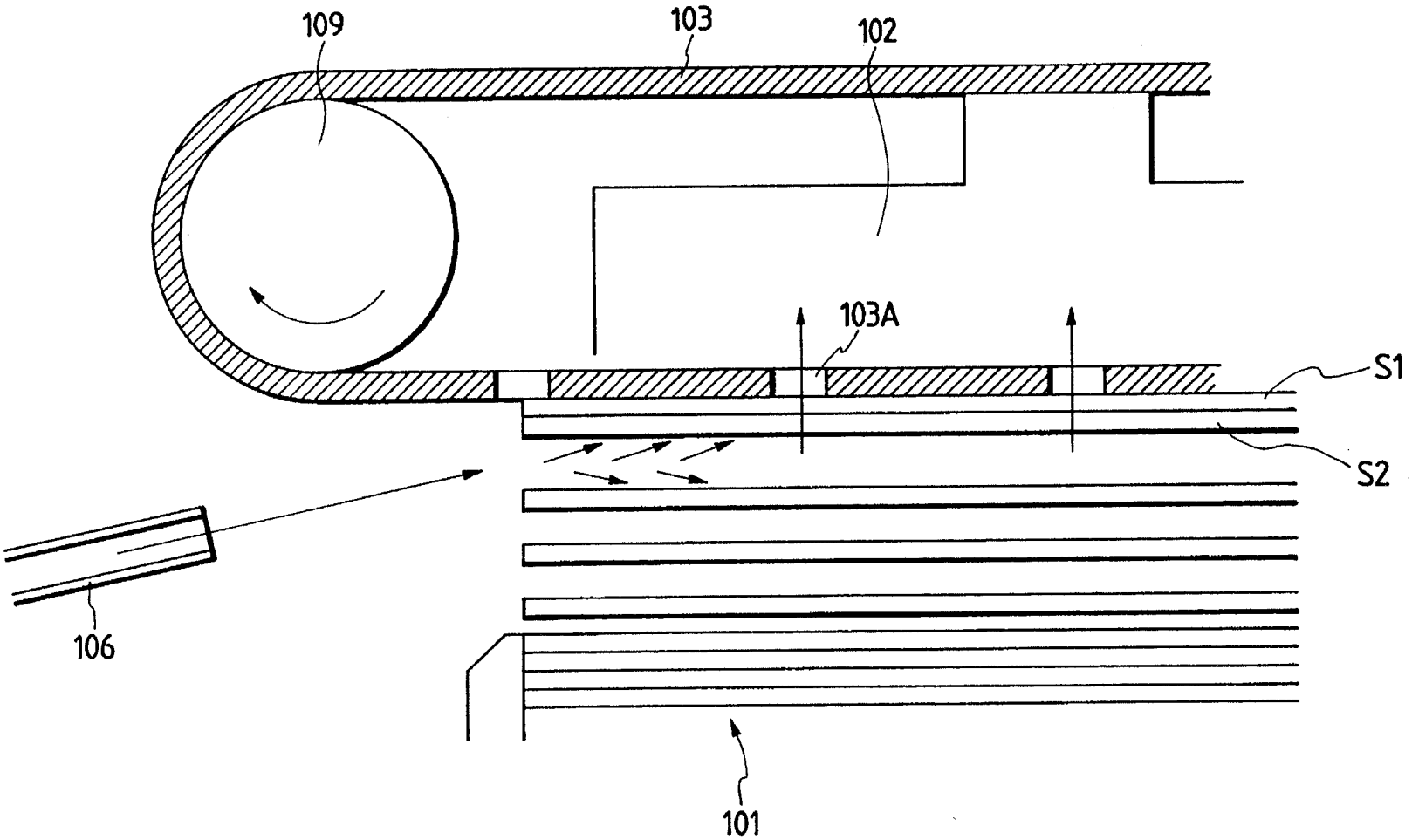
FIG. 51 PRIOR ART

The sheet pushing means used in the ninth and tenth embodiments provide the excellent advantage when they are applied to the conventional air sheet supply apparatus shown in FIG. 49.

Such embodiments will be explained hereinbelow. Incidentally, the same or similar constructural elements as those of the conventional apparatus shown in FIG. 49 are designated by the same reference numerals and the detailed explanation thereof will be omitted.

Figure 19:
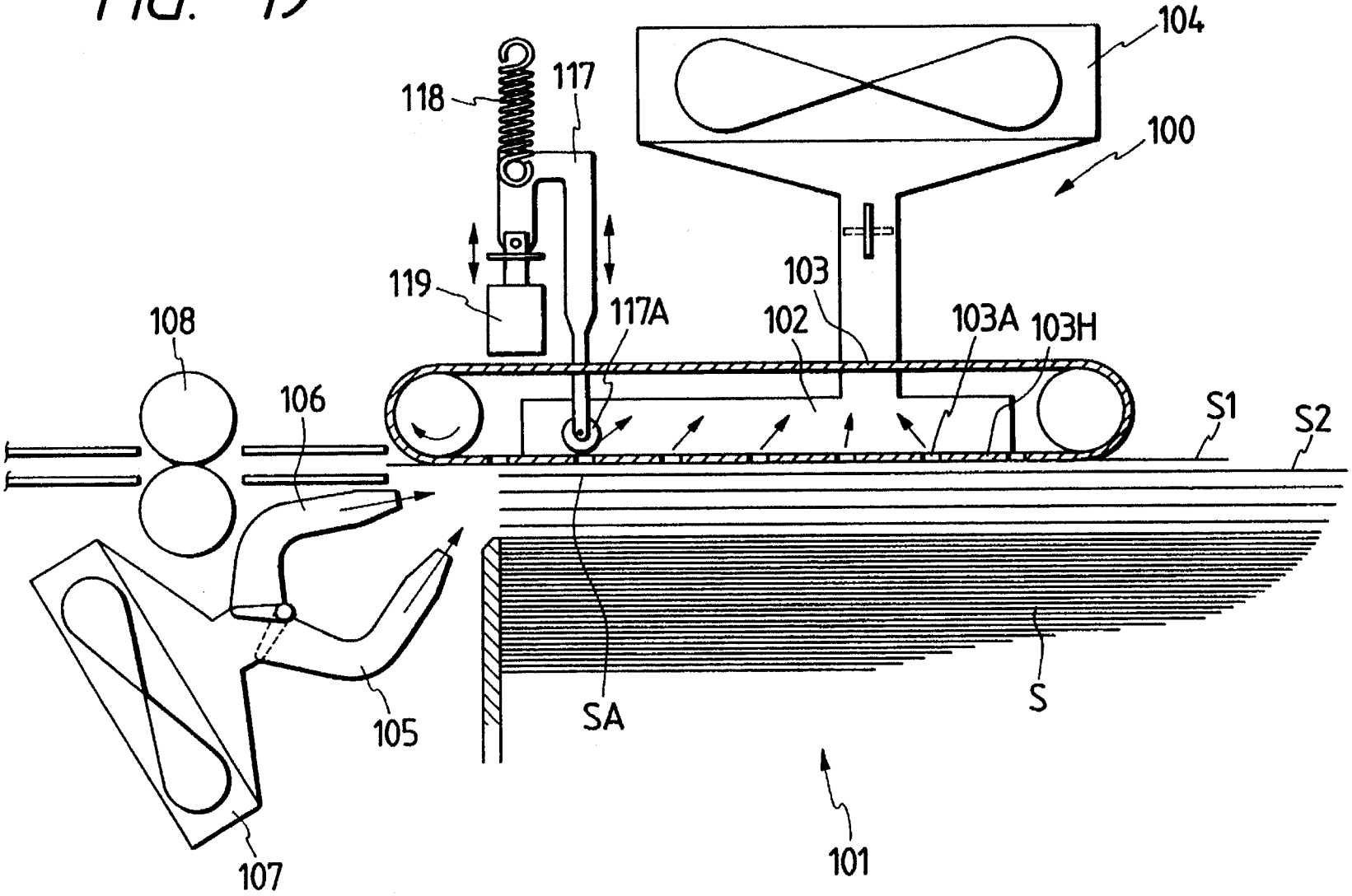
FIG. 19 is an elevational sectional view of a sheet supply apparatus according to an eleventh embodiment of the present invention.
Figure 20A:
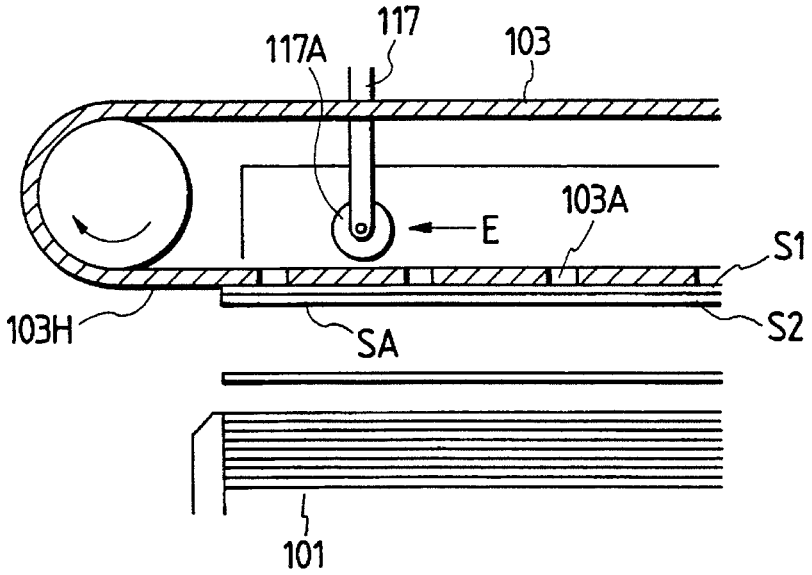
FIGS. 20A to 20C are sectional views showing the operation of the apparatus of FIG. 19.

FIG. 19 shows a sheet supply apparatus according to an eleventh embodiment of the present invention. In this sheet supply apparatus, a sheet pressurizing rod 117 having a pressurizing roller 117A at its free end is disposed in the proximity of the downstream end of the convey belt 103, which sheet pressurizing rod is arranged not to overlap with the convey belt 103. A bias spring 118 serves to bias the sheet pressurizing rod 117 upwardly, and a solenoid 119 serves to drive the sheet pressurizing rod 117. The solenoid 119 is turned ON when the sheet S adhered to a sheet absorb surface 103H of the belt 103 is pressurized by the sheet pressurizing rod 117, thereby lowering the sheet pressurizing rod 117 to a position F shown in FIG. 20B. Normally, the solenoid 119 is in an OFF condition so that the sheet pressurizing rod 117 is maintained in a position E shown in FIG. 20A.

Next, the operation of this sheet supply apparatus will be explained.

Figure 20B:
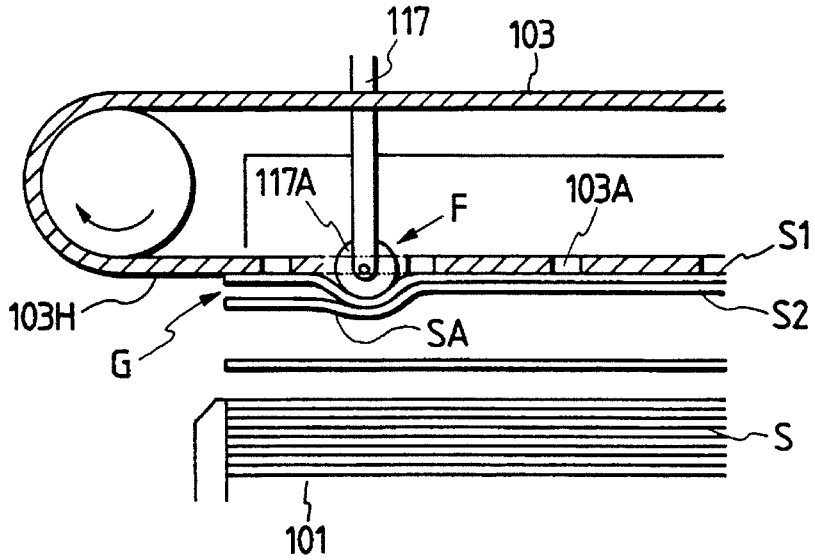

First of all, the air is injected from the nozzle 105 by the action of the blower 107 to float several sheets S on the tray 101. By the action of the blower 104, the uppermost sheet S1 is adhered to the sheet absorb surface 103H of the convey belt 103. Now, the solenoid 119 is turned ON to lower the sheet pressurizing rod 117 to the position F shown in FIG. 20B relatively swiftly. In this case, if the second sheet S2 is closely contacted with the first sheet S1 (FIG. 20A), a gap G is created between the first sheet S1 and the second sheet S2 by the pressurizing action of the sheet pressurizing rod (FIG. 20B).

Figure 20C:
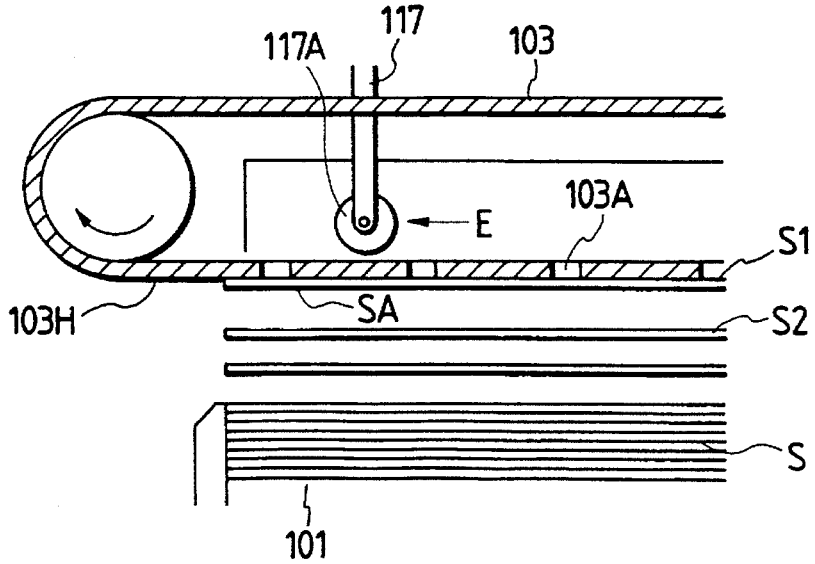

Then, the air is blown against the tip ends of the sheets S1, S2 by the action of the blower 107, thereby separating the second sheet S2 from the first sheet S1 completely. Thereafter, the solenoid 119 is turned OFF, with the result that the sheet pressurizing rod 117 is returned to its original position by the bias spring 118 (FIG. 20C).

Then, the convey belt 103 is driven, thereby sending only the first sheet S1 to the paired convey rollers 108.

In this embodiment, while an example that the sheet pressurizing rod pressurizes the sheet substantially along the vertical direction was explained, the present invention is not limited to this example, but the rod may pressurize the sheet obliquely.

Figure 21:
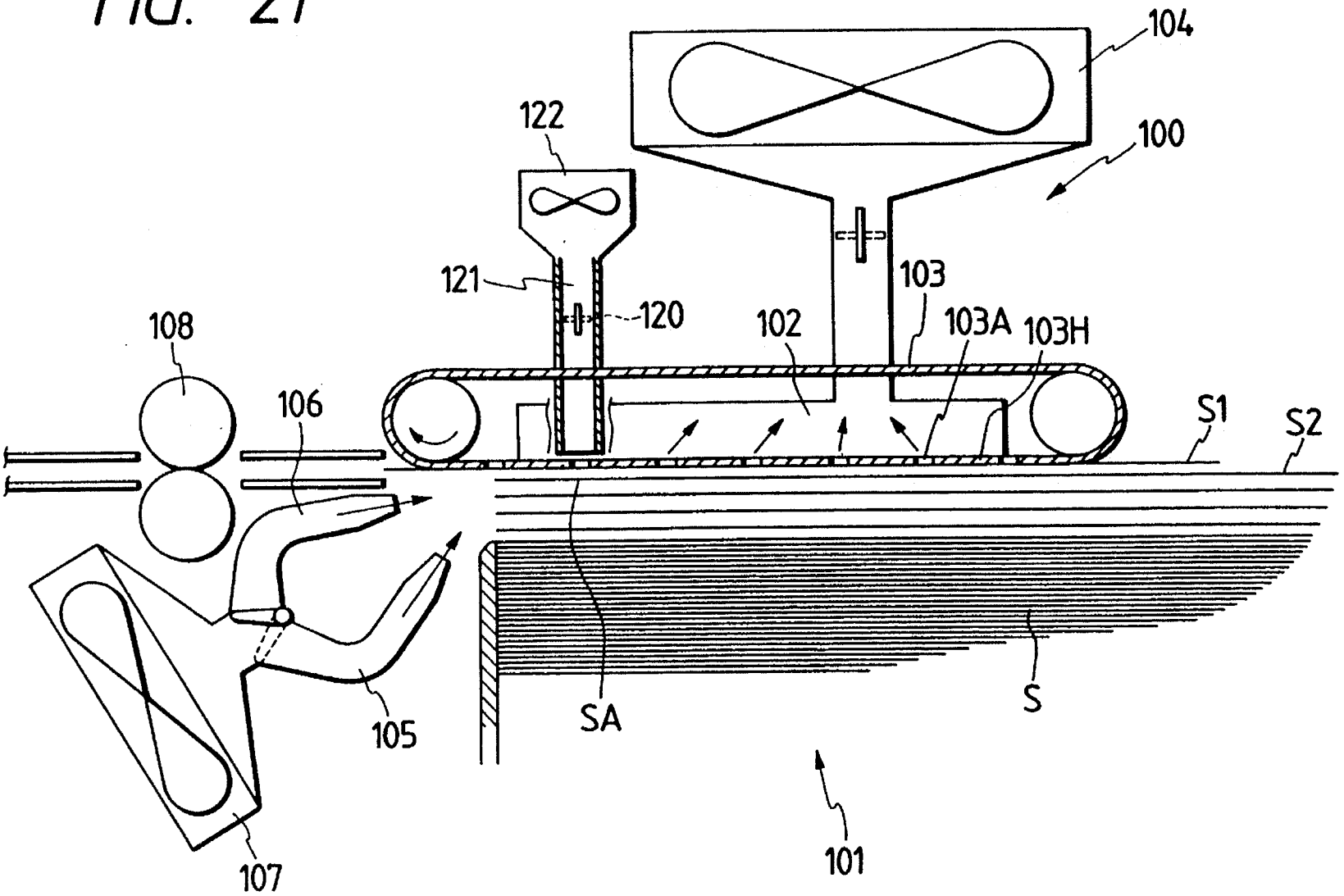
FIG. 21 is an elevational sectional view of a sheet supply apparatus according to a twelfth embodiment of the present invention.

FIG. 21 shows a whole construction of a sheet supply apparatus according to a twelfth embodiment of the present invention.

In this sheet supply apparatus, a sheet pressurizing air nozzle 120 is disposed in the proximity of the downstream end of the convey belt 103, which nozzle is arranged not to overlap with the convey belt 103. A fan 122 for supplying air to the sheet pressurizing air nozzle 120 is connected to the air nozzle 120. An air shutter 121 serves to switch ON/OFF of the air from the sheet pressurizing air nozzle 120. Normally, the air shutter 121 is in an OFF condition. That is to say, in this condition, the air is not injected against the sheet S adhered to the sheet absorb surface 103H of the belt 103.

Next, the operation of this sheet supply apparatus will be explained.

Figure 22A:
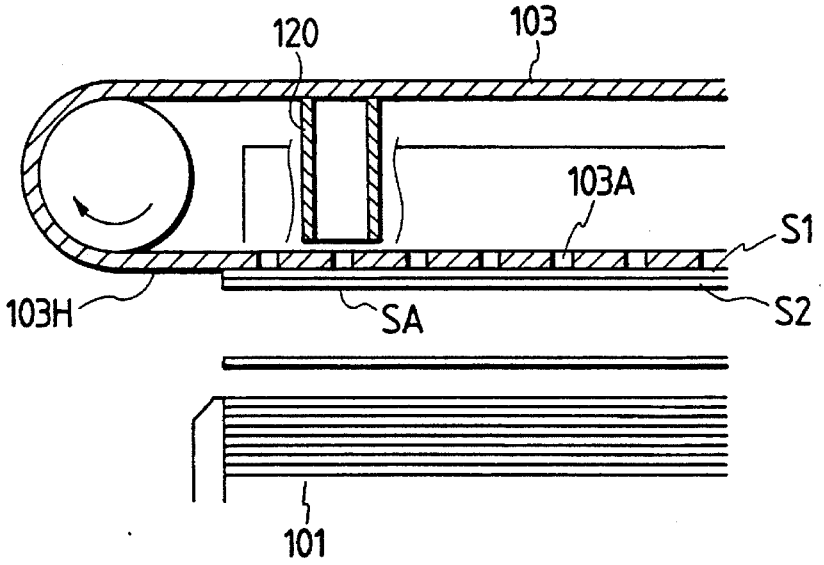
FIGS. 22A to 22C are sectional views showing the operation of the apparatus of FIGS. 20A to 20C.
Figure 22B:
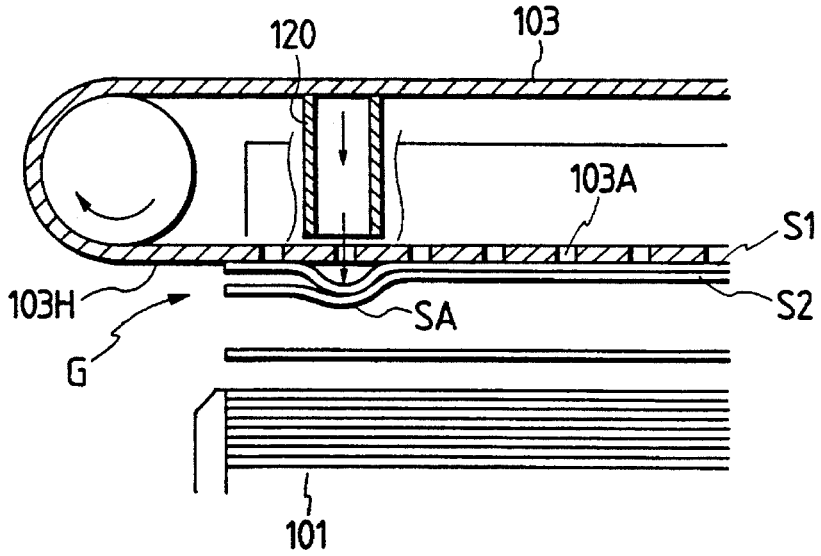

First of all, the air is injected from the nozzle 105 by the action of the blower 107 to float several sheets S on the tray 101. By the action of the blower 104, the uppermost sheet S1 is adhered to the sheet absorb surface 103H of the convey belt 103. The fan 122 is now operated or has previously been operated. Then, the air shutter 121 is turned ON, thereby blowing the air from the sheet pressurizing air nozzle 120 toward the sheet S. In this case, if the second sheet S2 is closely contacted with the first sheet S1 (FIG. 22A), a gap G is created between the first sheet S1 and the second sheet S2 by the pressurizing action of the sheet pressurizing air nozzle 120 (FIG. 22B).

Figure 22C:
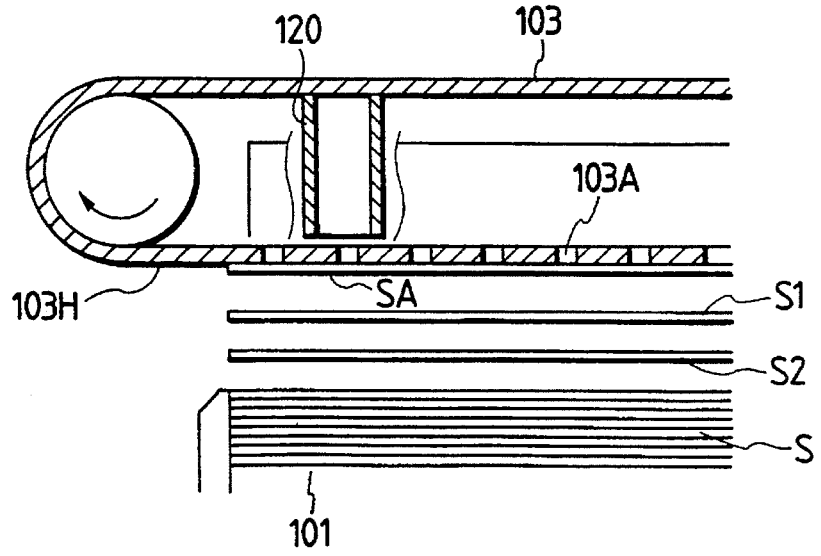

Then, the air is blown against the tip ends of the sheets S1, S2 by the action of the blower 107, thereby separating the second sheet S2 from the first sheet S1 completely. Thereafter, the air shutter 121 is turned OFF, with the result that the air from the sheet pressurizing air nozzle 120 is stopped (FIG. 22C).

Then, the convey belt 103 is driven, thereby sending only the first sheet S1 to the paired convey rollers 108.

In this embodiment, while an example that the air from the sheet pressurizing air nozzle 120 pressurizes the sheet substantially along the vertical direction was explained, the present invention is not limited to this example, but the air may pressurize the sheet obliquely.

Figure 23:
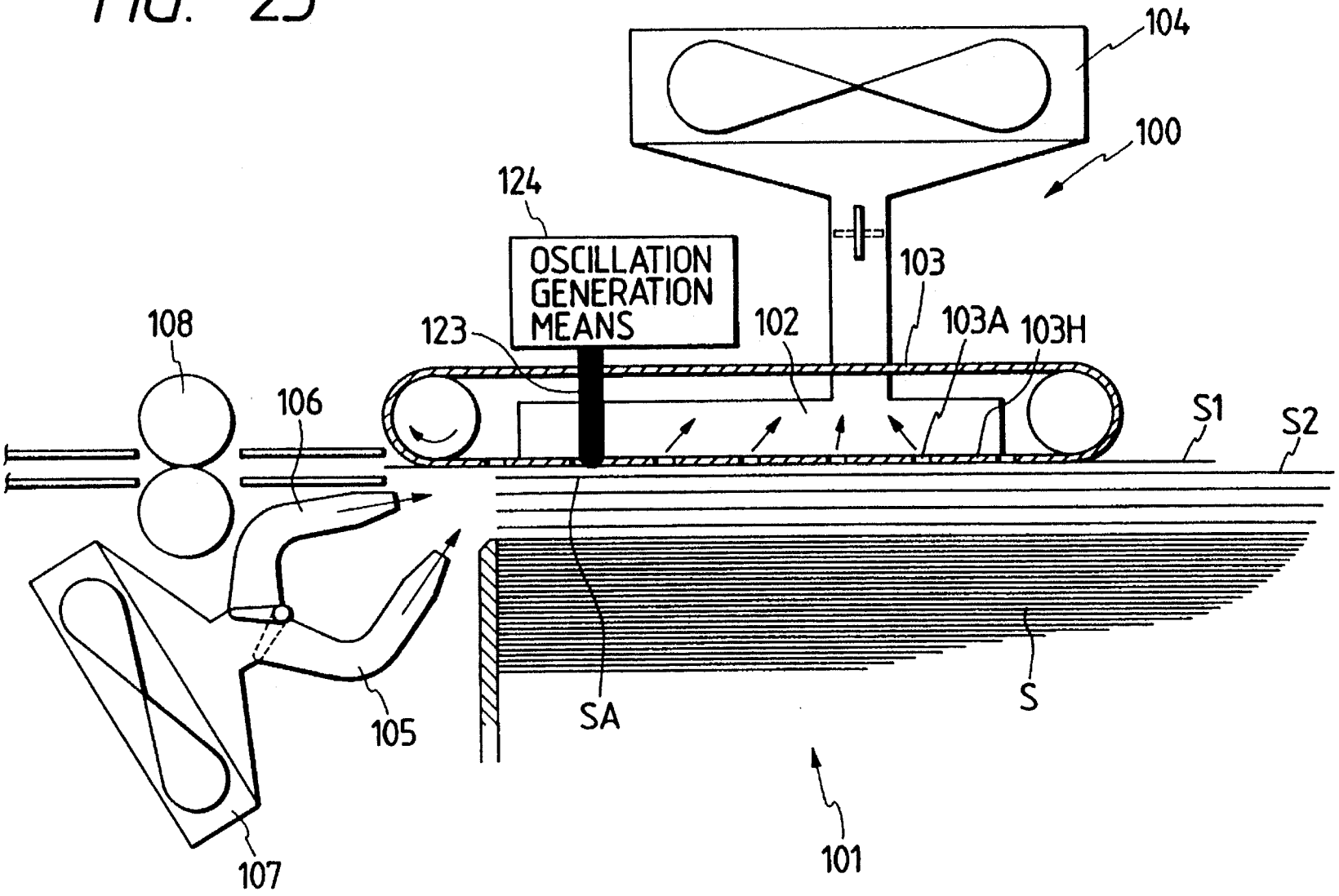
FIG. 23 is an elevational sectional view of a sheet supply apparatus according to a thirteenth embodiment of the present invention.

FIG. 23 shows a whole construction of a sheet supply apparatus according to a thirteenth embodiment of the present invention.

In this sheet supply apparatus, a sheet pressurizing oscillation rod 123, and an oscillation generation means 124 for driving the sheet pressurizing oscillation rod 123 are provided. The pressurizing oscillation rod 123 is disposed in the proximity of the downstream end of the convey belt 103 not to overlap with the convey belt 103.

The operation of this sheet supply apparatus is as follows.

First of all, the air is injected from the nozzle 105 by the action of the blower 107 to float several sheets S on the tray 101 by the action of the blower 104, the uppermost sheet S1 is adhered to the sheet absorb surface 103H of the convey belt 103. The oscillation generation means 124 is now operated to oscillate the sheet pressurizing oscillation rod 123. By oscillating the rod for a given time, a plurality of shocking forces is applied to the sheet S. In this case, if the second sheet S2 is closely contacted with the first sheet S1, by the shocking actions of the sheet pressurizing oscillation rod 123, a gap is created between the downstream tip ends of the first and second sheets S1 and S2.

Then, the air is blown against the tip ends of the sheets S1, S2 by the action of the blower 107, thereby separating the second sheet S2 from the first sheet S1 completely. Thereafter, the oscillation generation means 124 is turned OFF, thereby stopping the oscillation of the sheet pressurizing oscillation rod 123. Then, the convey belt 103 is driven, thereby sending only the first sheet S1 to the paired convey rollers 108.

In this embodiment, while an example that the sheet is directly oscillated by the sheet pressurizing oscillation rod 123 was explained, the present invention is not limited to this example, the sheet S may be indirectly oscillated via a portion of the convey belt 103.

Figure 24B:
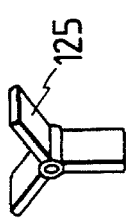
FIG. 24B is a perspective view of a pressure paddle of the apparatus of FIG. 24A.
Figure 24A:
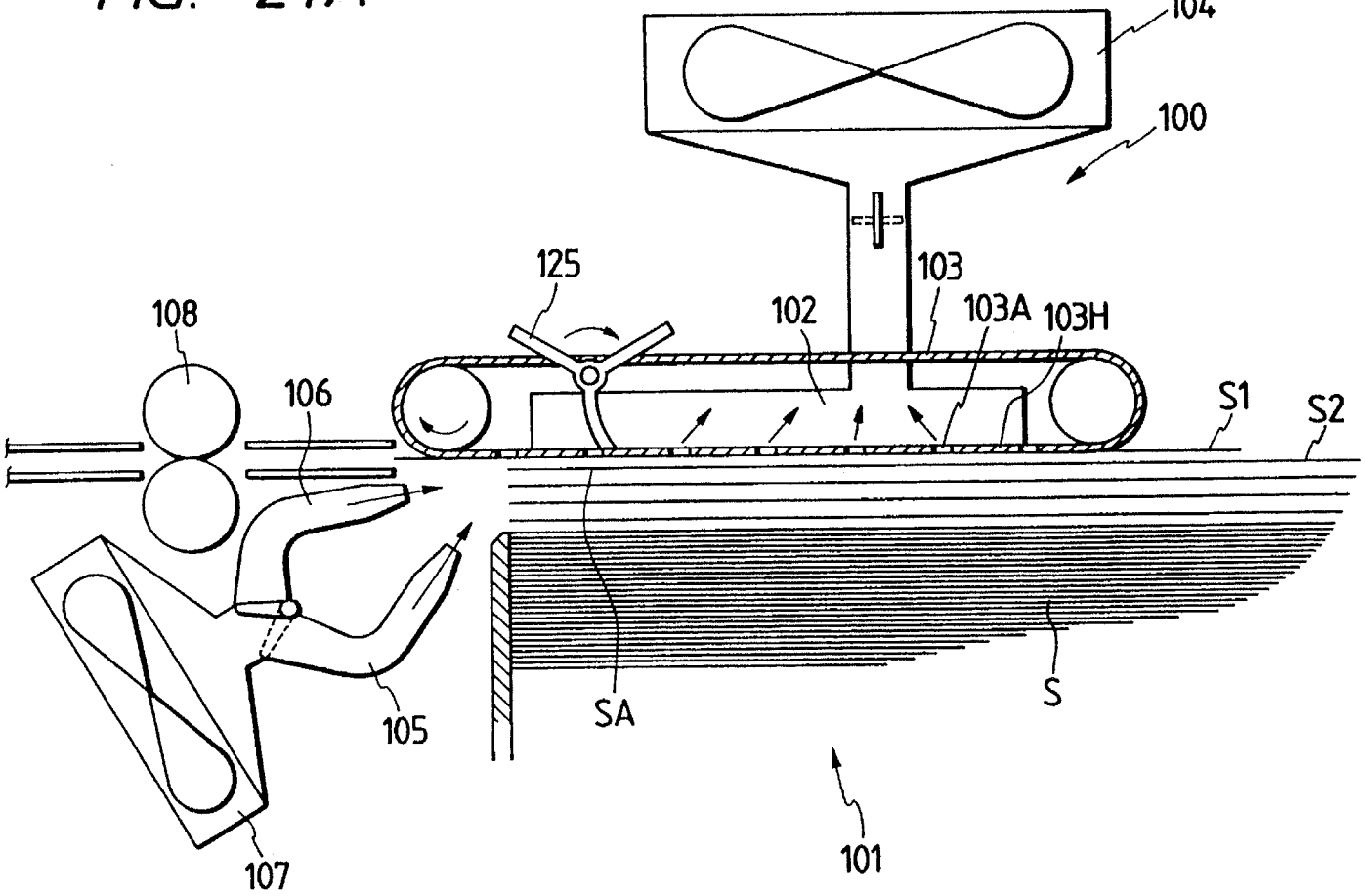
FIG. 24A is an elevational sectional view of a sheet supply apparatus according to a fourteenth embodiment of the present invention.

FIG. 24A shows a whole construction of a sheet supply apparatus according to a fourteenth embodiment of the present invention.

In this sheet supply apparatus, a sheet pressurizing paddle 125 made of elastic material such as rubber is disposed in the proximity of the downstream end of the convey belt 103 not to overlap with the convey belt 103. The sheet pressurizing paddle 125 is ON/OFF controlled, and is rotated in a direction shown by the arrow by a drive device (not shown), thereby applying the shock to the sheet S adhered to the sheet absorb surface 103H of the convey belt 103. Normally, the sheet pressurizing paddle 125 is in an OFF condition so that it is not rotated. FIG. 24B is a perspective view of the sheet pressurizing paddle 125.

The operation of this sheet supply apparatus is as follows.

First of all, the air is injected from the nozzle 105 by the action of the blower 107 to float several sheets S on the tray 101. By the action of the blower 104, the uppermost sheet S1 is adhered to the sheet absorb surface 103H of the convey belt 103. The sheet pressurizing paddle 125 is now rotated. By rotating the paddle for a given time, a plurality of shocking forces is applied to the sheet S. In this case, if the second sheet S2 is closely contacted with the first sheet S1, by the shocking actions of the sheet pressurizing paddle 125, a gap is created between the downstream tip ends of the first and second sheets S1 and S2.

Then, the air is blown against the tip ends of the sheets S1, S2 by the action of the blower 107, thereby separating the second sheet S2 from the first sheet S1 completely. Thereafter, the sheet pressurizing paddle 125 is stopped. Then, the convey belt 103 is driven, thereby sending only the first sheet S1 to the paired convey rollers 108.

Figure 25:
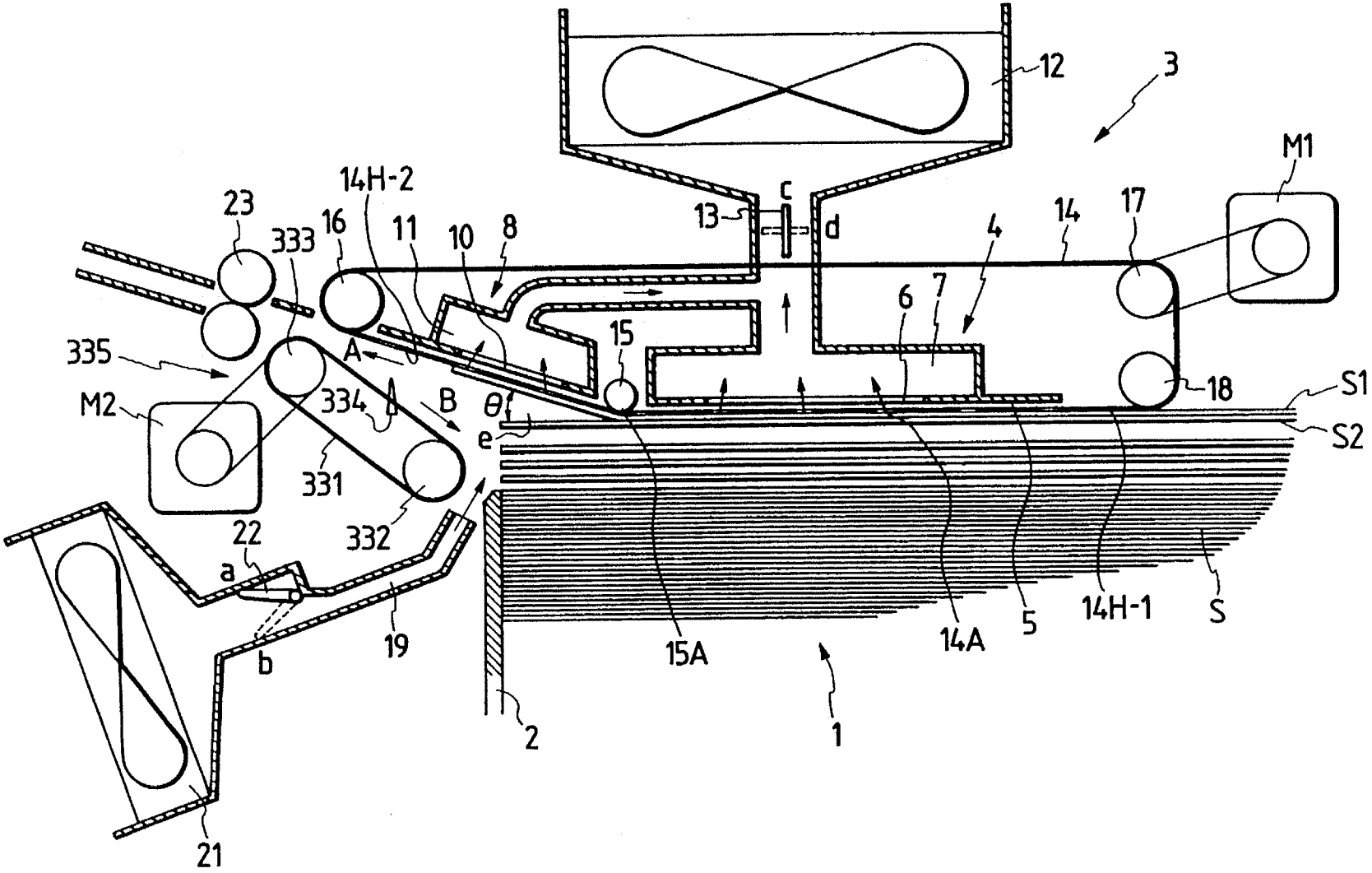
FIG. 25 is an elevational sectional view of a sheet supply apparatus according to a fifteenth embodiment of the present invention.

FIG. 25 shows a whole construction of a sheet supply apparatus according to a fifteenth embodiment of the present invention. Incidentally, regarding this embodiment, only the construction different from that of the first embodiment will be explained.

In this sheet supply apparatus, a belt separation portion 335 includes a separation belt 331 which extends between and wound around rollers 332, 333. The separation belt 331 is driven by a motor M2 to rotate in a direction shown by the arrow B. The convey belt 14 is supported by the rollers 16, 17 and 18 with a predetermined tension. The roller 17 is a drive roller which is driven by a motor M1. The convey belt 14 is intermittently driven by the drive roller 17 in a direction shown by the arrow A to convey the sheet S. A double-feed detection sensor 334 is arranged in the proximity of the separation belt 331.

Next, the operation of this sheet supply apparatus will be explained.

First of all, the valve 22 is switched to the position a by the switch means (not shown) such as a solenoid so that the blower 21 is operated to direct the air from the nozzles 19 toward the tip end of the sheet stack S. As a result, several sheets S1, S2 are blown up to float. Then, the valve 13 is switched to the position c by the switch means such as a solenoid so that the blower 12 is operated to suck the air through the absorb openings 6, 10 and the air openings 14A. As a result, the uppermost sheet S1 is absorbed to the first and second sheet absorb means 4, 8 and is closely adhered to the sheet absorb surfaces 14H-1, 14H-2 of the convey belt 14.

More specifically, the central portion of the sheet S1 is absorbed to the first sheet absorb means 4 and the tip end portion of the sheet S1 is absorbed to the second sheet absorb means 8. In this case, since the absorbing forces of the first and second sheet absorb means 4, 8 are set to be sufficiently strong, the sheet S1 is bent around the displacement fulcrum portion 15A in opposition to the resilience of the sheet, with the result that the tip end portion and the central portion of the sheet S1 are closely contacted with the sheet absorb surfaces 14H-1, 14H-2 of the convey belt 14, respectively. That is to say, the sheet S1 follows the sheet absorb surfaces 14H-1, 14H-2 to become convex downwardly around the displacement fulcrum portion 15A.

In this case, if the second sheet S2 is closely contacted with the first sheet S1, although the central portion of the sheet S2 substantially follows the sheet S1, since the surface of the second sheet absorb means 8 is covered by the first sheet S1, the tip end portion of the sheet S2 is not subjected to the absorbing force. Accordingly, since the resilience of the second sheet S2 overcomes the absorbing force, the second sheet S2 is not bent around the displacement fulcrum portion 15A to maintain the flat attitude, with the result that the tip end of the second sheet S2 is separated from the tip end of the first sheet S1, thereby creating the gap e between the sheets.

Thereafter, the valve 22 is switched to the position b to stop the injection of the air for floating the sheet S and to stop the blower 21. As a result, the second sheet S2 drops on the tray 1 by its own weight. At the same time, the convey belt 14 is driven by the motor M1 to convey the sheet S1 in the direction shown by the arrow A. Accordingly, only the sheet S1 is conveyed toward the downstream direction to be sent to the paired convey rollers 23.

Figure 26:
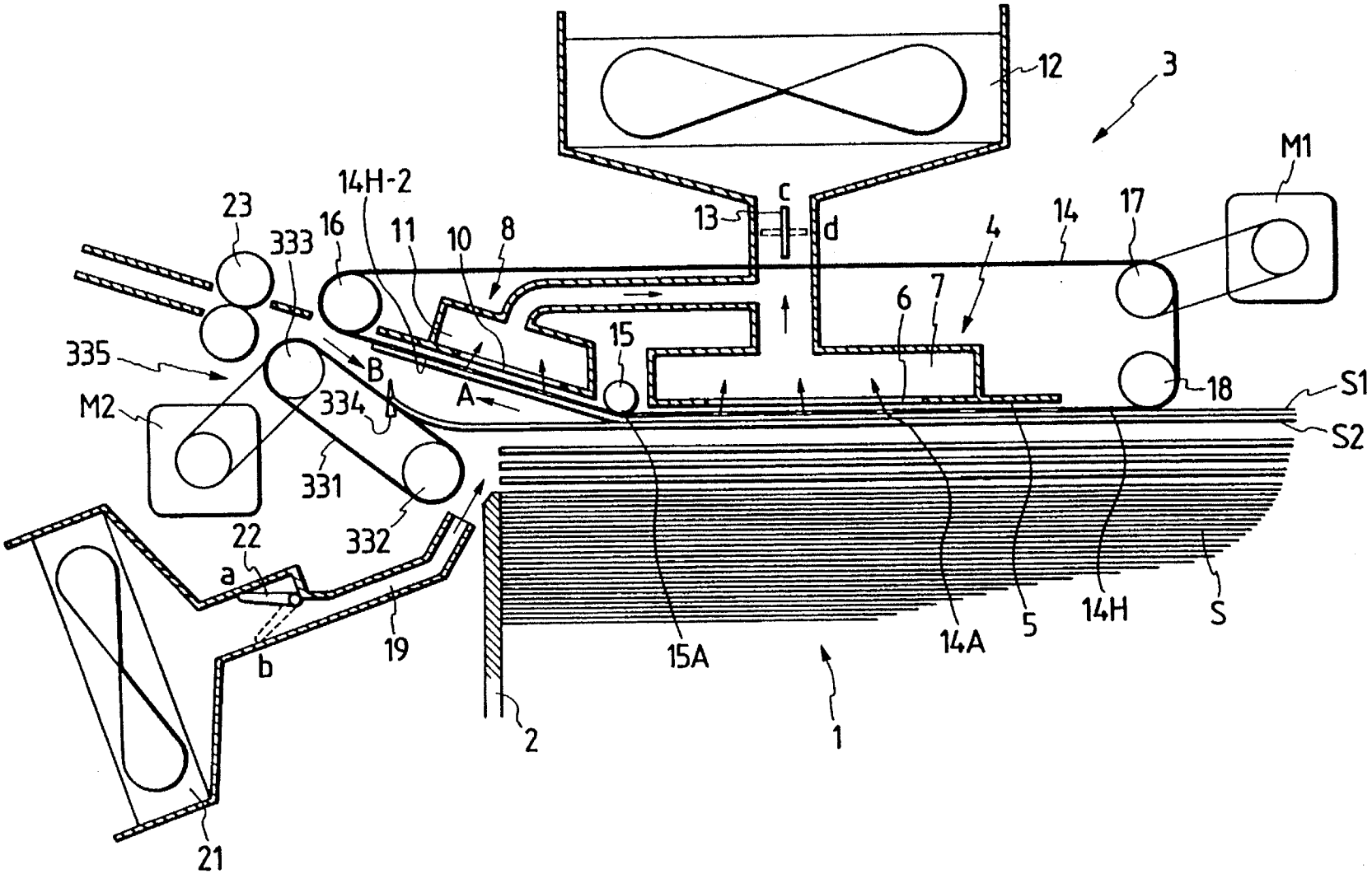
FIG. 26 is an elevational sectional view of the apparatus of FIG. 25 in its operative condition.

In this embodiment, while an example that when the injection of the air from the nozzles 19 is stopped the sheet S2 drops by its own weight was explained, it is feared that the second sheet S2 is also conveyed together with the first sheet S1 because these sheets are closely contacted with each other, depending upon the kinds of the sheets and/or due to the poor cutting of the sheet edges and the charging of the sheets. In this case, although the sheet S1 is conveyed in the direction shown by the arrow A while closely contacting with the convey belt 14, the second sheet S2 is dragged by the sheet S1 to abut against the separation belt 331. This condition is shown in FIG. 26. The sheet S2 is further dragged to reach the double-feed detection sensor 334. When the tip end of the sheet S2 is detected by the double-feed detection sensor 334, the motor N2 is operated to drive the separation belt 331 in the direction shown by the arrow B. As a result, the sheet S2 is returned onto the tray 1 by the friction force of the separation belt 331. The separation belt 331 is stopped when a predetermined time period is elapsed.

In this way, even if the sheets are double-fed, the sheets can be separated without fail by the action of the separation belt 331.

In this embodiment, while the separation belt 331 was driven on the basis of the detection of the double-feed detection sensor 334, the separation belt 331 may always be driven when the convey belt 14 is being driven.

Figure 27:
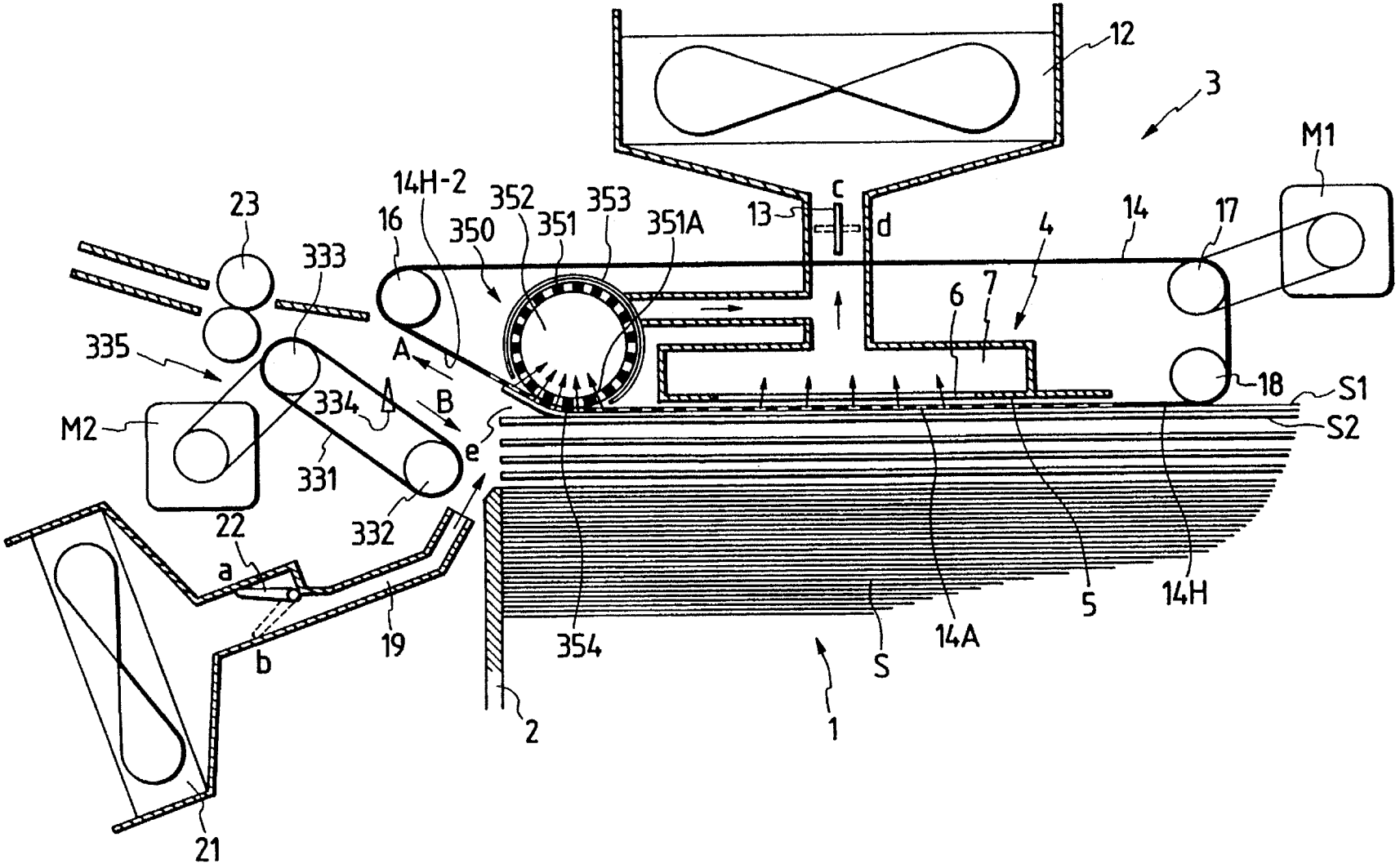
FIG. 27 is an elevational sectional view of a sheet supply apparatus according to a sixteenth embodiment of the present invention.

FIG. 27 shows a whole construction of a sheet supply apparatus according to a sixteenth embodiment of the present invention.

In this sheet supply apparatus, a second sheet absorb means 350 is arranged at a downstream side of the first sheet absorb means 4 in the sheet convey direction. Further, the second sheet absorb means 350 comprises a hollow absorb roller 351 having a plurality of absorb openings 351A formed in the surface thereof, a suction chamber portion 352, and a cover 353 for covering the absorb roller 351 except for a portion thereof for absorbing the sheet S. Since the sheet absorbing portion (surface) of the absorb roller 351 has a curvature, it is positioned substantially above the flat bottom plate 5 of the first sheet absorb means 4.

The first sheet absorb means 4 and the second sheet absorb means 350 are connected to the blower 12. The convey belt 14 is mounted in such a manner that it covers the surfaces of the first and second sheet absorb means 4, 350. The convey belt 14 is supported by the rollers 15, 16, 17 and 18 with a predetermined tension and is intermittently driven in the direction shown by the arrow A by the motor M1, thereby conveying the sheet. A belt separation portion 335 is opposed to the second sheet absorb means 350 at the downstream side of the tray 1 in the sheet convey direction. The construction of the belt separation portion 335 is the same as that of the above-mentioned fifteenth embodiment.

Also in this sheet supply apparatus having the construction as mentioned above, by adopting the same operation as that of the above-mentioned fifteenth embodiment, it is possible to return the double-fed sheet S2 onto the tray 1.

Figure 28:
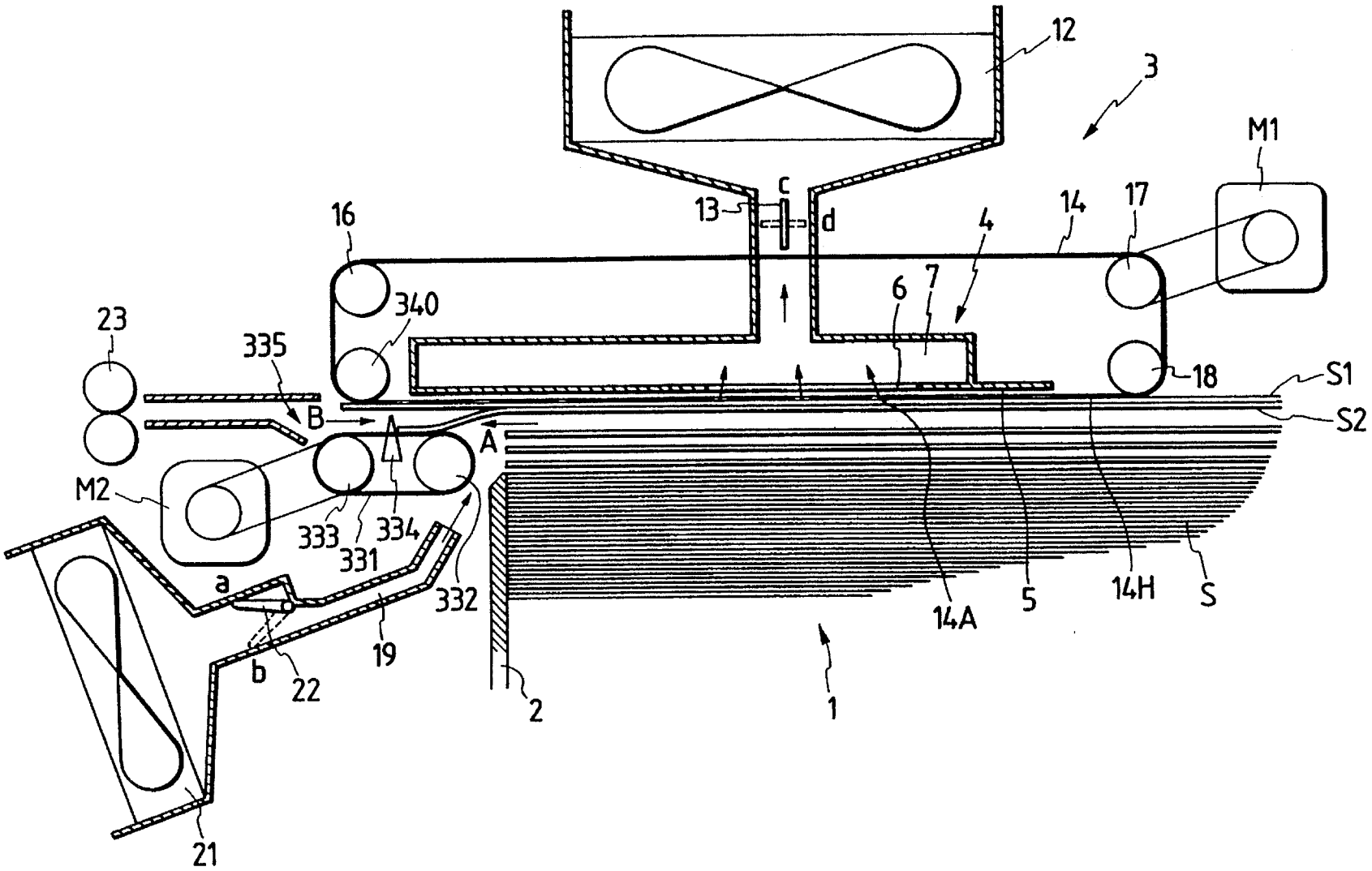
FIG. 28 is an elevational sectional view of a sheet supply apparatus according to a seventeenth embodiment of the present invention.

FIG. 28 shows a whole construction of a sheet supply apparatus according to a seventeenth embodiment of the present invention. In this embodiment, a belt separation portion is applied to the conventional air sheet supply apparatus.

In this sheet supply apparatus, the convey belt 14 is supported by rollers 340, 16, 17 and 18 with a predetermined tension. The roller 17 is a drive roller which is driven by the motor M1. The convey belt 14 is intermittently driven by the drive roller 17 in the direction shown by the arrow A, thereby conveying the sheet S.

A belt separation portion 335 includes a separation belt 331 which extends between and wound around rollers 332, 333. The separation belt 331 is driven by the motor M2 in the direction shown by the arrow B. A double-feed detection sensor 334 is arranged in the proximity of the separation belt 331.

Next, the operation of this sheet supply apparatus will be explained.

The operation of this sheet supply apparatus is the same as that of the apparatus according to the above-mentioned fifteenth embodiment. That is to say, if the second sheet S2 is conveyed together with the first sheet S1, the sheet S1 is conveyed in the direction shown by the arrow A while closely contacting with the convey belt 14, and the sheet S2 is dragged by the sheet S1. The tip end of the sheet S2 comes down by its own weight and is abutted against the separation belt 331. The sheet S2 is further dragged to reach the double-feed detection sensor 334. When the tip end of the sheet S2 is detected by the double-feed detection sensor 334, the motor M2 is operated to shift the separation belt 331 in the direction shown by the arrow B.

As a result, the sheet S2 is returned onto the tray 1 by the friction force of the separation belt 331. The separation belt 331 is stopped when a predetermined time period is elapsed. In this way, even if the sheets are double-fed, the sheets can be separated without fail by the action of the separation belt 331.

In this embodiment, while the separation belt 331 was driven on the basis of the detection of the double-feed detection sensor 334, the separation belt 331 may be always driven when the convey belt 14 is being driven.

Next, an eighteenth embodiment in which an area of the absorb opening of the sheet absorb means is controlled regarding the first embodiment will be explained.

In this eighteenth embodiment, the area of the absorb opening of the first sheet absorb means 4 of the first embodiment is controlled. Thus, this control will be fully explained.

Figure 29A:
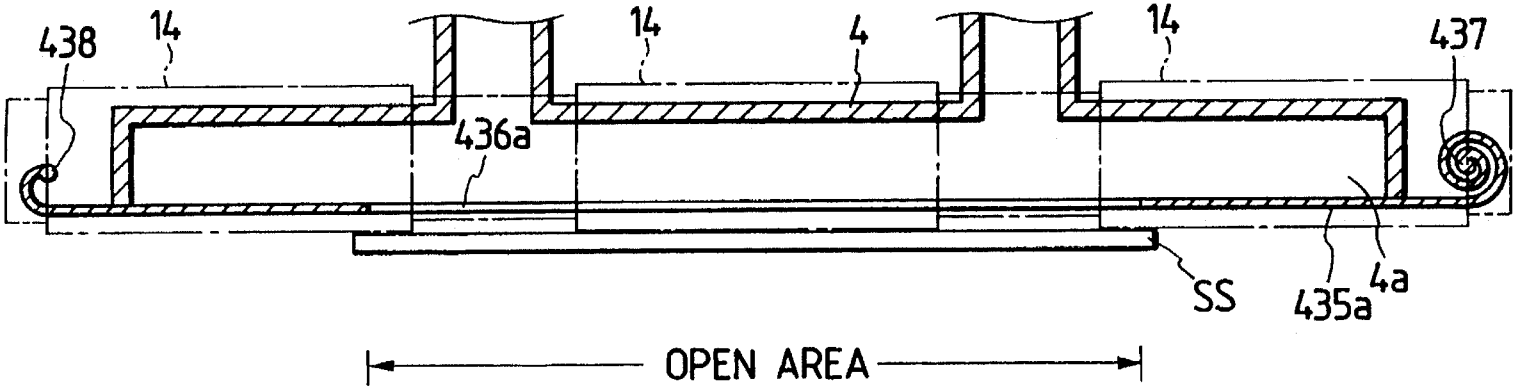
FIGS. 29A and 29B are sectional views of a sheet supply apparatus according to an eighteenth embodiment of the present invention, looked at from a downstream side of a sheet convey direction.
Figure 29B:
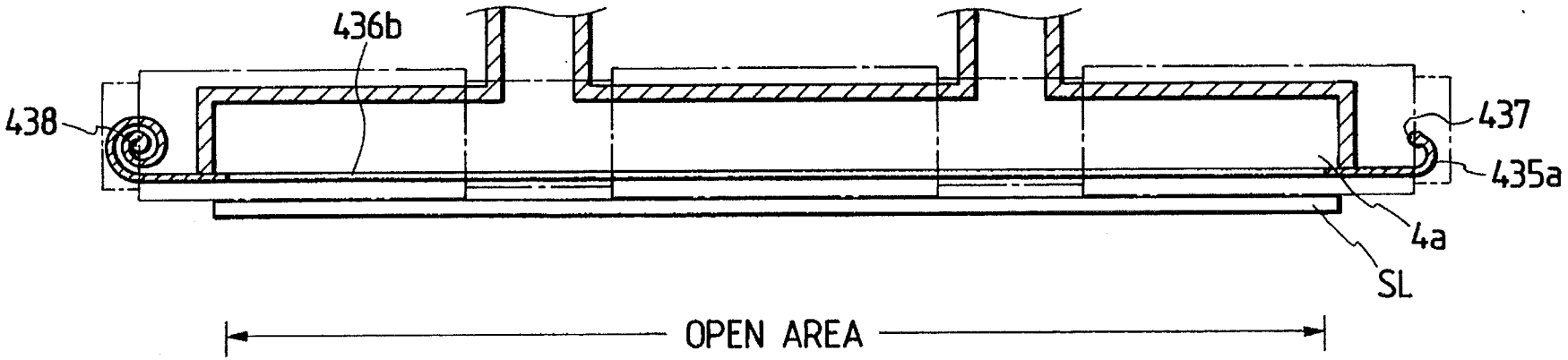
Figure 30A:
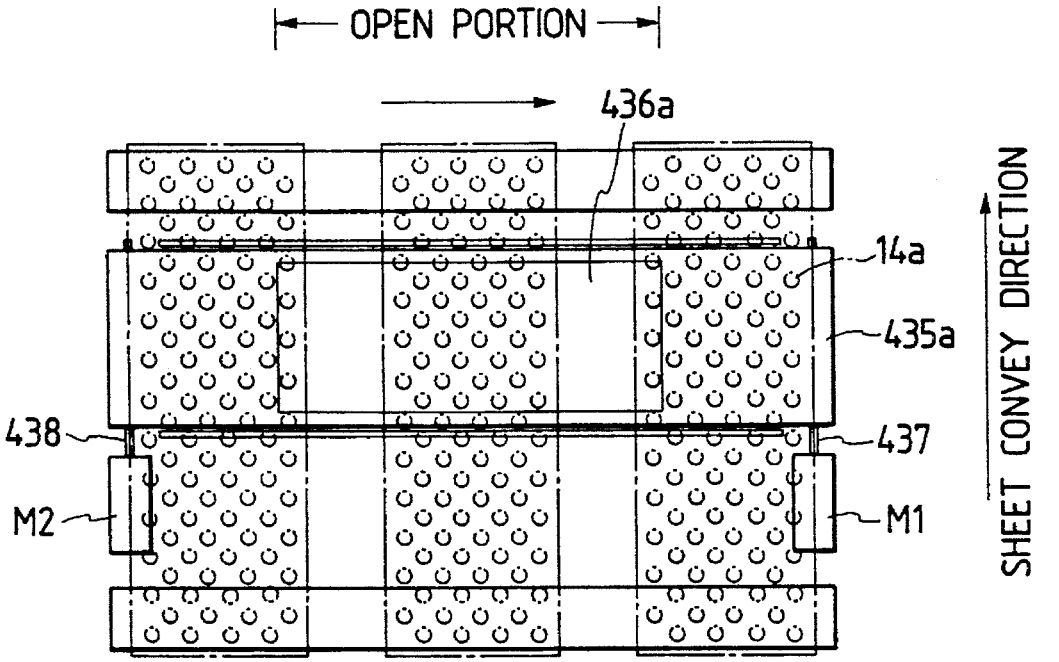
FIGS. 30A and 30B are bottom views of the apparatus of FIGS. 29A and 29B.
Figure 30B:
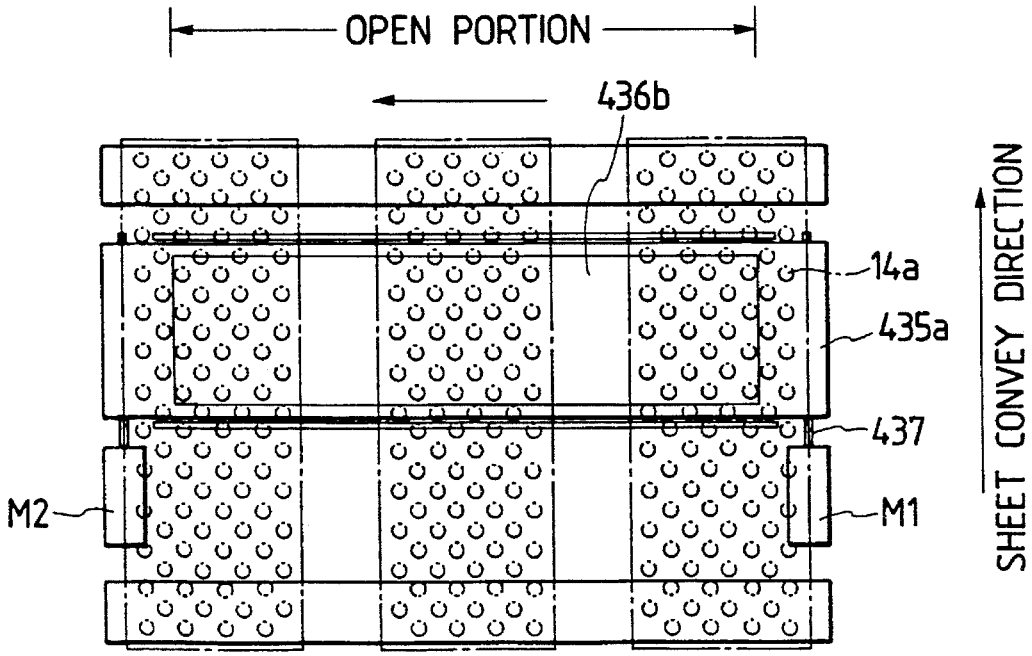
Figure 31:
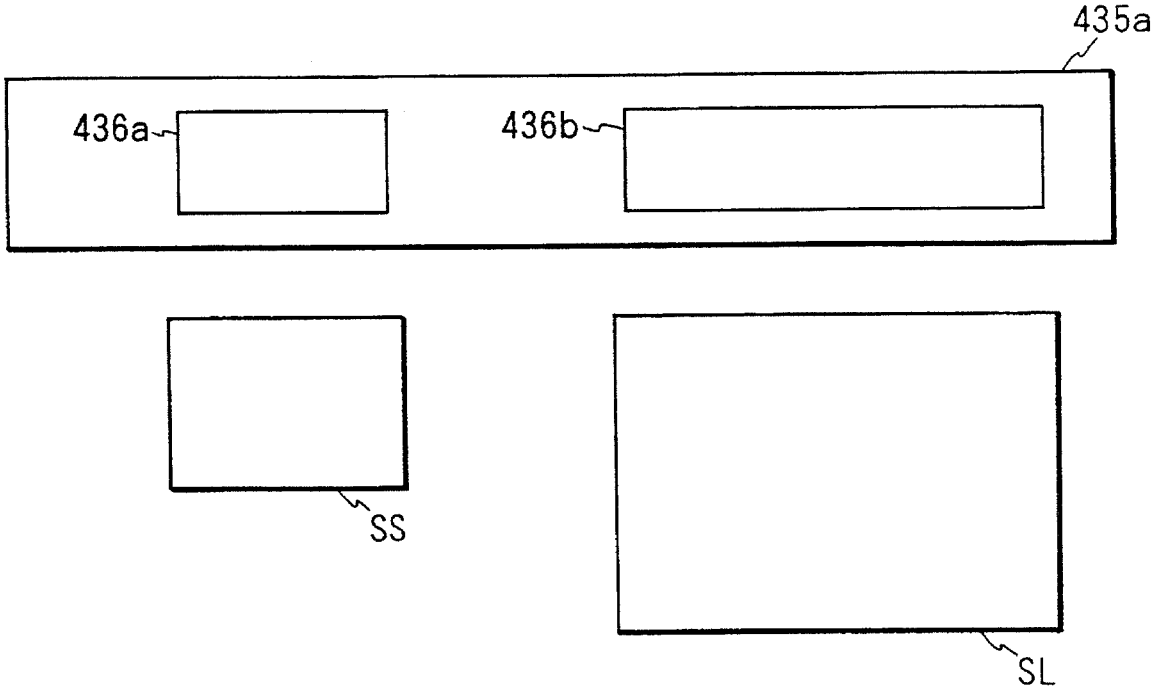
FIG. 31 is a plan view of a shutter member of the apparatus of FIGS. 29A and 29B.

FIGS. 29A and 29B are views of the sheet convey portion 3 looked at from the downstream side of the sheet convey direction, and FIGS. 30A and 30B are views of the sheet convey portion 3 looked at from the bottom. As shown in FIG. 31, a shutter sheet (shutter member) 435*a* has a small opening portion 436*a* (having a width substantially the same as that of a small size sheet SS) corresponding to the small size sheet SS, and a large opening portion 436*b* (having a width substantially the same as that of a large size sheet SL) corresponding to the large size sheet SL. The shutter 435*a* constitutes an air absorb opening portion and is secured to rotatably supported shafts 437, 438 at its both ends and is wound around the shafts. Motors (drive means) M1, M2 serve to rotatingly drive the shafts 437, 438 to wind up the shutter 435*a*.

With this arrangement, when the small size sheet SS is supplied, the motor M1 is driven to wind up the shutter 435*a* in a direction shown by the arrow (right in FIG. 30A), with the result that the sheet SS is absorbed with the opening portion 436*a* maintained in a condition shown in FIG. 30A. Accordingly, as shown in FIG. 29A, since the opening portion 436*a* is generally covered by the sheet SS, the leakage of air is prevented, thus obtaining the sufficient absorbing force. On the other hand, when the large size sheet SL is supplied, the motor M2 is driven to wind up the shutter 435*a* in a direction shown by the arrow (left in FIG. 30B), with the result that the sheet SL is absorbed with the opening portion 436*b* maintained in a condition shown in FIG. 30B. Accordingly, as shown in FIG. 29B, since the sheet SL is absorbed through its whole length, both ends of the sheet SL are also adhered to the convey belt 14.

Figure 32A:
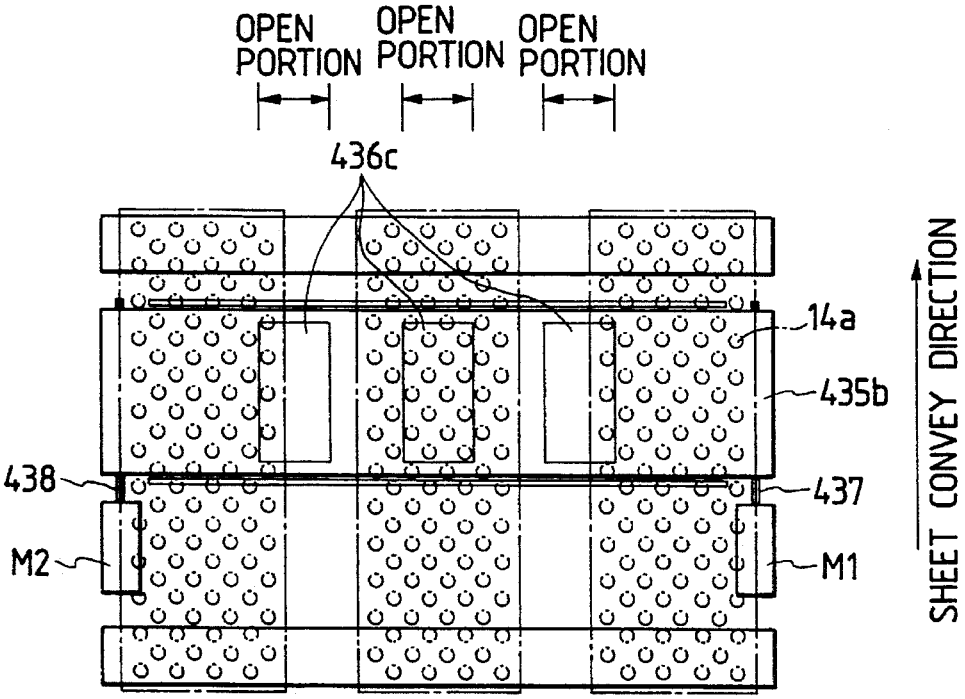
FIGS. 32A and 32B are bottom views of a sheet supply apparatus according to a nineteenth embodiment of the present invention.
Figure 32B:
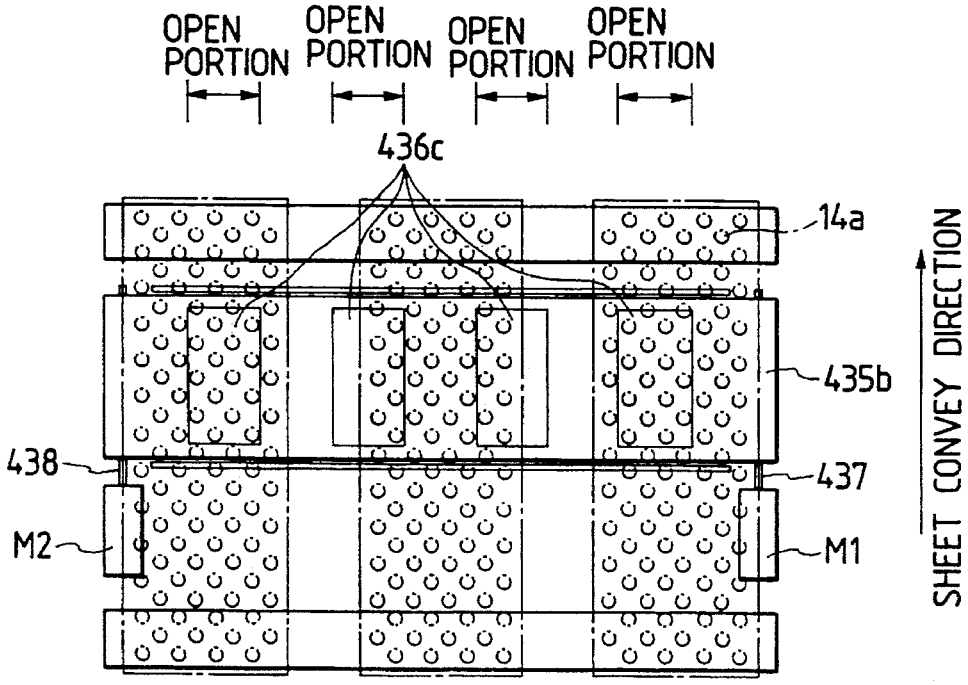
Figure 33:
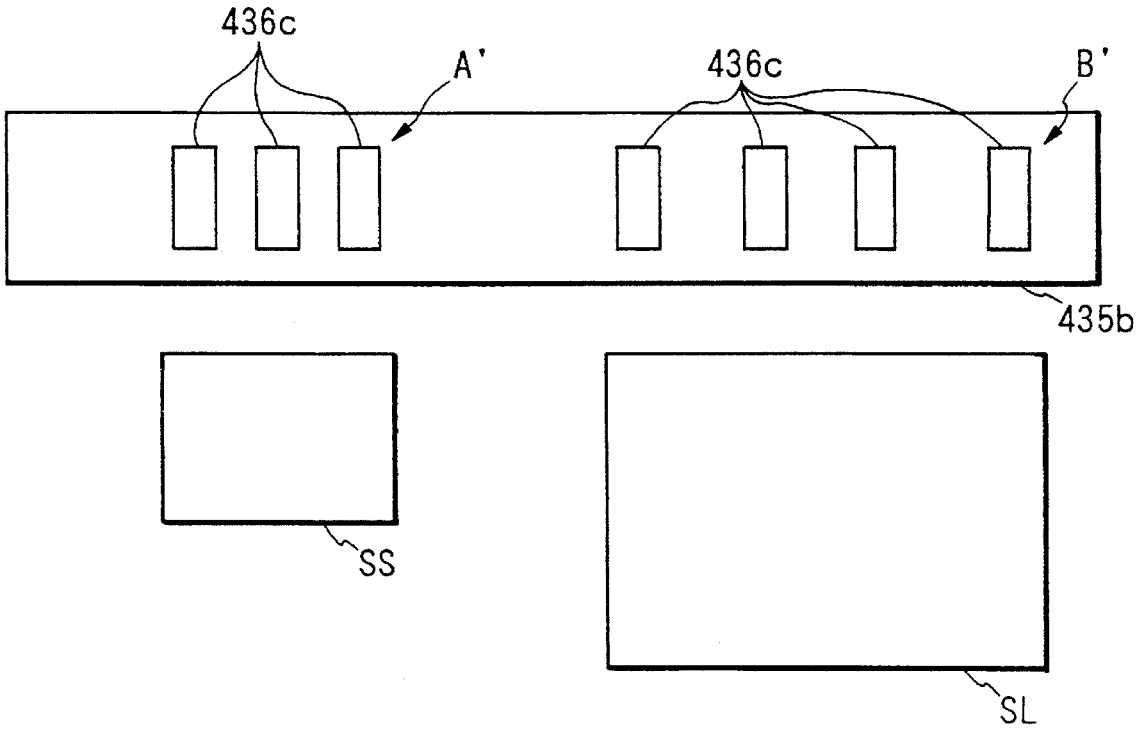
FIG. 33 is a plan view of a shutter member of the apparatus of FIGS. 32A and 32B.

Next, a nineteenth embodiment of the present invention will be explained with reference to FIGS. 32A, 32B and 33. Incidentally, since the fundamental construction of a sheet supply apparatus of this embodiment is substantially the same as that of the eighteenth embodiment, the same constructural elements as those of the eighteenth embodiment are designated by the same reference numerals and the detailed explanation thereof will be omitted. As shown in FIG. 33, the sheet supply apparatus according to the nineteenth embodiment has a shutter sheet (shutter member) 435*b*. The shutter sheet 435*b* has a group of openings A' corresponding to a small size sheet SS and including three opening portions 436*c*, and a group of openings B7 corresponding to a large size sheet SL and including four opening portions 436*c*. As similar to the eighteenth embodiment, the opening group A' is arranged as shown in FIG. 32A to absorb the sheet SS. On the other hand, when the large size sheet SL is supplied, the opening group B' is arranged as shown in FIG. 32B to absorb the sheet SL.

In this example, while the number of opening portions corresponding to the small size sheet SS was decreased and the number of the opening portions or the distance between the opening portions corresponding to the large size sheet SL was increased, such number of openings and/or the opening-to-opening distance may be varied.

Next, a twentieth embodiment of the present invention in which the injection of airs from the nozzles 19, 20 regarding the first embodiment is controlled will be explained.

Since the construction of a sheet supply apparatus itself of the twentieth embodiment is the same as that of the first embodiment (only the air injection controls are different from each other), the apparatus itself is not shown.

When the sheet S is floated, the valve 22 is switched to the position a to inject the air from the nozzles 19, and when the sheets S are separated, the valve 22 is switched to the position b to inject the air from the nozzles 20. In this way, the sheet supply operation is effected.

By the way, when the sheet supply operation of the sheet supply apparatus is not performed, the valve 22 is switched to the position a so that the nozzles 19 are controlled by a control portion (adjust means) (not shown) in such a manner that an air amount injected from the nozzles 19 in the sheet supply operation is reduced. Also in this condition, several sheets S can be blown up to float, and the air can be introduced between the floated sheets. The other constructions of this sheet supply apparatus is the same as those of the first embodiment.

Figure 34:
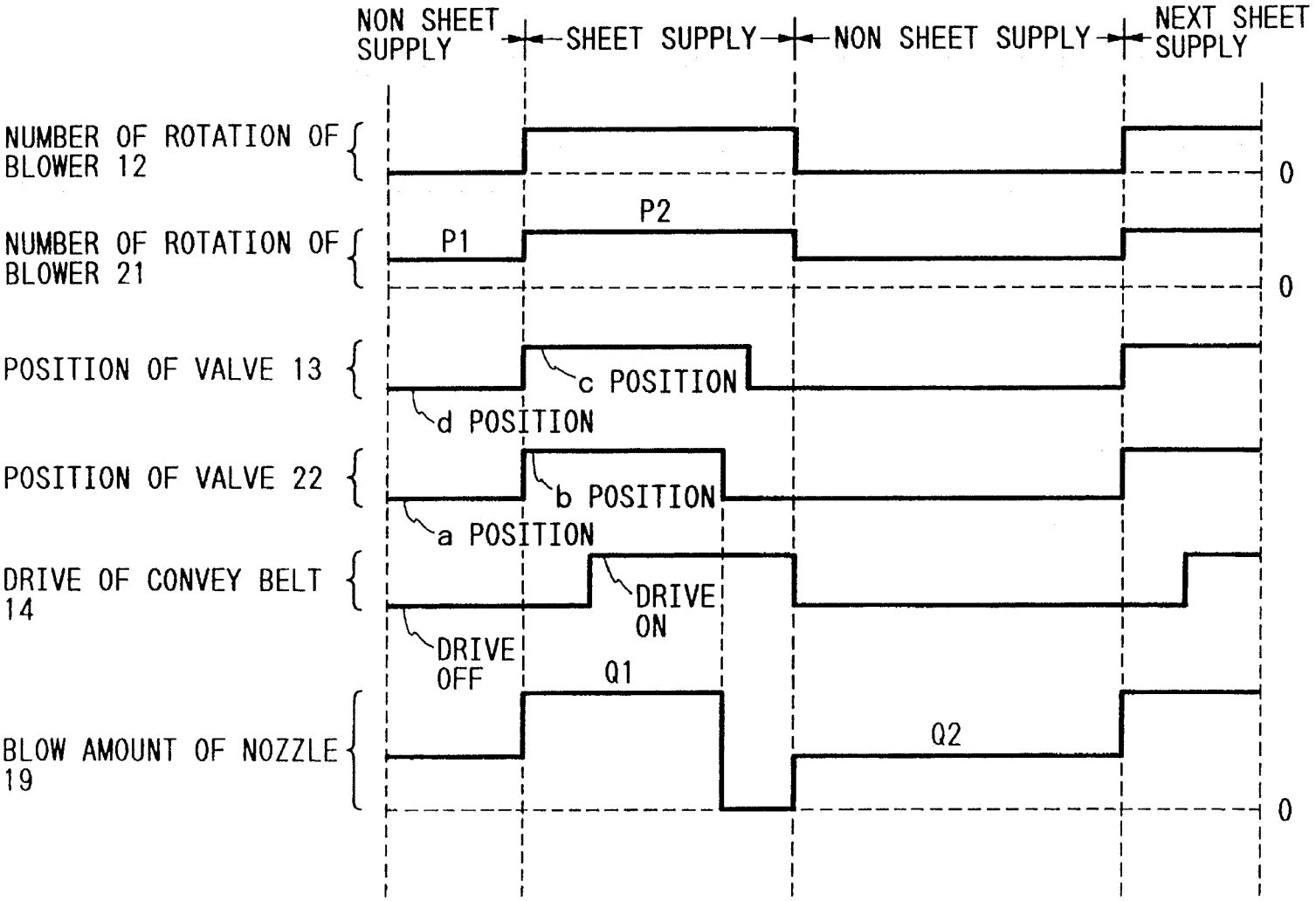
FIG. 34 is a control timing chart of a sheet supply apparatus according to a twentieth embodiment of the present invention.

FIG. 34 shows a detailed drive timing chart. The blower 12 is not rotated when the sheet supply operation is not effected; but, during the sheet supply operation, the blower 12 is rotated. When the sheet supply operation is finished, the blower 12 is stopped. In this case, the blower 21 is rotated with the smaller number (P1) of rotation when the sheet supply operation is not effected, and is rotated with the number P2 (>P1) of rotation during the sheet supply operation. When the sheet supply operation is finished, the number of rotation of the blower 21 is returned from P2 to P1. Further, when the sheet supply operation is not effected, the valve 13 is in the position d; but, the valve 13 is switched to the position c in the sheet supply operation, and is returned to the position d when the sheet supply operation is finished. On the other hand, the valve 22 is in the position a when the sheet supply operation is not effected; but, the valve 22 is switched to the position b in the sheet supply operation, and is returned to the position a when the sheet supply operation is finished. Further, the drive of the convey belt 14 is turned OFF when the sheet supply operation is not effected; but, when the sheet supply operation is started and the sheet S has been adhered to the convey belt 14, the drive of the convey belt 14 is turned ON to convey the sheet S, and when the sheet supply operation is finished the drive of the convey belt 14 is turned OFF again. By controlling the blower 21 and the valve 22 as mentioned above, the blow amount of the nozzle 19 becomes as shown in FIG. 34 so that, when the sheet supply operation is not effected, the air is injected with the blow amount Q2 smaller than the blow amount Q1 (during the sheet supply operation).

In this way, when the sheet supply operation is not effected, by injecting the air against the sheet stack S, since it is possible to float several sheets and to pass the air along both surfaces of each sheet, thereby reducing the moisture absorption of the sheet and making the hygroscopicity of the sheets uniform, it is possible to perform the excellent image formation without any image flow and the curl in the sheet S.

Further, particularly in this embodiment, since the air blowing means for reducing the moisture absorption of the sheet and for making the hygroscopicity of the sheets uniform also serves as the air blowing means (blower 21 and nozzle 19) for floating the sheets in the sheet supply apparatus, the sheet supply apparatus is prevented from making large-sized and expensive.

Furthermore, in this embodiment, while the blow amount from the nozzle 19 in the non-sheet supply period was smaller than the blow amount in the sheet supply operation to reduce the noise, the blow amount in the non-sheet supply period may be equal to the blow amount in the sheet supply operation, or, when the sheet supply apparatus is used under the high humidity condition, the blow amount in the non-sheet supply period may be greater than the blow amount in the sheet supply operation to further reduce the moisture absorption of the sheet S and to make the hygroscopicity of the sheets further uniform.

Figure 35:
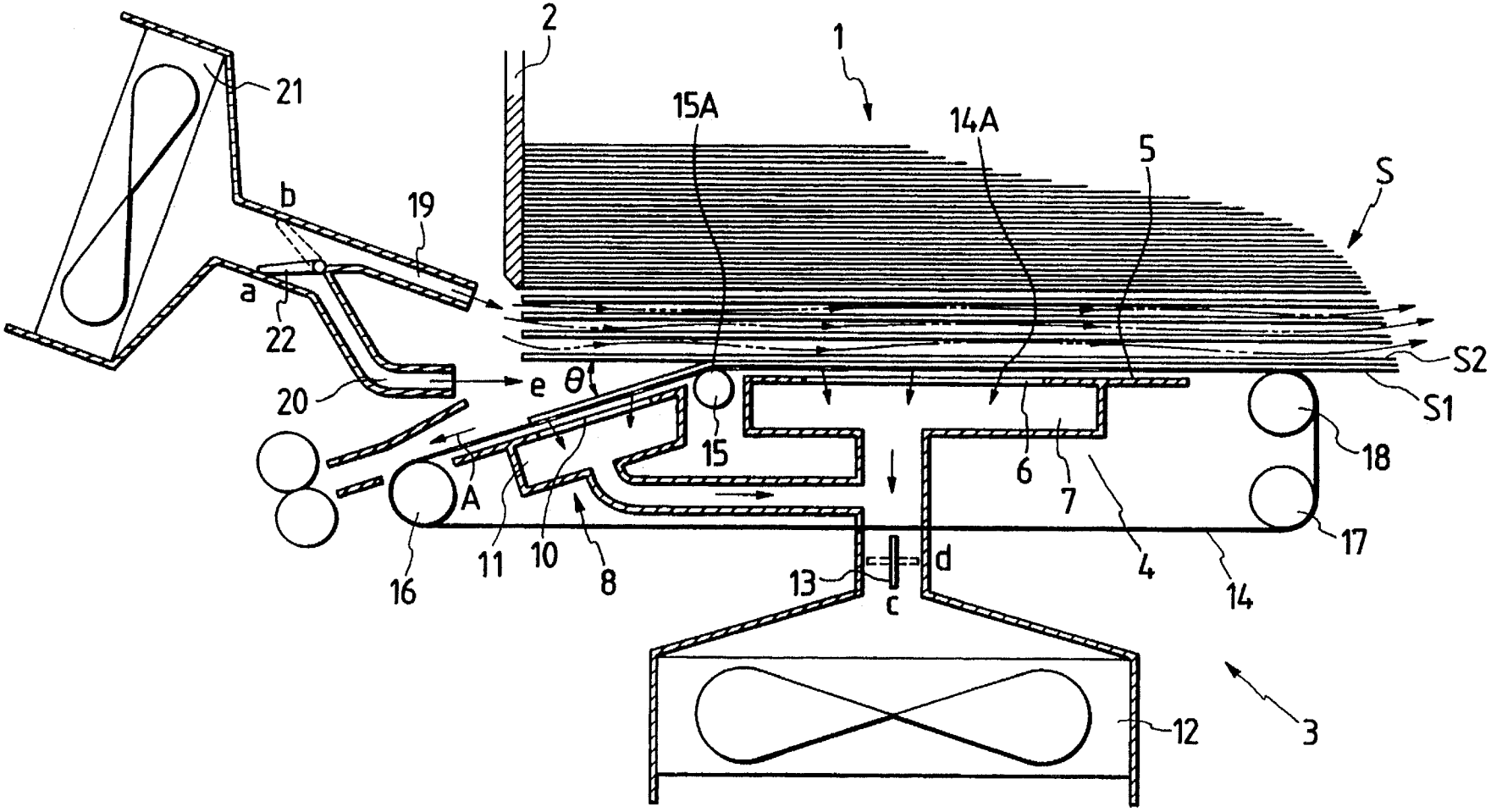
FIG. 35 is an elevational sectional view of a sheet supply apparatus of other type applying the twentieth embodiment.

Further, as shown in FIG. 35, the arrangement of the elements of the sheet supply apparatus may be inverted (upside down) with respect to the arrangement of FIG. 1. With this arrangement, the sheets S are separated and conveyed one by one from a lowermost sheet of the sheet stack. Such arrangement is mainly used in an automatic original feeding apparatus of various image forming apparatuses (particularly, copying machines) or in a sheet tray of a sheet reversing (inverting) portion of both-sided image forming apparatuses. By injecting the air in the non-sheet supply period, since it is possible to pass the air along both surfaces of stacked sheets, the moisture absorption of the sheet S can be reduced and the hygroscopicity of the sheets can be made uniform, thereby performing the excellent image formation without any image flow and the curl in the sheet S.

Further, in the twentieth embodiment, while an example that the present invention is applied to the sheet supply apparatus was explained, the present invention is not limited to this example, but the air blowing means may be provided in a roller sheet supply apparatus, for example. Accordingly, the kind of the sheet supply apparatus is not limited. Furthermore, in this embodiment, while the air was always injected from the nozzles even in the non-sheet supply period, for example, in order to save the electric power and to reduce the noise, a means for manually turning OFF the air injection when the image forming apparatus is not used for a long time may be provided.

Figure 36C:
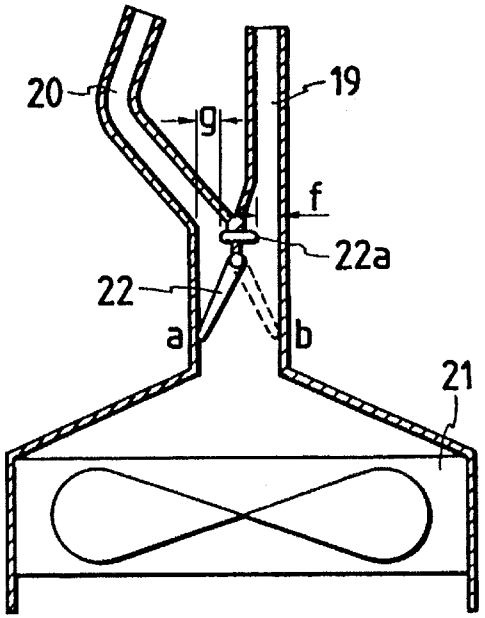
FIGS. 36A to 36C are sectional views showing the operation of a sheet supply apparatus according to a twenty-first embodiment of the present invention.
Figure 36B:
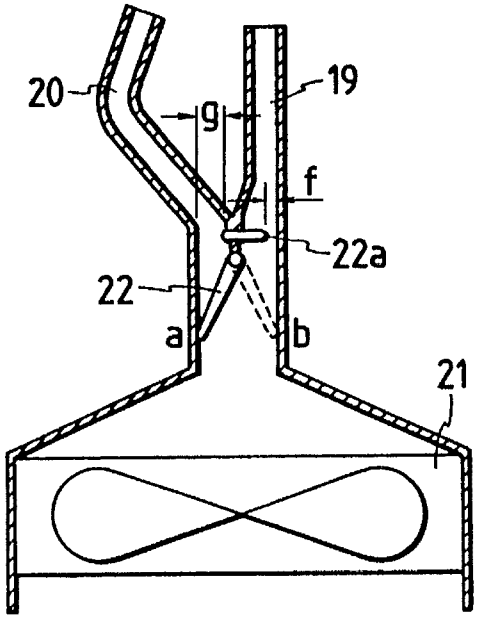
Figure 36A:
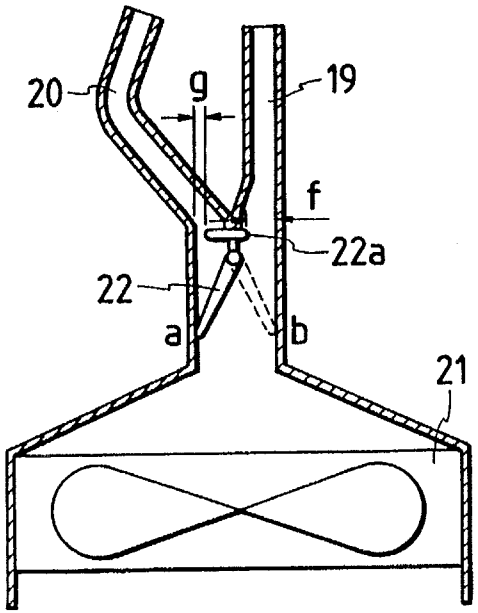

Next, a twenty-first embodiment of the present invention will be explained with reference to FIGS. 36A to 36C. Incidentally, since the fundamental construction of a sheet supply apparatus according to the twenty-first embodiment is substantially the same as that of the twentieth embodiment, the same constructural elements are designated by the same reference numerals and the explanation thereof will be omitted. FIGS. 36A to 36C are sectional views showing the variable condition of the valve 22 of the air blowing means.

In accordance with the kinds of the sheets S, the operator manipulates a switch means (not shown) exposed from the sheet supply apparatus. For example, when the kinds of the sheets S are grouped into three (thick sheet, thin sheet and normal sheet), the operator can shift the switch means to one of three positions corresponding to three kinds of sheets. In response to the shifting movement of the switch means, a regulating valve (adjust means) 22*a* is shifted along a plane including the lower openings of the nozzles 19, 20 to control the opening areas of the nozzles 19, 20.

FIGS. 36A to 36C show schematic positional relation of the regulating valve 22*a* between the above-mentioned three kinds of sheets. FIG. 36A shows a condition that the thick sheet is handled. In this case, the regulating valve is adjusted so that the blow amount from the nozzle 19 becomes greater than the blow amount from the nozzle 20 (f>g), thereby increasing the floating force for floating the sheets S. FIG. 36B shows a condition that the thick sheet is handled. In this case, the regulating valve is adjusted so that the blow amount from the nozzle 19 becomes smaller than the blow amount from the nozzle 20 (f<g), thereby decreasing the floating force for floating the sheets S to enhance the separating ability. FIG. 36C shows a condition that the normal sheet is handled. In this case, the regulating valve 22*a* is adjusted so that the opening area of the nozzle 19 becomes substantially the same as that of the nozzle 20 (f=g). That is to say, the regulating valve 22*a* is shifted to control the air amounts from the nozzles 19, 20 so that the sum of the air amount from the nozzle 19 and the air amount from the nozzle 20 is always constant, thereby supplying the air amounts in accordance with the property of the sheet.

When the regulating valve 22*a* is fixed on the basis of the above-mentioned positional relation, then, the valve 22 is switched to the position a by the switch means (not shown) such as a solenoid so that the blower 21 is operated inject the air from the nozzle 19 toward the tip end of the sheet stack S. As a result, several sheets S are blown up to float. Then, the valve 13 is switched to the position c by the switch means (not shown) such as a solenoid so that the blower 12 is operated to suck the air through the absorb openings 6, 10 and the air openings 14*a*. In this way, the uppermost sheet S1 is absorbed to the first and second sheet absorb means 4, 8 and is closely contacted with the convey belt 14.

Next, a twenty-second embodiment of the present invention will be explained with reference to FIG. 37. Incidentally, since the fundamental construction of a sheet supply apparatus according to the twenty-second embodiment is substantially the same as that of the twentieth embodiment, the same constructural elements are designated by the same reference numerals and the explanation thereof will be omitted.

Figure 37:
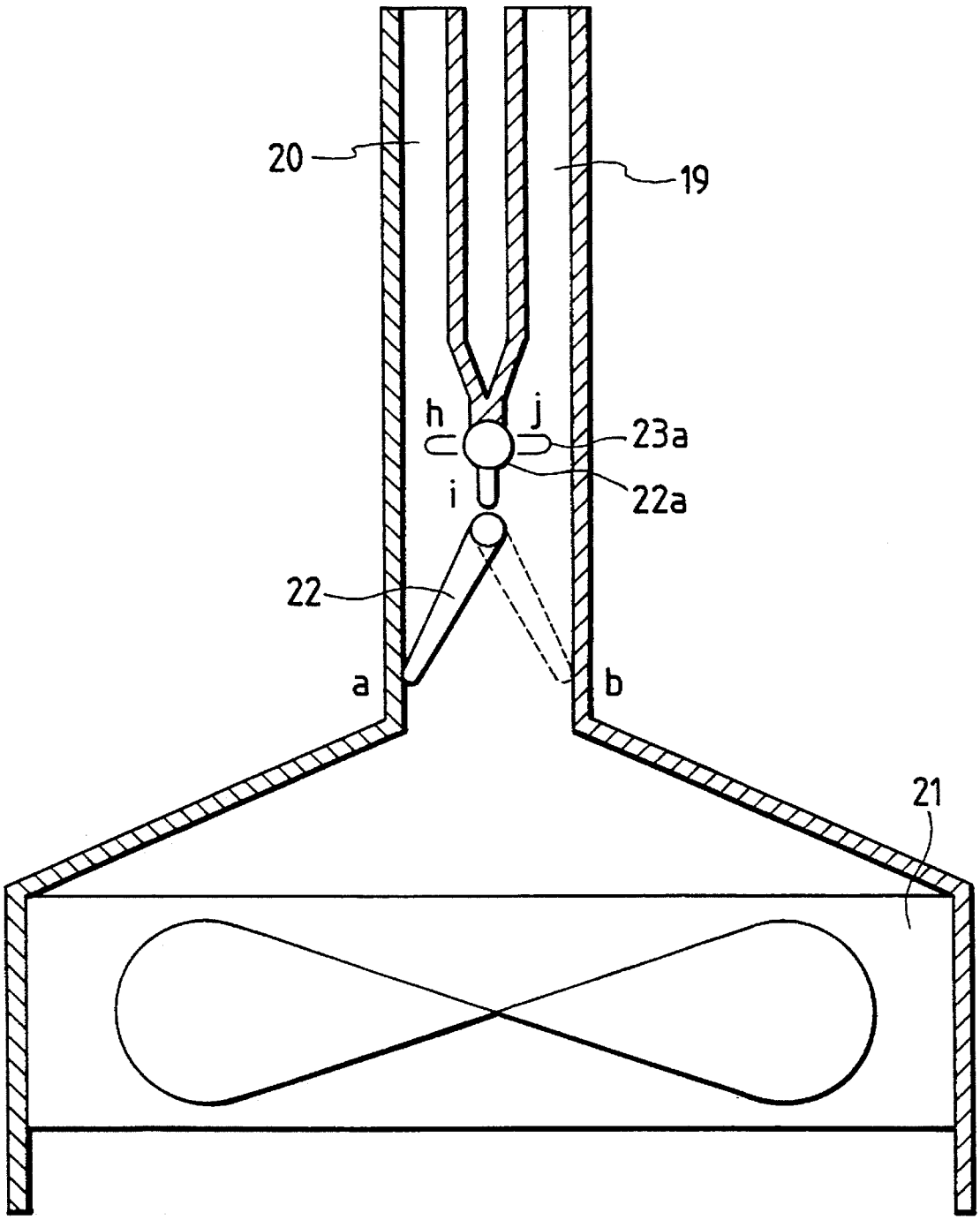
FIG. 37 is a sectional view showing the operation of a sheet supply apparatus according to a twenty-second embodiment of the present invention.

FIG. 37 is a sectional view showing the air blowing means. In the twenty-first embodiment, while the regulating valve 22*a* was slidingly shifted to regulate the opening areas of the nozzles 19, 20, in this twenty-second embodiment, the regulating valve 22*a* is of rotatable type in which the rotation angle of the regulating valve is changed in accordance with the kinds of the sheets to regulate the opening areas of the nozzles 19, 20. That is to say, when the thick sheet is handled, a wall 23*a* protruded from the regulating valve 22*a* is brought into a position h, where the opening areas of the nozzles are regulated so that the opening area of the nozzle 19 becomes greater than the opening area of the nozzle 20. Further, when the thin sheet is handled, the wall is brought into a position j (opposite to the position h), where the opening area of the nozzle 19 becomes smaller than the opening area of the nozzle 20. Further, when the normal sheet is handled, the wall is brought into a position i, where the opening area of the nozzle 19 becomes substantially the same as the opening area of the nozzle 20.

Next, a twenty-third embodiment of the present invention will be explained with reference to FIG. 38. Incidentally, since the fundamental construction of a sheet supply apparatus according to the twenty-third embodiment is substantially the same as that of the twentieth embodiment, the same constructural elements are designated by the same reference numerals and the explanation thereof will be omitted.

Figure 38:
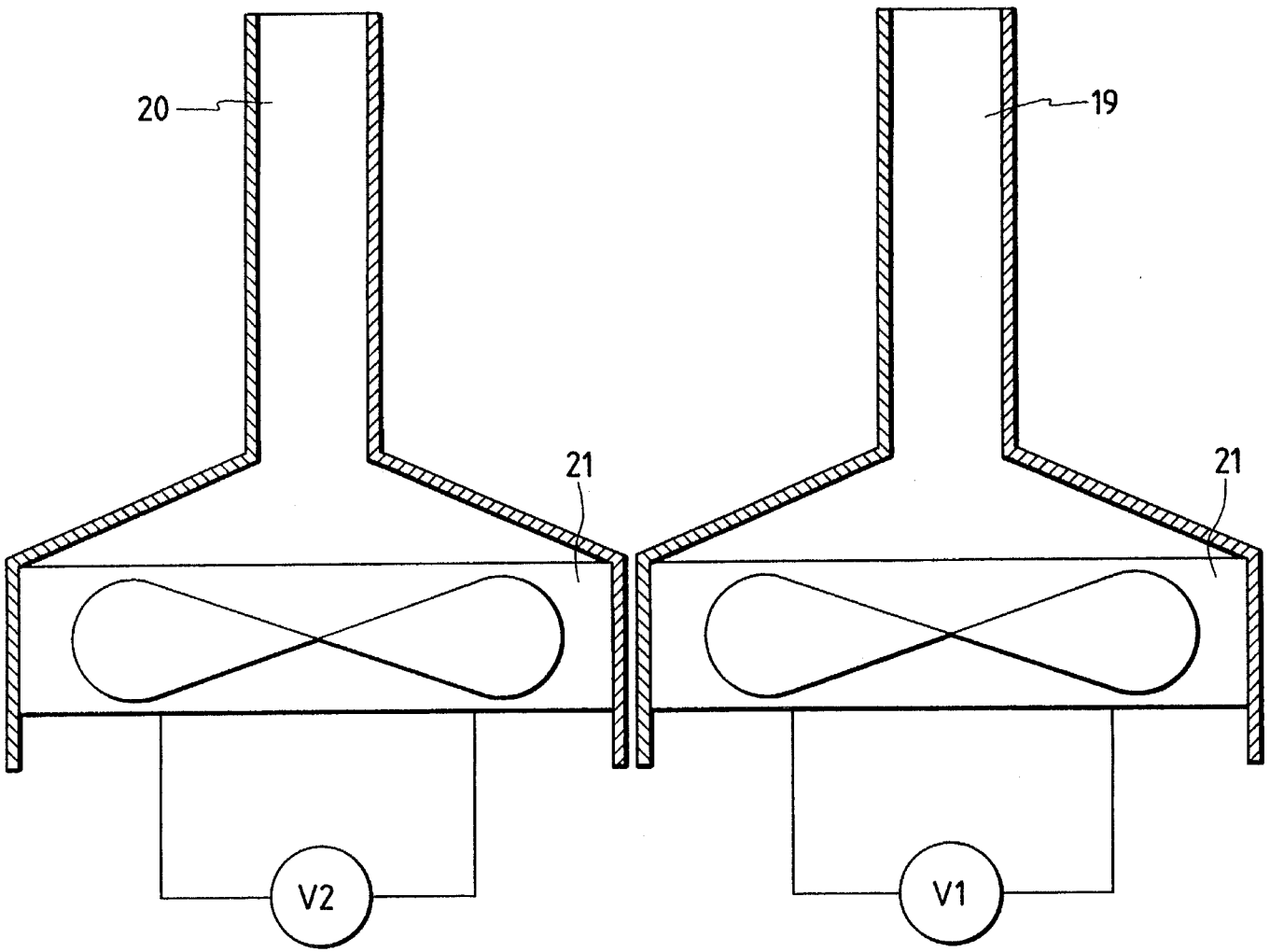
FIG. 38 is an elevational sectional view of a sheet supply apparatus according to a twenty-third embodiment of the present invention.

FIG. 38 is a sectional view showing the air blowing means. In this embodiment, the valve 22 and the regulating valve 22*a* are not used, but air blowing blowers 21 having the same ability are attached to the nozzles 19, 20, respectively. These blowers 21 are set so that a service voltage is proportional to the number of rotation of the blower 21 (i.e., air amount injected from the blower). By an electric means (not shown) for changing the voltages V1, V2 (V1+V2=V) supplied to the blowers 21 relatively, when the thick sheet is handled, a relation V1>V2 is established, and, when the thin sheet is handled, a relation V1<V2 is established, and when the normal sheet is handled, a relation V1=V2 is established. In this way, the air amounts injected from the nozzles 19, 20 are regulated relatively, thereby achieving the same technical effect as that of the twenty-second embodiment.

Figure 39:
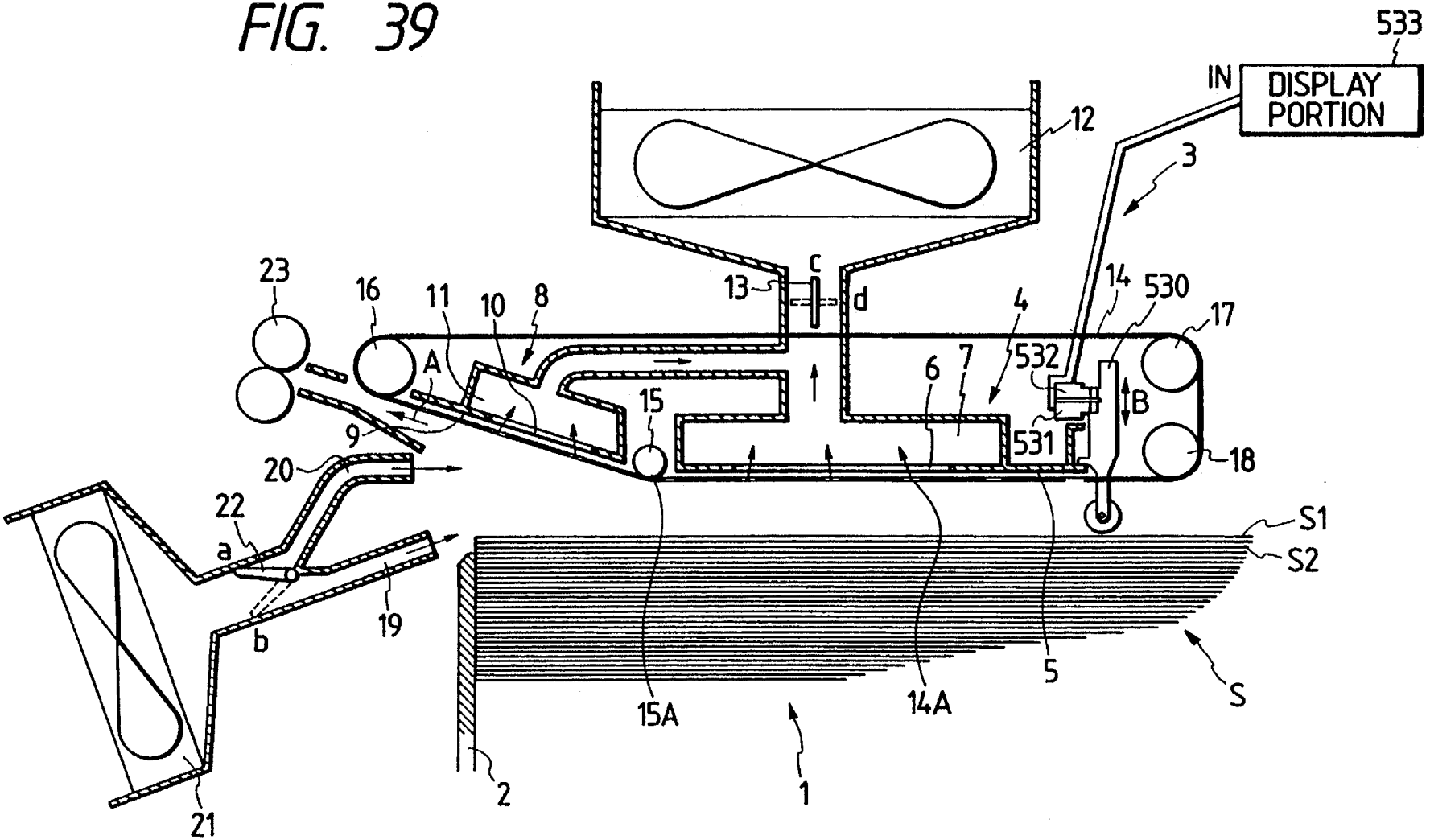
FIG. 39 is an elevational sectional view of a sheet supply apparatus according to a twenty-fourth embodiment of the present invention.
Figure 40:
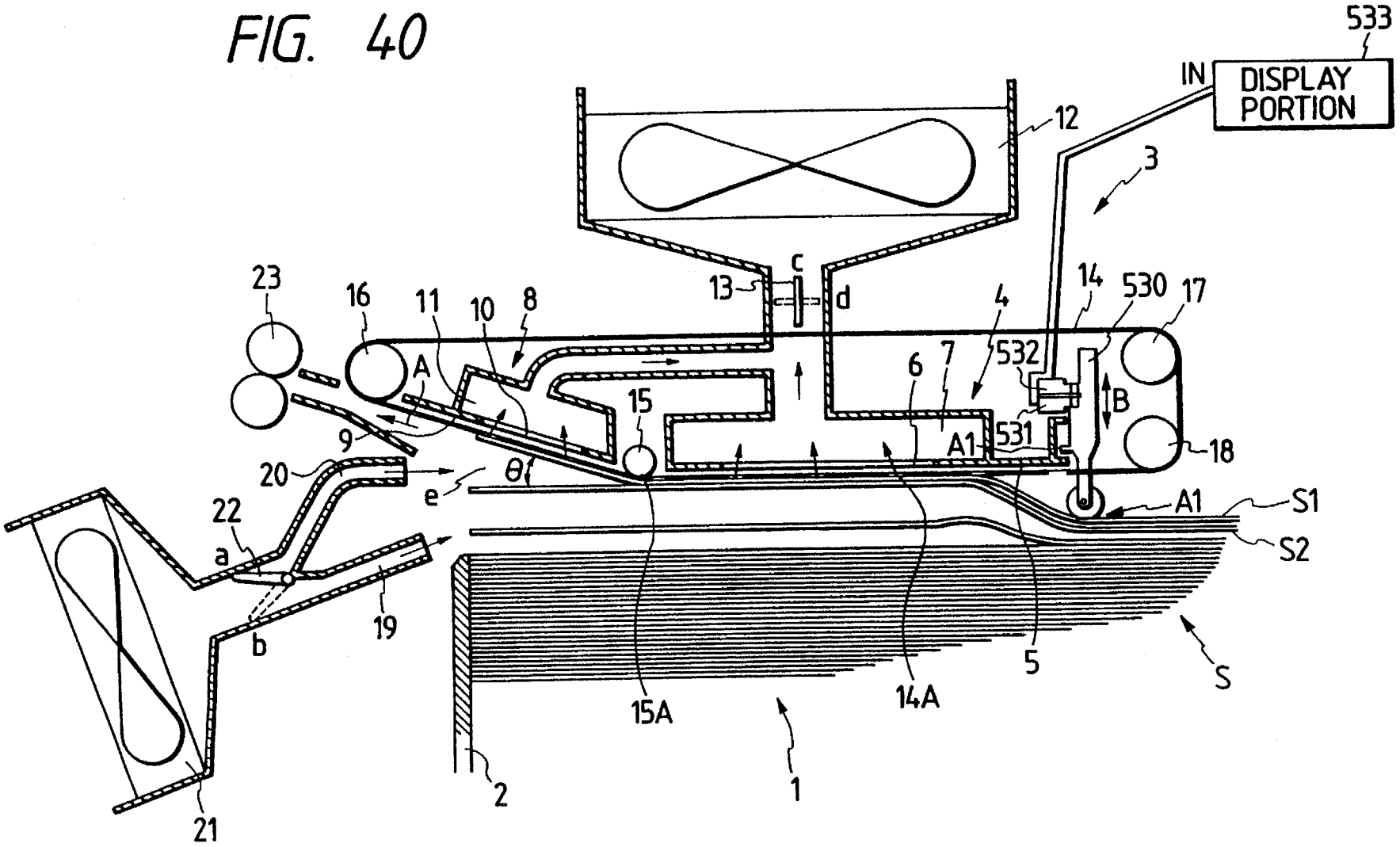
FIGS. 40 and 41 are elevational sectional views of the apparatus of FIG. 39 in its operative condition.
Figure 41:
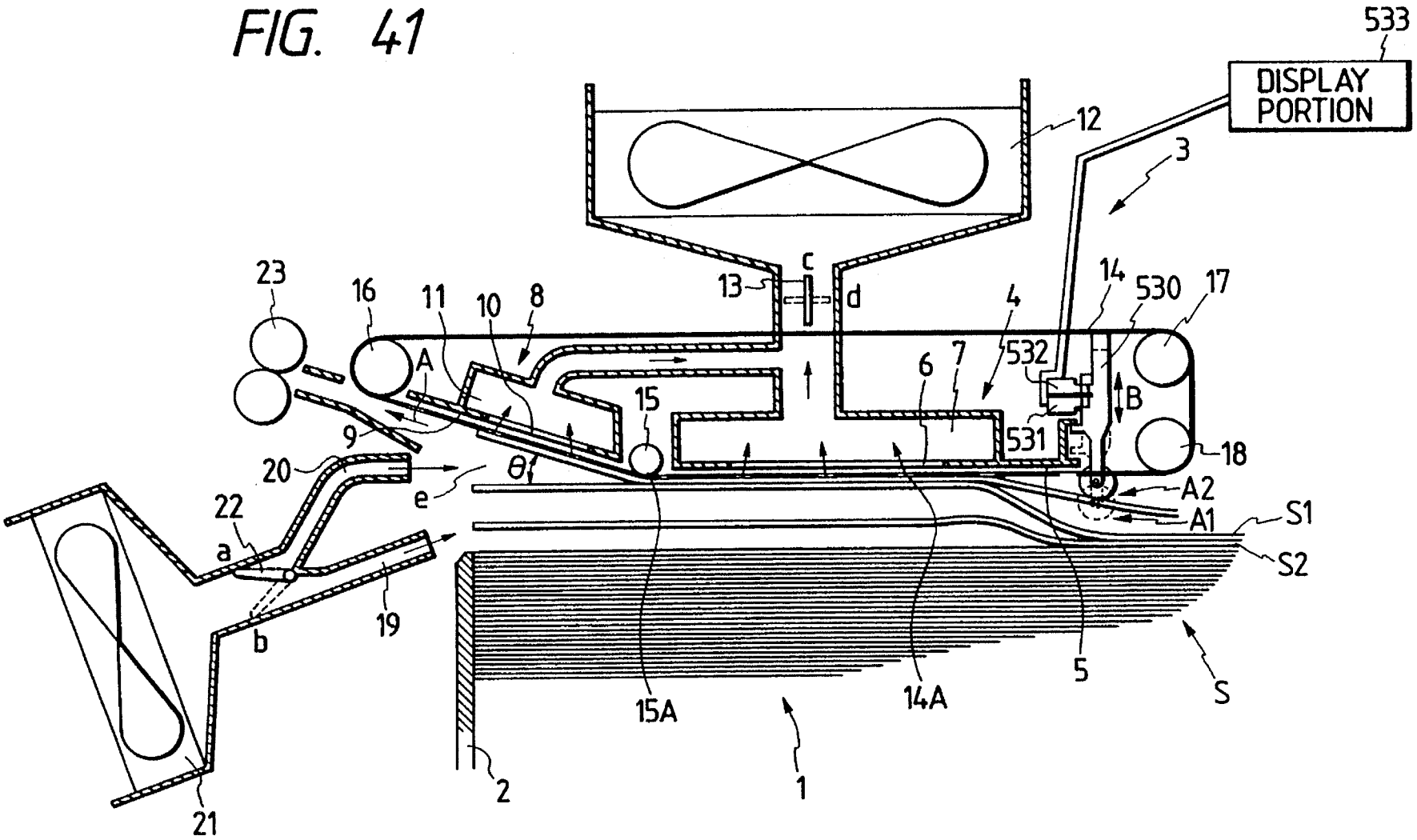

Next, a twenty-fourth embodiment of the present invention will be explained with reference to FIGS. 39 to 41. Incidentally, in this twenty-fourth embodiment, a detection means for detecting the resilience of the sheet is provided in the sheet supply apparatus of the first embodiment. Further, since the fundamental construction of a sheet supply apparatus according to the twenty-third embodiment is substantially the same as that of the first embodiment, the same constructural elements are designated by the same reference numerals and the explanation thereof will be omitted. FIG. 39 is a sectional view of the sheet supply apparatus, FIG. 40 shows a condition that a (thin) sheet having the weak resilience is supplied by the sheet supply apparatus, and FIG. 41 shows a condition that a (thick) sheet having the strong resilience is supplied by the sheet supply apparatus.

A detection projection (detection means) 530 is arranged at an upstream side of the first sheet absorb means 4 in the sheet convey direction and is disposed above the sheet stack S rested on the sheet stacking tray 1 to protrude downwardly from the flat bottom plate 5 of the first sheet absorb means toward the sheet stacking tray 1. The detection projection 530 is movable to a direction shown by the arrow B in FIG. 39. Photo-sensors (detection means) 531, 532 for detecting the position of the detection projection 530 are provided, so that ON and OFF are switched by the shifting movement of the detection projection 530 in an up-and-down direction. These photo-sensors are used when various conditions regarding the sheet supply operation and/or the transfer operation are set by the operator or a service man. First of all, when the sheet S is not absorbed to the first sheet absorb means 4, the condition shown in FIG. 39 is maintained, where both of the photo-sensors 531 and 532 are in an ON condition.

Then, by depressing a set start switch (not shown), the sheet S is absorbed to the first sheet absorb means 4 as mentioned above. In this case, a trailing end portion of the sheet S positioned at the upstream side of the first sheet absorb means 4 in the sheet convey direction is not absorbed to the first sheet absorb means 4 and is subjected to an upwardly directing force tending to follow the sheet along the flat bottom plate of the first sheet absorb means 4 due to the resilience of the sheet S. However, since the trailing end portion of the sheet is pushed downwardly by a force tending to dropping the detection projection 530, the trailing end portion of the sheet S is stopped at a position where these two forces are balanced. In case of the (thin) sheet having the weak resilience, since the detection projection 530 is stopped at a position A1 in FIG. 40, the photo-sensor 531 is turned OFF by the detection projection 530. As a result, "weak resilience" (thin sheet) is displayed on a display means 533. In case of the (thick) sheet having the strong resilience, since the detection projection 530 is stopped at a position A2 in FIG. 41, the photo-sensor 532 as well as the photo-sensor 531 are turned OFF. As a result, "strong resilience" (thick sheet) is displayed on the display means 533.

Thus, when the resilience of the sheet S is varied depending upon the kind of the sheet, the position where the above-mentioned two forces are balanced is also varied (that is to say, the position to which the detection projection 530 is shifted is varied). By measuring the shifting amount of the detection projection 530, it is possible to detect the resilience of the sheet S. By checking the detection result by means of the display means, the operator or the service man can understand the resilience of the sheet S and can set the optimum conditions regarding the transfer voltage, the air absorbing force in the sheet supply operation, the fixing temperature and the like.

Next, further embodiments of the present invention regarding the air absorb opening of the sheet absorb means 4 in the first embodiment will be explained.

Incidentally, since the fundamental construction of one of the further embodiments (twenty-fifth embodiment) is the same as that of the first embodiment, the detailed explanation thereof will be omitted, but only the characteristic portion will be fully explained with reference to FIG. 42 which is a bottom view of the sheet absorb means showing the characteristic of the twenty-fifth embodiment clearly.

In the conventional sheet supply apparatus, while air openings 6*a* formed in the flat bottom plate 5 of the air suction chamber 7 provided in the sheet convey portion 3 had same diameter, in this twenty-fifth embodiment, such air openings 6*a* are so arranged that the area of each air opening disposed nearest to the air sucking blower 12 is minimum and the area of each air opening disposed farthest from the air sucking blower 12 is maximum and the areas of the air openings are gradually increased as the openings go away from the air sucking blower 12.

Figure 42:
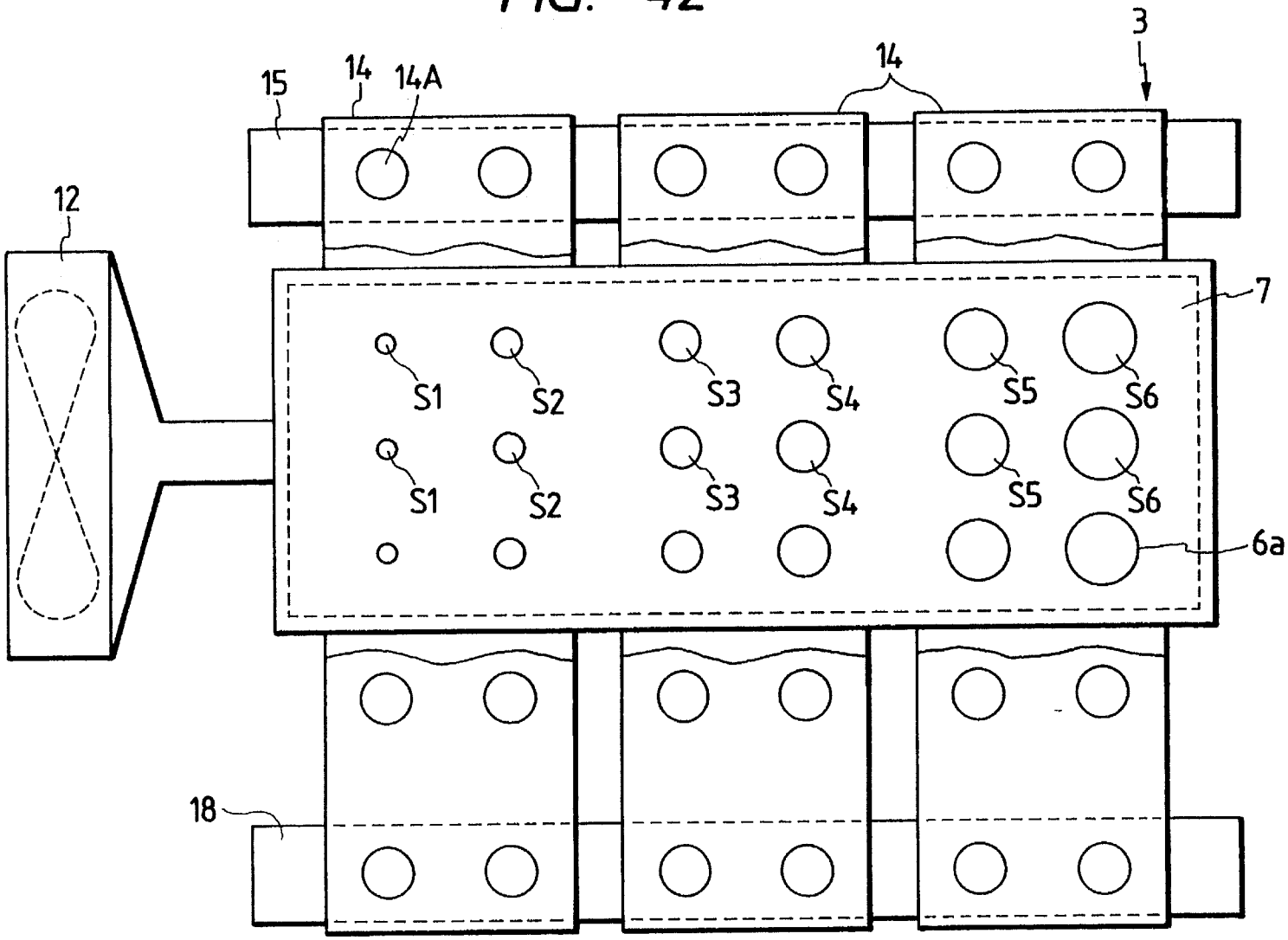
FIG. 42 is a bottom view of a sheet supply apparatus according to a twenty-fifth embodiment of the present invention.

In FIG. 42, the air suction chamber 7 is covered by a plurality of identical convey belts 14, and is communicated with the air sucking blower 12 at one end of the chamber (in a direction perpendicular to the sheet convey direction, i.e., a widthwise direction of the sheet), so that the air sucked from the air suction chamber 7 flows along a direction substantially perpendicular to the sheet convey direction.

Further, a plural rows (along the sheet convey direction) of air openings 6*a* having different opening areas are formed in the flat bottom plate 5 defining the suction chamber 7 at positions corresponding to the positions of the rows of the air openings 14A formed in the respective convey belts 14 in such a manner that the diameters of the air openings 6*a* in each row are identical and the areas of the air openings 6*a* are gradually increased as the air openings go away from the air sucking blower 12. That is to say, the opening areas of the air openings are selected so that, when the opening area of each air opening 6*a* nearest to the air sucking blower 12 is S1, the opening area of each air opening adjacent to the aforementioned one is S2 and so on, a relation $S1<S2<S3<S4<S5<S6< \ldots <Sn$ is established, and the air sucking pressure loss of each air opening is identical to each other.

The air sheet supply apparatus having the air suction chamber 7 with the above-mentioned arrangement is operated as follows. The air injection belower 21 is operated by a predetermined manipulation so that the air from the floating nozzle 19 is injected against the tip end of the sheet stack, thereby blowing up several sheets S to float. Then, the suction valve 13 is switched by the switch means (not shown) such as a solenoid from a position d shown by the broken line to a position c shown by the solid line so that the air sucking blower 12 is operated to suck the sheet S through the air openings 6*a*, 14A, thereby adhering the sheet S to the convey belts 14.

In this case, even when the sheet S to be conveyed is thickest, since the absorbing force of each convey belt 14 along the sheet convey direction is substantially constant, the sheet is not skew-fed and the end of the sheet is not depended down, with the result that only the uppermost sheet is surely adhered to the convey belts 14 closely by the positive separation action of the separating nozzle 20 and the sheet is surely conveyed in the downstream direction by the rotations of the rollers 15, 16, 17, 18.

Incidentally, in the above embodiment, while the air openings were circular, for example, a plural rows of air openings in the form of a trapezoid contacting with the circles S1 and S2, a trapezoid contacting with the circles S3 and S4 and a trapezoid contacting with the circles S5 and S6 respectively and having gradually increased opening areas, or integral air openings in the form of a trapezoid contacting with the circles S1 and S6 may be formed in the flat bottom plate.

Figure 43:
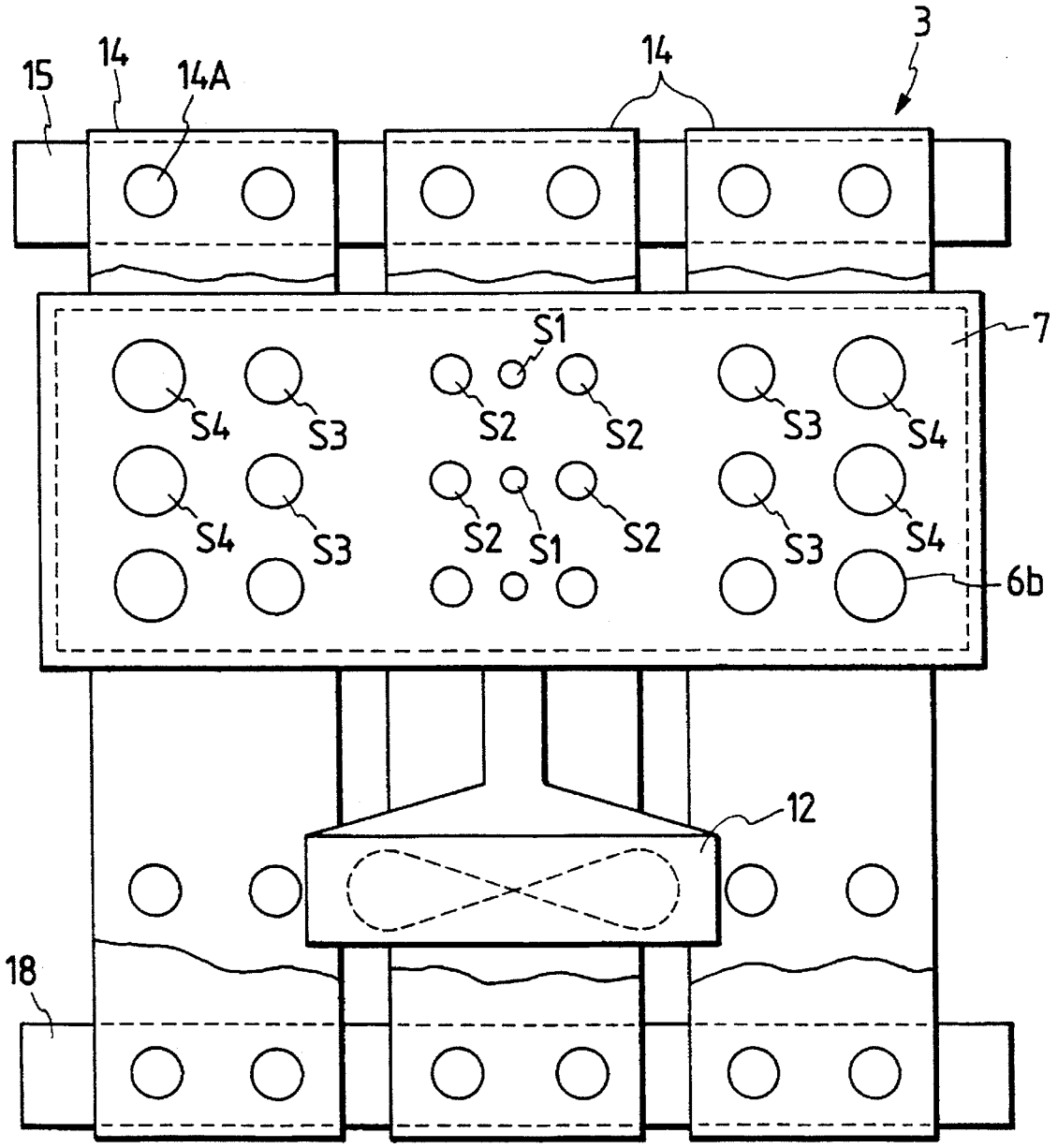
FIG. 43 is a bottom view of a sheet supply apparatus according to a twenty-sixth embodiment of the present invention.

Next, a twenty-sixth embodiment of the present invention will be explained. The same constructural elements as those of the twenty-fifth embodiment are designated by the same reference numerals and the explanation thereof will be omitted. FIG. 43 shows the twenty-sixth embodiment and is a bottom view of a sheet convey means to which the present invention is applied.

In the fifteenth embodiment, while the air sucking blower 12 was connected to one end of the air suction chamber 7 in the direction perpendicular to the sheet convey direction, in the twenty-sixth embodiment, as shown in FIG. 43, the air sucking blower 12 is connected to a central portion of one surface (facing the sheet convey direction) of the air suction chamber 7, and air openings 6*b* are arranged so that the opening areas of the air openings are gradually increased from a central portion (nearest to the blower 12) of the chamber to both ends of the chamber. In this way, the same technical effect as that of the fifteenth embodiment can be obtained.

Figure 44:
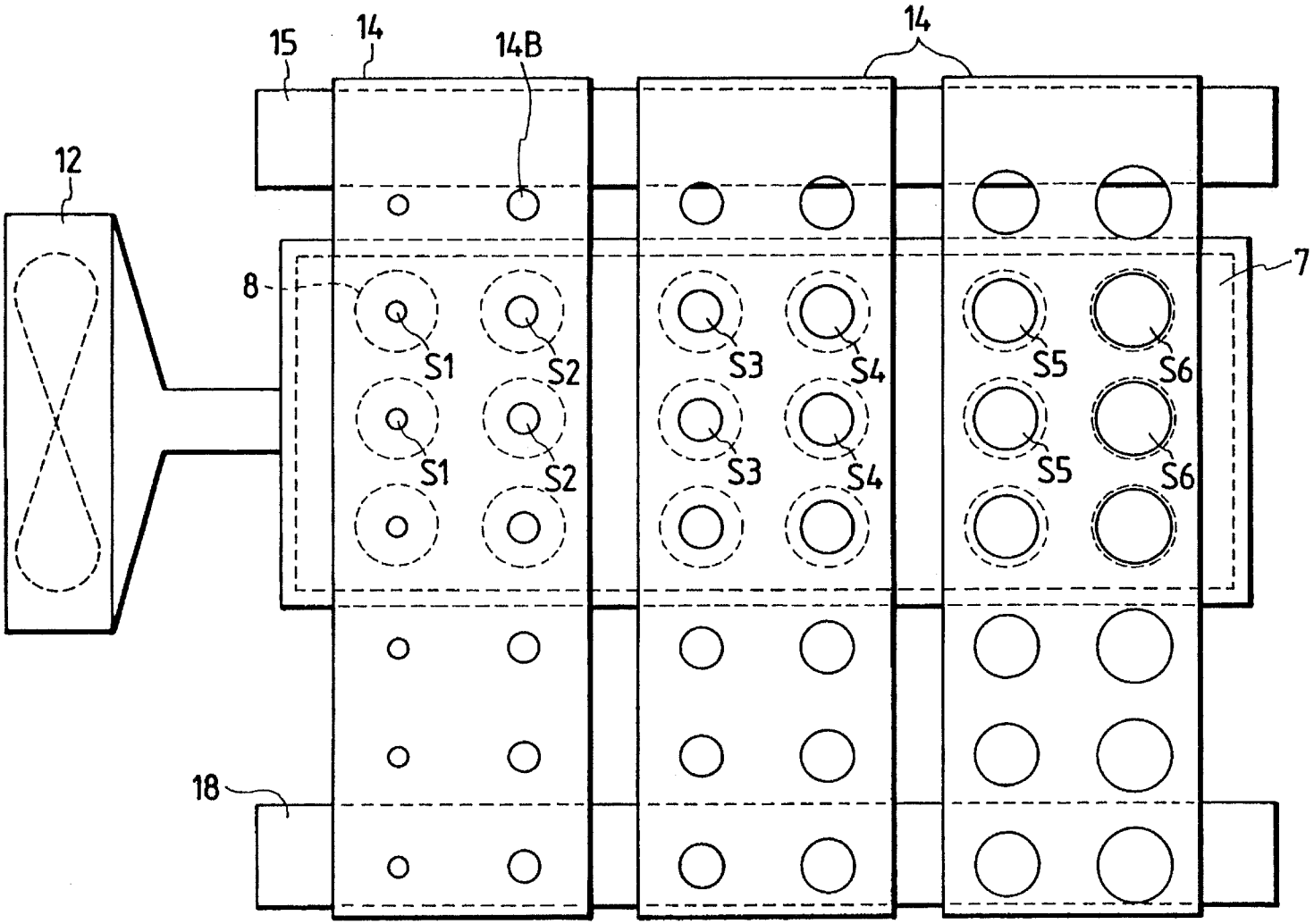
FIG. 44 is a bottom view of a sheet supply apparatus according to a twenty-seventh embodiment of the present invention.

FIG. 44 shows the twenty-seventh embodiment and is a bottom view of a sheet convey means to which the present invention is applied.

In the twenty-fifth embodiment, while the air openings 6*a* having the different opening areas were formed in the flat bottom plate 5 defining the air suction chamber 7, in the twenty-seventh embodiment, as shown in FIG. 44, although the air openings 6*a* having the same opening area are formed in the same manner as the conventional case in correspondence to the width of each convey belt 14, a plurality of air openings 14B formed in the convey belts 14 are arranged so that, as in the twenty-second embodiment, the opening areas of the air openings 14B are gradually increased as the air openings go away from the air sucking blower 12.

Next, a twenty-eighth embodiment of the present invention in which a means for reducing the moisture absorption of the sheet is provided in the apparatus of the first embodiment will be explained.

Figure 45:
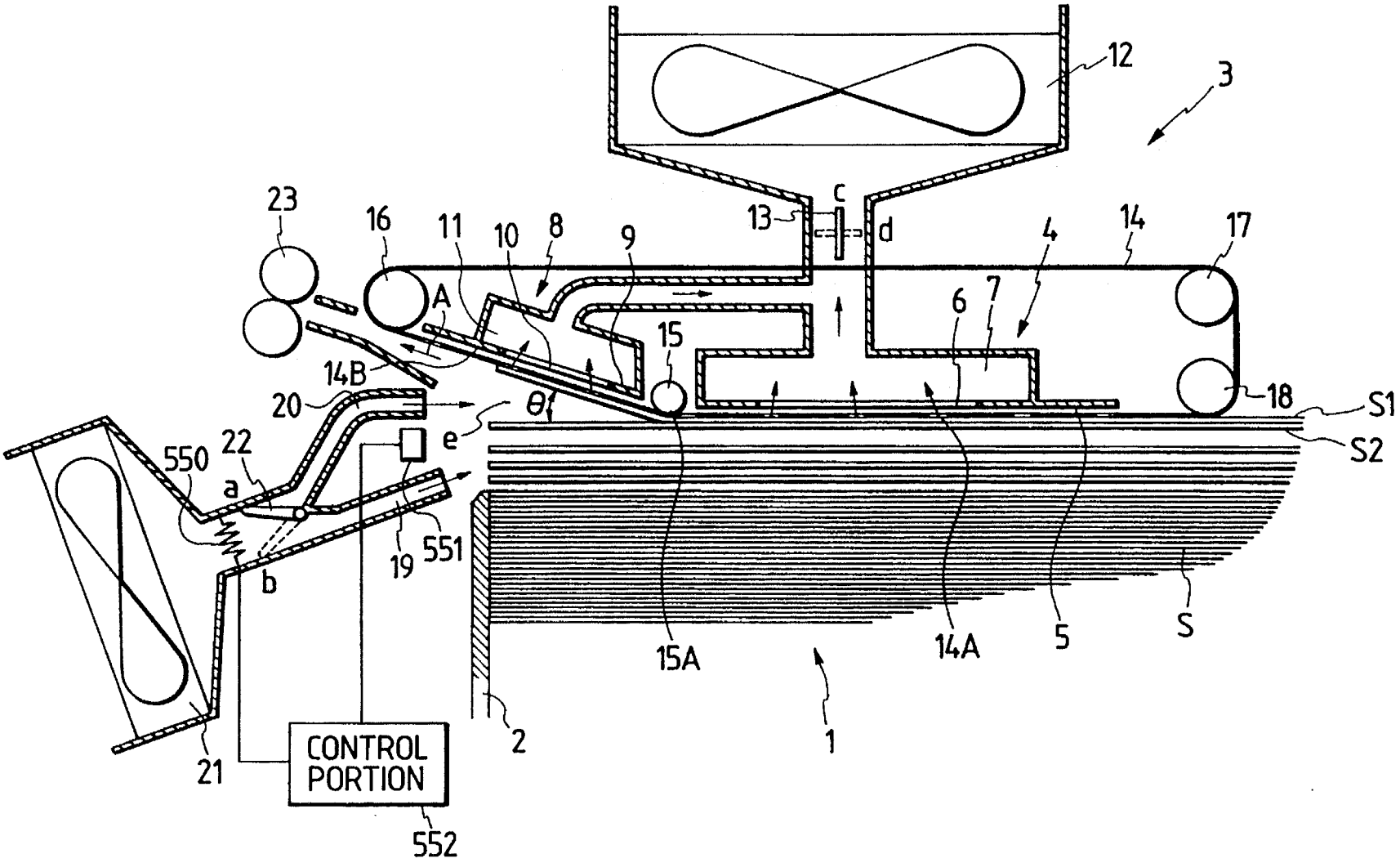
FIG. 45 is an elevational sectional view of a sheet supply apparatus according to a twenty-eighth embodiment of the present invention.

In FIG. 45, a heater 550 is arranged between the blower 21 and the nozzles 19, 20. A temperature sensor 551 for detecting the temperature of the proximity of the sheet stack S is arranged in the vicinity of the sheet stacking tray 1. The heater 550 is appropriately controlled by a control means 552 on the basis of the detection result of the temperature sensor 551.

Next, the operation of the apparatus according to the twenty-eighth embodiment will be described.

Both when the sheet supply operation of the sheet supply apparatus is effected and when the sheet supply operation is not effected, the heater 550 is always driven to generate heat. Accordingly, the hot air always flows along the surfaces of several sheets on the sheet stack.

Figure 46:
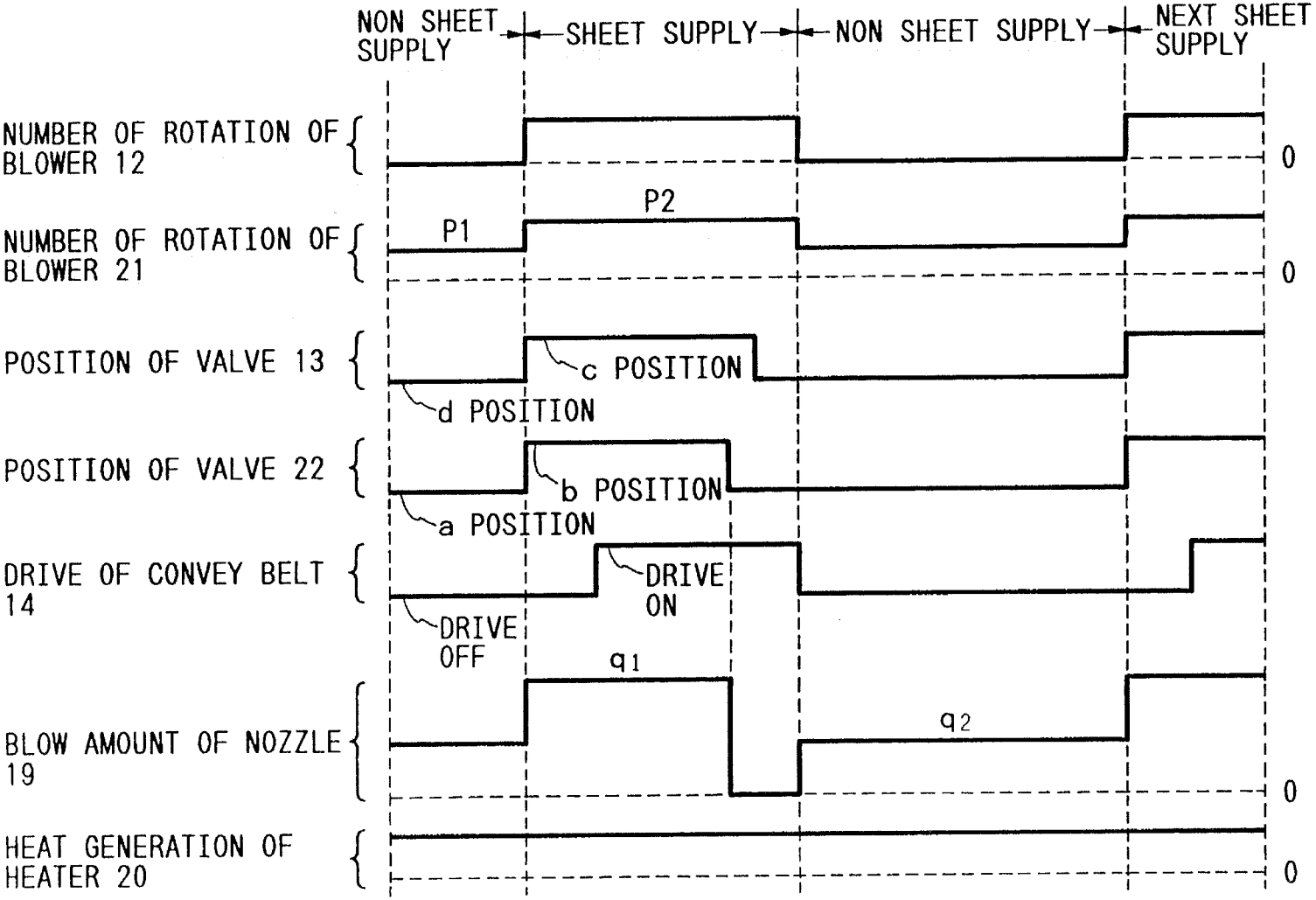
FIG. 46 is a drive timing chart of the apparatus of FIG. 45.

FIG. 46 is a detailed drive timing chart regarding this embodiment. When the sheet supply operation is not effected, the blower 12 is not rotated; however, when the sheet supply operation is started the blower is rotated and when the sheet supply operation is finished the blower is stopped. When the sheet supply operation is not effected, the blower 21 is being rotated at the number p1 of rotation which is smaller than the number of rotation in the sheet supply operation, and when the sheet supply operation is started the blower is rotated at the number p2 (>p1) of rotation, and when the sheet supply operation is finished the number of rotation of the blower is returned to p1.

When the sheet supply operation is not effected, the valve 13 is in the position d; but, when the sheet supply operation is effected, the valve 13 is switched to the position c, and, immediately before the sheet supply operation is finished, the valve is returned to the position d. When the sheet supply operation is not effected, the valve 22 is in the position a; but, when the sheet supply operation is effected, the valve 22 is switched to the position b, and, immediately before the sheet supply operation is finished, the valve is returned to the position a.

When the sheet supply operation is not effected, the drive of the convey belt 14 is in the OFF condition; but, when the sheet supply operation is started and the sheet has been adhered to the convey belt 14, the drive of the convey belt is turned ON to convey the sheet. By controlling the blower 21 and the valve 22 as mentioned above, the blow amount of the nozzle 19 becomes as shown in FIG. 46 so that, when the sheet supply operation is not effected, the air is injected with the blow amount q2 smaller than the blow amount q1 (during the sheet supply operation). The heater 550 is turned ON both when the sheet supply operation is being effected and when the sheet supply operation is stopped.

In this way, even when the sheet supply operation is not effected, by sending the hot air to the several sheets, since it is possible to float the several sheets and to pass the hot air along both surfaces of each sheet, thereby reducing the moisture absorption of the sheet and making the hygroscopicity of the sheets uniform, it is possible to perform the excellent image formation without any image flow and the curl in the sheet S.

Further, particularly in this embodiment, since the air sheet supply apparatus is used as the sheet supply apparatus and the air blowing means for reducing the moisture absorption of the sheet and for making the hygroscopicity of the sheets uniform also serves as the air blowing means (blower 21 and nozzle 19) for floating the sheets in the sheet supply apparatus, the sheet supply apparatus is prevented from making large-sized and expensive. Incidentally, in this embodiment, while the blow amount from the nozzle in the non-sheet supply period was smaller than the blow amount in the sheet supply operation to reduce the noise, the blow amount in the non-sheet supply period may be equal to the blow amount in the sheet supply operation, or, when the sheet supply apparatus is used under the high humidity condition, the blow amount in the non-sheet supply period may be greater than the blow amount in the sheet supply operation to further reduce the moisture absorption of the sheet S and to make the hygroscopicity of the sheets further uniform.

Further, while an example that the present invention is applied to the air sheet supply was explained, the present invention is not limited to this example, but the air blowing means may be provided in a roller sheet supply apparatus, for example. Accordingly, the kind of the sheet supply apparatus is not limited. Furthermore, in this embodiment, while the air was always injected from the nozzle 19 even in the non-sheet supply period, for example, in order to save the electric power and to reduce the noise, a means for manually turning OFF the air injection when the image forming apparatus is not used for a long time may be provided.

Next, a twenty-ninth embodiment of the present invention in which the arrangement of the blower 12 is changed with respect to the first embodiment will be explained.

Figure 47:
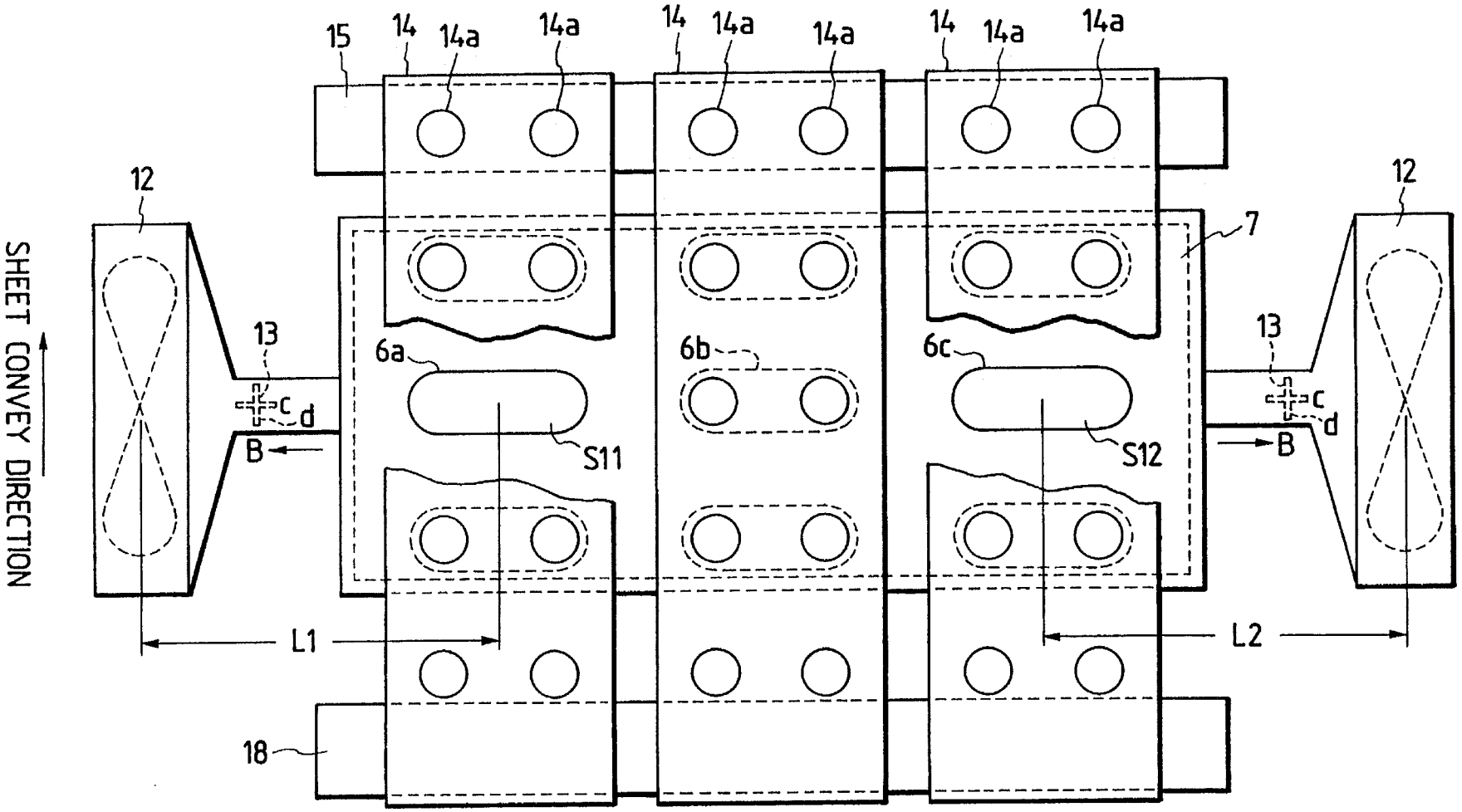
FIG. 47 is a bottom view of a sheet supply apparatus according to a twenty-ninth embodiment of the present invention.

Since the fundamental construction and the general function of this embodiment are the same as those of the first embodiment, the detailed explanation thereof will be omitted, but only the characteristic portion will be fully explained with reference to FIG. 47 which is a bottom view of the sheet convey means showing the characteristic of the twenty-ninth embodiment clearly. In FIG. 47, air sucking blowers 12 having the identical ability are connected to both ends of the air suction chamber (in a direction perpendicular to the sheet convey direction), so that the air sucked from the air suction chamber 7 flows from a center of the air suction chamber 7 to the both ends thereof as shown by the arrows B. Further, a plurality of air openings **6*a*, 6*b*, 6*c* are formed in the flat bottom plate 5 defining the air suction chamber 7 at positions corresponding to the positions of the air openings 14A formed in the respective convey belts 14. Particularly, the opening areas of the air openings are so selected that the absorbing forces of the air sucking blowers 12 at the air openings 6*a* and 6*c* are equal to each other and the air suction pressure losses at the air openings 6*a* and 6*b*** are equal to each other.

For example, when distances between the air sucking blowers 12 positioned at both ends (in a direction perpendicular to the sheet convey direction) of the suction chamber and the air openings **6*a*, 6*c* are L1, L2, respectively, and the opening areas of the air openings 6*a*, 6*c*** are S11, S12, respectively, the opening areas are adjusted independence upon the above-mentioned distances so that when L1=L2 a relation S11=S12 is established and when L1>L2 a relation S11>S12 is established and when L1<L2 a relation S11<S12 is established, thereby equalizing the sheet absorbing forces at both ends of the sheet (in a widthwise direction).

The air sheet supply apparatus having the sheet convey means with the above-mentioned arrangement is operated as follows.

As in the conventionl apparatus, the air injection blower 21 is operated by a predetermined manipulation so that the air from the floating nozzle 19 is injected against the tip end of the sheet stack, thereby blowing up several sheets S to float. Then, the suction valve 13 is switched by the switch means (not shown) such as a solenoid from a position d shown by the broken line to a position c shown by the solid line so that the air sucking blowers 12 are operated to suck the air through the air openings **6*a*, 6*b*, 6*c* and 14A, thereby adhering the sheet S to the convey belts 14**.

In this case, even when the sheet S to be conveyed is thickest, since the absorbing forces to the convey belts 14 in the widthwise direction of the sheet are substantially the same, the sheet is not skew-fed and the end of the sheet S is not depended down, with the result that only the uppermost sheet is surely adhered to the convey belts 14 closely by the positive separation action of the separating nozzle 20 and the sheet is surely conveyed in the downstream direction by the rotations of the rollers 15, 16, 17 and 18.

Figure 48:
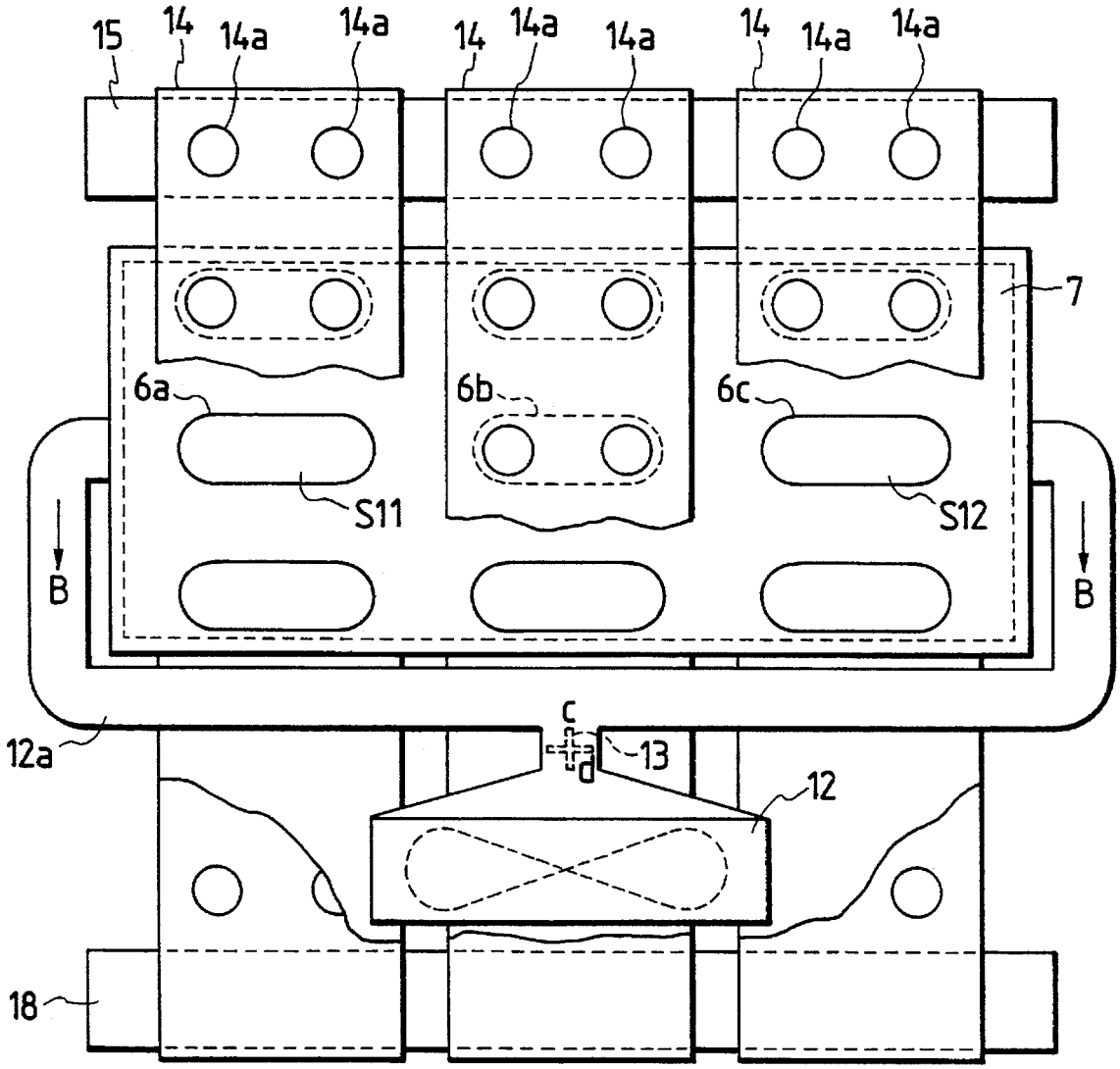
FIG. 48 is a bottom view of a sheet supply apparatus according to a thirtieth embodiment of the present invention.

Lastly, a thirtieth embodiment of the present invention of the present invention will be explained. The same constructural elements as those of the twenty-ninth embodiment are designated by the same reference numerals and the explanation thereof will be omitted. FIG. 48 shows the thirtieth embodiment and is a bottom view of the sheet convey means to which the present invention is applied.

In the twenty-ninth embodiment, while the air sucking blowers 12 were directly connected to both ends of the chamber 7 in the direction perpendicular to the sheet convey direction, in this embodiment, as shown in FIG. 48, one or more blower 12 is arranged within the central convey belt 14 and is connected to the air suction chamber 7 via ducts 12*a* connected to both ends of the chamber in the direction perpendicular to the sheet convey direction, thereby achieving the same technical effect as that of the twenty-ninth embodiment.

Incidentally, in FIG. 48, while the air sucking blower 12 was arranged within the central convey belt, it may be arranged outside of such convey belt.

What is claimed is:

1. A sheet supplying apparatus, comprising:

sheet support means for supporting a plurality of sheets;

sheet absorb means, arranged facing a surface of the sheets supported by said sheet support means, for absorbing a sheet of the plurality of sheets by air suction;

sheet feed means for feeding out the sheet absorbed by said sheet absorb means;

convey means disposed downstream of said sheet feed means for conveying the sheet fed out by said sheet feed means; and control means for controlling said sheet feed means and said sheet absorb means so that, when the sheet fed out by said sheet feed means stops being fed prior to reaching said convey means, said sheet feed means feeds the sheet in a direction opposite to the sheet feed direction to return it to said sheet support means, and said sheet absorb means absorbs the sheet at least until the sheet is returned to said sheet support means.

2. A sheet supplying apparatus according to claim 1, wherein said sheet absorb means includes first absorb means and second absorb means, an absorb surface of said first absorb means being disposed substantially parallel to surfaces of the sheets supported by said sheet support means, and an absorb surface of said second absorb means being inclined relative to the sheet surfaces so that the absorb surface is further from the sheet surfaces as it extends downstream in a sheet feeding direction, whereby the sheets are separated one by one by utilizing a tip end of the sheet absorbed by said second absorb means.

3. A sheet supply apparatus according to claim 2, wherein said second sheet absorb means comprises a cylindrical member having a plurality of air absorb openings on an outer peripheral surface thereof.

4. A sheet feeding apparatus according to claim 1, further comprising detection means for detecting whether the sheet reaches said convey means, said control means effecting the controlling based on the detecting by said detection means.

5. A sheet supply apparatus according to claim 1, wherein said sheet absorb means absorbs an uppermost sheet of the sheets supported by said sheet support means.

6. A sheet supply apparatus according to claim 1, wherein said sheet absorb means absorbs a lowermost sheet of the sheets supported by said sheet support means.

7. A sheet supply apparatus according to claim 1, wherein said convey means comprises a rotatable convey belt mounted on rollers to cover a surface of said sheet absorb means, and said convey belt is provided with a plurality of air openings, so that when said sheet absorb means absorbs the air the sheet is absorbed through said air openings for conveying.

8. A sheet supply apparatus according to claim 1, further comprising air blowing means for blowing air against a tip end of the sheet absorbed to promote separation of the sheet absorbed to said sheet absorb means.

9. A sheet supplying apparatus, comprising:

sheet support means for supporting a plurality of sheets;

sheet absorb means arranged facing a sheet surface of the sheets supported by said sheet support means for absorbing a sheet by air suction;

sheet feeding means for feeding out the sheet absorbed by said sheet absorb means;

air blowing means blowing the air against a tip end of the sheet for floating the sheet from said sheet support means; and heating means applying predetermined heat to said air blowing means for causing heated air to blow from said air blowing means.

10. A sheet supply apparatus according to claim 9, further comprising separation rotation means driven in a direction opposite to a drive direction of said sheet feeding means for separating the sheets fed out by said sheet feeding means one by one.

11. A sheet supply apparatus according to claim 10, wherein said separation rotation means has a separation belt spanned between rollers, and said separation belt is driven in synchronization with said sheet feeding means.

12. A sheet supply apparatus according to claim 10, further comprising double-feed detection means disposed in the proximity of said separation rotation means for detecting a double-feed of the sheets conveyed by said sheet feeding means, wherein said separation rotation means is driven when the double-feed is detected by said double-feed detection means.

13. A sheet supplying apparatus according to claim 9, further comprising moisture detection means disposed in proximity to said sheet support means for detecting moisture, said heating means being controlled based on the detection result of said moisture detection means to keep constant moisture at a point in proximity to the sheet.

14. A sheet supplying apparatus according to claim 9, wherein said sheet absorb means includes first absorb means and second absorb means, an absorb surface of said first absorb means being disposed substantially parallel to surfaces of the sheets supported by said sheet support means and an absorb surface of said second absorb means being inclined relative to the sheet surfaces so that the absorb surface is further from the sheet surfaces as it extends downstream in a sheet feeding direction, whereby the sheets are separated one by one by lifting a tip end of the sheet absorbed by said second absorb means.

15. A sheet supply apparatus, comprising:

sheet support means for supporting a plurality of sheets;

sheet absorb means for absorbing a sheet of the plurality of sheets supported by said sheet support means by air suction, said sheet absorb means including first absorb means and second absorb means, an absorb surface of said first absorb means being disposed facing surfaces of the sheets supported by said sheet support means and an absorb surface of said second absorb means being inclined relative to the sheet surfaces so that the absorb surface is further from the sheet surfaces as it extends downstream in a sheet feeding direction;

sheet feeding means for feeding out the sheet absorbed by said sheet absorb means; and angle adjust means for adjusting an inclined angle of said second sheet absorb means.

16. A sheet supply apparatus according to claim 15, wherein said angle adjust means decreases the inclined angle of said second sheet absorb means as the resilience of the sheet is increased.

17. A sheet supply apparatus according to claim 16, wherein said sheet feeding means has a rotatable convey belt spanned between rollers to cover sheet absorb surfaces of said first and second sheet absorb means, and said convey belt is provided with a plurality of air openings, so that when said sheet absorb means absorb the air the sheet is absorbed through said air openings.

18. An image forming apparatus, comprising:

sheet support means for supporting a plurality of sheets;

sheet absorb means arranged facing a surface of the sheets supported by said sheet support means for absorbing a sheet of the plurality of sheets by air suction;

sheet feed means for feeding out the sheet absorbed to said sheet absorb means;

convey means disposed downstream of said sheet feed means for conveying the sheet fed out by said sheet feed means;

control means for controlling said sheet feed means and said sheet absorb means so that, when the sheet fed out by said control means stops being fed prior to reaching said convey means, said sheet feed means feeds the sheet in a direction opposite to the sheet feed direction to return it to said sheet support means, and said sheet absorb means absorbs the sheet at least until the sheet is returned to said sheet support means; and image forming means for forming an image on the sheet conveyed by said conveying means.

19. An image forming apparatus, comprising:

sheet support means for supporting a plurality of sheets;

sheet absorb means for absorbing a sheet of the plurality of sheets supported by said sheet support means by air suction, said sheet absorb means including first absorb means and second absorb means, an absorb surface of said first absorb means being disposed substantially parallel to surfaces of the sheets supported by said sheet support means and an absorb surface of said second absorb means being inclined relative to the sheet surfaces so that the absorb surface is further from the sheet surfaces as it extends downstream in a sheet feeding direction;

sheet feeding means for feeding out the sheet absorbed by said sheet absorb means;

angle adjust means for adjusting an inclined angle of said second sheet absorb means; and an image forming means for forming an image on the sheet fed by said sheet feeding means.

20. A sheet supplying apparatus, comprising:

sheet support means for supporting a plurality of sheets thereon;

sheet absorb means arranged facing a sheet surface of the sheets supported by said sheet support means for absorbing a sheet by air suction;

sheet feeding means for feeding out the sheet absorbed to said sheet absorb means; and shock apply means for applying a shock to the sheet absorbed by said sheet absorb means to separate the sheets.

21. A sheet supplying apparatus according to claim 20, wherein said shock apply means includes sheet pressure means for shockably applying pressure to the sheet absorbed by said first absorb means.

22. A sheet applying apparatus according to claim 21, wherein said sheet pressure means includes a solenoid and a pressure rod operated by the solenoid, for pressurizing an absorbed surface of the sheet shockably.

23. A sheet supplying apparatus according to claim 20, wherein said shock apply means is a sheet pressure vibration rod for applying vibration to an absorbed surface of the sheet.

24. A sheet supplying apparatus according to claim 20, wherein said sheet absorb means includes first absorb means and second absorb means, an absorb surface of said first absorb means being disposed substantially parallel to surfaces of the sheets supported by said sheet support means, and an absorb surface of said second absorb means being inclined relative to the sheet surfaces so that the absorb surface is further from the sheet surfaces as it extends downstream in a sheet feeding direction, whereby the sheets are separated one by one by lifting a tip end of the sheet absorbed by said second absorb means.

* * * * *

UNITED STATES PATENT AND TRADEMARK OFFICE

CERTIFICATE OF CORRECTION

PATENT NO. : 5,478,066

DATED : December 26, 1995

INVENTOR(S) : YASUMI YOSHIDA, ET AL.

It is certified that error appears in the above-indentified patent and that said Letters Patent is hereby corrected as shown below:

On title page, item [56], "4358637 12/1992 Japan" should be deleted,

"3079525 4/1991 Japan" should read --3-79525 4/1991 Japan--, and "4169433 6/1992 Japan" should read --4-169433 6/1992 Japan--.

Column 1,
line 29, "is" should read --are--.

Column 5,
line 59, "is" should read --are--.

Column 9,
line 65, "stack So" should read --stack S.--.

Column 15,
line 10, "fundamentary," should read --fundamentally,--.

Column 21,
line 28, "is" should read --are--.

UNITED STATES PATENT AND TRADEMARK OFFICE

CERTIFICATE OF CORRECTION

PATENT NO. : 5,478,066
DATED : December 26, 1995
INVENTOR(S) : YASUMI YOSHIDA, ET AL.

It is certified that error appears in the above-indentified patent and that said Letters Patent is hereby corrected as shown below:

Column 25,
line 45, "a" should be deleted; and
line 63, "belower" shoul dread --blower--.
Column 26,
line 16, "a" should be deleted.
Column 31,
line 17, "said sheet" should read --said first and second sheet--.

Signed and Sealed this

Seventeenth Day of September, 1996

*Attest:*

*Attesting Officer*

BRUCE LEHMAN

*Commissioner of Patents and Trademarks*